US007595138B2

(12) United States Patent
Yuasa

(10) Patent No.: US 7,595,138 B2
(45) Date of Patent: Sep. 29, 2009

(54) TONER, TWO-COMPONENT DEVELOPER, AND IMAGE FORMING METHOD

(75) Inventor: Yasuhito Yuasa, Katano (JP)

(73) Assignee: Panasonic Corporation, Osaka (JP)

( * ) Notice: Subject to any disclaimer, the term of this patent is extended or adjusted under 35 U.S.C. 154(b) by 378 days.

(21) Appl. No.: 10/538,634

(22) PCT Filed: Nov. 27, 2003

(86) PCT No.: PCT/JP03/15137

§ 371 (c)(1),
(2), (4) Date: Jun. 10, 2005

(87) PCT Pub. No.: WO2004/053598

PCT Pub. Date: Jun. 24, 2004

(65) Prior Publication Data

US 2006/0057482 A1 Mar. 16, 2006

(30) Foreign Application Priority Data

Dec. 10, 2002 (JP) ..... 2002-358641

(51) Int. Cl.
*G03G 9/08* (2006.01)

(52) U.S. Cl. ..... 430/108.11; 430/108.3; 430/108.4; 430/111.35; 430/108.2

(58) Field of Classification Search ..... 430/108.4, 430/108.11, 108.2, 108.3, 111.35
See application file for complete search history.

(56) References Cited

U.S. PATENT DOCUMENTS

| | | | | |
|---|---|---|---|---|
| 5,155,000 | A | 10/1992 | Matsumura et al. | |
| 5,248,851 | A | 9/1993 | Nakayama et al. | |
| 5,378,572 | A | 1/1995 | Akiyama et al. | |
| 5,567,561 | A | 10/1996 | Yoshikawa et al. | |
| 5,604,071 | A | 2/1997 | Okado et al. | |
| 5,698,357 | A | 12/1997 | Inoue et al. | |
| 5,702,859 | A | 12/1997 | Kubota, et al | |
| 5,837,413 | A | 11/1998 | Yada et al. | |
| 6,106,986 | A | 8/2000 | Shirai et al. | |
| 6,156,473 | A * | 12/2000 | Tyagi et al. | 430/108.4 |
| 6,210,852 | B1 | 4/2001 | Nakamura | |
| 6,352,808 | B1 | 3/2002 | Hagi et al. | |
| 6,408,155 | B1 | 6/2002 | Tajima et al. | |
| 2002/0064401 | A1 | 5/2002 | Ashikari | |
| 2002/0064724 | A1 | 5/2002 | Nakamura et al. | |
| 2002/0086229 | A1* | 7/2002 | Yuasa et al. | 430/108.4 |
| 2003/0091923 | A1* | 5/2003 | Kobayashi et al. | 430/111.33 |
| 2003/0152857 | A1* | 8/2003 | Sugiura et al. | 430/109.2 |
| 2004/0058258 | A1* | 3/2004 | Yoshino et al. | 430/108.1 |

FOREIGN PATENT DOCUMENTS

| | | |
|---|---|---|
| EP | 0 744 667 | 11/1996 |
| EP | 0 952 495 | 10/1999 |
| EP | 1 059 568 | 12/2000 |
| JP | 61-80161 | 4/1986 |
| JP | 61-80162 | 4/1986 |
| JP | 61-80163 | 4/1986 |
| JP | 63-174068 | 7/1988 |
| JP | 2619439 | 6/1989 |
| JP | 2744790 | 11/1989 |
| JP | 2-266372 | 10/1990 |
| JP | 2-271364 | 11/1990 |
| JP | 3-242657 | 10/1991 |
| JP | 4-452 | 1/1992 |
| JP | 4-274443 | 9/1992 |
| JP | 5-34984 | 2/1993 |
| JP | 5-72802 | 3/1993 |
| JP | 5-165250 | 7/1993 |
| JP | 5-188632 | 7/1993 |
| JP | 5-241367 | 9/1993 |
| JP | 5-333584 | 12/1993 |
| JP | 6-89045 | 3/1994 |
| JP | 8-314184 | 11/1996 |
| JP | 9-34162 | 2/1997 |
| JP | 9-43909 | 2/1997 |
| JP | 9-120174 | 5/1997 |
| JP | 9-281748 | 10/1997 |
| JP | 10-20563 | 1/1998 |
| JP | 10-161340 | 6/1998 |
| JP | 2801507 | 7/1998 |
| JP | 2000-10338 | 1/2000 |
| JP | 2000-66438 | 3/2000 |
| JP | 2000-89503 | 3/2000 |
| JP | 2000-214638 | 8/2000 |
| JP | 2001-100453 | 4/2001 |
| JP | 2001-209209 | 8/2001 |
| JP | 2001-249511 | 9/2001 |
| JP | 2001-296688 | 10/2001 |
| JP | 2001-318506 | 11/2001 |

(Continued)

OTHER PUBLICATIONS

"Technical Information TI 1222, Special hydrophobic AEROSIL® (SHA) for Toners", Nippon Aerosil, (2001) p. 5.*
English language translation of JP 2002-287408 (Oct. 2002).*

*Primary Examiner*—Christopher RoDee
(74) *Attorney, Agent, or Firm*—Hamre, Schumann, Mueller & Larson, P.C.

(57) ABSTRACT

A toner of the present invention is a toner comprising an additive and a toner matrix that contains a binder resin, a colorant, and a wax, in which the additive contains an inorganic micropowder to whose surface polysiloxane and at least one selected from fatty acids and derivatives thereof are adhered. Thus, the present invention provides the toner, a two-component developer, and an image forming method with which oil-less fixing is possible without the use of an oil on a fixing roller. Furthermore, the present invention provides the two-component developer that causes less carrier deterioration by toner-spent even when used in combination with a toner containing wax or another such release agent and thus the developer has good durability. In addition, the present invention provides the toner, the two-component developer, and the image forming method with which partial transfer defects are reduced and high transfer efficiency can be obtained.

26 Claims, 6 Drawing Sheets

FOREIGN PATENT DOCUMENTS

| | | |
|---|---|---|
| JP | 2002-14489 | 1/2002 |
| JP | 2002-23429 | 1/2002 |
| JP | 2002-41977 | 2/2002 |
| JP | 2002-169324 | 6/2002 |
| JP | 2002-202624 | 7/2002 |
| JP | 2002-229253 | 8/2002 |
| JP | 2002-287408 | 10/2002 |
| JP | 2002-296829 | 10/2002 |
| JP | 2002-311784 | 10/2002 |
| WO | 98/20396 | 5/1998 |

* cited by examiner

TONER, TWO-COMPONENT DEVELOPER, AND IMAGE FORMING METHOD

TECHNICAL FIELD

The present invention relates to a two-component developer and an image formation device used in copiers, laser printers, plain paper fax machines, color PPCs, color laser printers, color fax machines, and apparatuses that combine these functions.

BACKGROUND ART

Electrophotographic apparatuses in recent years have been shifting from office use to personal use, and this has been accompanied by a need for these apparatuses to be smaller and faster, to provide higher image quality, to be maintenance-free, and so on. Accordingly, some of the requirements these apparatuses now must meet include use of a cleaner-less process in which waste toner is recovered in development, without having to clean away waste toner left behind after transfer; the use of a tandem color process with which color images can be output at a high speed; oil-less fixing with which a sharp color image having high gloss and high optical transmissivity can be obtained with no offset even without the use of a fixing oil for preventing offset during fixing; easy maintenance; and low ozone emission. All of these functions must be realized at the same time, and improving toner characteristics, and not only the process, is an important factor.

With a color printer, an image support (hereinafter referred to as a photosensitive member) is charged by corona discharge, using a charger, after which the photosensitive member is irradiated with various colors of latent image in the form of optical signals, thereby forming an electrostatic latent image. This is developed with a first color (such as yellow) toner to visualize the latent image. After this, a transfer member that has been charged to the opposite polarity of the charge of the yellow toner is brought into contact with the photosensitive member, which transfers the yellow toner image formed on the photosensitive member. The photosensitive member is destaticized after cleaning away any toner remaining behind from transfer, which concludes the development and transfer of the first color toner. Then, for other toner colors such as magenta and cyan, the same operation as for yellow toner is repeated, which builds up toner images of various colors on the transfer member and forms a color image. These superimposed toner images then are transferred onto a paper that has been charged to the opposite polarity from that of the toner, and this constitutes a four-pass color process.

There also has been a proposal for a tandem color process in which a primary transfer process first is executed by disposing in a row a plurality of image formation stations having a charger, a photosensitive member, a developing unit, and so forth, and bringing an endless transfer member into contact with the photosensitive member to continuously transfer consecutive colors of toner to the transfer member, so that a multilayer transferred color toner image is formed on the transfer member, and then a secondary transfer process is executed by transferring the multilayer toner image formed on the transfer member all at once to a transfer medium such as a paper or an overhead projector (OHP) sheet, as well as a proposal for a tandem color process involving direct and successive transfer to the paper, OHP sheet, or other transfer medium, without using a transfer member.

In the fixing process, with a color image, the color toner must be melted to mix the colors and increase optical transmissivity. If the toner does not melt sufficiently, light is scattered on the surface or in the interior of the toner image, resulting in a loss of the original color tone of the toner dye and preventing the light from reaching lower layers in overlapping portions, which decreases color reproducibility. Therefore, one of the conditions required for a toner is that it be capable of completely melting and have enough optical transmissivity that does not impair color tone. The need for OHP sheets to have good optical transmissivity has increased as color presentations have become more commonplace. When a color image is obtained, offset occurs when toner adheres to the surface of the fixing roller, so that the fixing roller has to be coated with a large quantity of oil or the like, which complicates handling and the apparatus configuration. Consequently, there is a need for oil-less fixing, in which no oil is used during fixing (discussed below), in order to make apparatuses smaller, easier to maintain, and less expensive. A design in which a wax or other such release agent is added to a binder resin having sharp melting characteristics is starting to be put to use in an effort to accomplish this goal.

However, a problem with a toner such as this is that the toner has the property of being highly cohesive, so that toner image disruption during transfer and the tendency toward poor transfer are likely to be more pronounced, making it difficult to achieve both good transfer and good fixing. Also, in the course of two-component development, toner-spent tends to occur, in which the low-melting point component of the toner adheres to the carrier surface as a result of heat generated by mechanical impact and friction, such as impact and friction between particles, or impact and friction between particles and the developing unit. This diminishes the ability of the carrier to be charged, and shortens the service life of the developer. In an effort to provide a coated carrier having an extended-life, it has been proposed, for example, in Patent Document 1 (see below) that the surface of a carrier core be coated with a resin of a copolymer of a nitrogen-containing fluoroalkyl (meth)acrylate and a vinyl monomer, a copolymer of a fluoroalkyl (meth)acrylate and a nitrogen-containing vinyl monomer, or the like. It is stated in these documents that a coated carrier with a relatively long service life can be obtained by coating the carrier core surface with a solvent-soluble fluorine-containing polymer having imide bonds, or a copolymer of a nitrogen-containing monomer and a fluorinated monomer. Nevertheless, the resin adhesive strength is low at the adhesive boundary with the carrier, and the strength of the resin is too low, so that adequate impact resistance has yet to be obtained. Also, the chargeability of fluorine makes it difficult to negatively charge the toner, so that an adequate charge cannot be imparted to the toner, resulting in image fogging, uneven density, and other such problems.

Patent Document 2, for example, proposes a carrier coated with a silicone resin containing an aminosilane coupling agent in combination with a toner of specific components in an effort to improve the durability of a developer by preventing a decrease in toner charge in atmospheres of high humidity, but these approaches were inadequate in terms of preventing toner-spent.

Patent Document 3 proposes a carrier in which fluorine-substituted alkyl groups have been introduced into the silicone resin of a coating layer, as opposed to positively-chargeable toner. Patent Document 4 proposes a coated carrier containing conductive carbon and a crosslinked fluorine-modified silicone resin, which affords better developing performance in a high speed process, and this performance does not deteriorate over an extended period. This takes advantage of the excellent charging characteristics of a silicone resin, and the fluorine-substituted alkyl groups impart lubricity, partability, water repellency, and other such benefits, make wear, separation, cracking, and the like less likely to occur, and prevent toner-spent. However, not only is the effect unsatisfactory in terms of wear, separation, cracking, and the like, but while suitable charging is obtained with a positively-chargeable toner, when a negatively-chargeable toner is used, the amount of charge is too low, oppositely chargeable toner (positively-chargeable toner) is generated in large quantity, fogging, toner scattering, and other such problems occur, and the product cannot stand up to actual use.

A variety of toner compositions also have been proposed. As is well known, a toner for electrostatic charge development used in electrophotography generally includes a resin component (binder resin), a coloration component composed of a pigment or dye, a plasticizer, a charge control agent, and any necessary additives such as a release agent. A natural or synthetic resin is used, either singly or as a suitable mixture, as the resin component.

The above-mentioned additives are pre-mixed in an appropriate ratio, the mixture is heated and kneaded by thermal melting, and finely pulverized with an air stream collision board, and the resulting fine powder is graded to complete a toner matrix. Chemical polymerization such as emulsion aggregation or suspension polymerization is another way to produce a toner matrix. After this, an additive such as hydrophobic silica is added to the toner matrix to complete the toner. Toner alone is used in single-component development, while a two-component developer is obtained by mixing toner with a carrier composed of magnetic particles.

Patent Document 5 discloses the constitution in which $TiO_2$ whose surface is coated with a compound with a melting point of 40 to 150° C., such as a $C_{13}$ to $C_{39}$ saturated fatty acid, a fatty acid ester, or a aliphatic alcohol having at least 15 carbon atoms, is added, and provides a toner whose fluidity and anti-caking properties are improved, and in which cleaning defects hardly occur.

Patent Document 6 discloses a toner containing titanium oxide treated with a fatty acid metal salt (A), and a carrier comprising ferrite particles covered with fluorine resin (B), and provides the effect of enhancing charging stability of the developer and speeding up the start of charging after a new toner is supplied.

Patent Document 7 discloses resin microparticles that have an average particle size of 0.03 to 2.0 μm and whose surfaces have been treated with a fatty acid or a fatty acid derivative, and discloses the effect of obtaining images that are faithful to latent images regardless of the condition of the transfer material, and, in particular, high quality images without partial transfer defects.

Patent Document 8 discloses a toner containing inorganic micropowder subjected to treatment for imparting hydrophobic property through hydrolysis of a fatty acid compound in an aquatic system and inorganic micropowder subjected to treatment for imparting hydrophobic property with silicone oil in an aquatic system, and provides a color toner that is affected less by temperature and humidity, has a stable friction chargeability, and is excellent in producing sharp images without fogging and in durability.

Patent Document 9 discloses a constitution in which magnetic particles whose surfaces have been treated with a fatty acid, a fatty acid metal salt, or a fatty acid ester are added to a polyester resin, in order to obtain a positively-chargeable magnetic toner having a stable image quality even under the condition of high humidity and high temperature.

Patent Document 10 discloses a constitution in which an inorganic compound whose surface has been treated with at least one treatment agent selected from the group consisting of fatty acid metal salts and $C_{20}$ to $C_{60}$ alcohols being solid at room temperature is added, and proposes a dry toner for electrostatic charge development that has good fluidity, good cleaning property, excellent environmental stability and durability, and does not cause toner filming on the surface of a photosensitive member, the surface of a carrier used in two-component development, or the surface of a charge imparting member used in one-component development.

Patent Document 11 discloses a constitution in which microparticles with core microparticles coated with a long chain fatty acid metal salt are added to the surface of toner particles. This constitution provides images that have good transfer and do not cause partial transfer defects in characters, while maintaining the image density.

Patent Document 12 discloses a magnetic toner containing hydrophobic silica and a superfine particle titanium oxide powder that is made hydrophobic by surface treatment with a fatty acid salt of aluminum, and provides a magnetic toner having a stable image quality for a long period of time without causing filming on the surface of a photosensitive member.

However, merely adding inorganic microparticles whose surfaces are treated with, for example, a fatty acid does not provide sufficient environmental characteristics, and the treatment amount is limited so that a sufficient charging stability and parting effect cannot be obtained, although the effect is achieved to a certain extent. Furthermore, a constitution in which a large amount of low-melting point wax is blended in a toner for oil-less fixing is not sufficient to maintain good fluidity or to stabilize the quality of developed images.

In Patent Document 13, a non-free fatty acid type of carnauba wax and/or a montan-based ester wax and an oxidized rice wax with an acid value of 10 to 30 are used as a wax serving as a release agent, while a vinyl copolymer having a melting point of 85 to 100° C. that is polymerized in the presence of a natural gas-based Fischer-Tropsch wax is used in Patent Document 14, and Patent Document 15 discloses that a polyhydric alcohol component is polycondensed with a dicarboxylic acid and a trivalent or higher carboxylic acid compound, the average dispersed particle size of the release agent is from 0.1 to 3 μm, the particle size of the additive is from 4 to 200 nm, and the addition is made in an amount of 1 to 5 parts by weight. Patent Document 16 discloses that fixability is enhanced by including a fluorine-modified polyolefin resin such as polypropylene that has been modified with an organofluorine compound such as perfluoro-octyl methacrylate. In Patent Document 17, it is stated that a toner with excellent fixability, offset resistance, and optical transmissivity can be obtained by using a product obtained from a synthetic hydrocarbon wax and an unsaturated polyvalent alkylcarboxylic acid and an alkyl alcohol or amine. In Patent Document 18, it is disclosed that offset resistance during fixing is improved by blending a low-molecular weight polyolefin containing fluorine and having a softening point of 80 to 140° C., which is a molten mixture of polytetrafluoroethylene and a low-molecular weight olefin, and it is stated that this is effective at improving fixability.

The purpose of adding a low-melting point release agent such as polyethylene or polypropylene wax to a resin composition obtained by blending or copolymerizing these high and low molecular weight components is to improve parting from a heat roller during fixing, and thereby increase offset resistance. However, it is difficult to increase the dispersibility of these release agents in a binder resin, oppositely chargeable toner tends to be generated, and fogging occurs in the non-image portions. Filming also tends to occur on the photosensitive member.

A particular problem is the phenomenon whereby the surface of the carrier, which is the toner transport and charging member, is contaminated in the course of using as a two-component developer a toner to which one of these release agents has been added (called toner-spent). Accordingly, there is a decrease in chargeability, as well as a drop in toner transport performance. Furthermore, carrier adhesion tends to be caused, which causes damage to the intermediate transfer member. Therefore, currently the carrier is replaced and discarded after being used for a certain length of time, which drives up the running costs.

Patent Document 1: JP S61-80161A
Patent Document 2: Japanese Patent No. 2,619,439
Patent Document 3: Japanese Patent No. 2,801,507
Patent Document 4: JP 2002-23429 A
Patent Document 5: JP S63-174068 A
Patent document 6: JP H04-452 A
Patent document 7: JP H04-274443A
Patent document 8: JP H05-34984A
Patent document 9: JP H05-72802A
Patent document 10: JP H05-165250A
Patent document 11: JP H05-241367A
Patent document 12: JP H10-161340A
Patent document 13: JP H02-266372A
Patent document 14: JP H09-281748A
Patent document 15: JP2000-214638A
Patent document 16: JP H05-333584A
Patent document 17: JP 2000-10338A
Patent document 18: JP H05-188632A

DISCLOSURE OF INVENTION

In order to achieve an oil-less fixing toner with which no oil is used on a fixing roller, the present invention provides a toner, a two-component developer, and an image forming method with which oil-less fixing is possible by using a release agent such as wax in the toner. Furthermore, the present invention provides the two-component developer that causes less carrier deterioration by toner-spent even when used in combination with a toner containing wax or another such release agent and that has good durability. In addition, the present invention provides the toner, the two-component developer, and the image forming method with which partial transfer defects are reduced and high transfer efficiency can be obtained.

A toner of the present invention is a toner comprising an additive and a toner matrix that includes a binder resin, a colorant, and a wax, in which the additive contains an inorganic micropowder to whose surface polysiloxane and at least one selected from fatty acids and derivatives thereof are adhered.

Next, a two-component developer of the present invention is a two-component developer comprising a carrier and a toner containing an additive and a toner matrix that contains at least a binder resin, a colorant and a wax, in which the additive contains an inorganic micropowder whose surface is treated with polysiloxane and at least one selected from fatty acids and derivatives thereof, and in which the carrier comprises a core material whose surface is coated with a resin containing a fluorine-modified silicone resin containing an aminosilane coupling agent.

Next, a first image forming method of the present invention is an image forming method making use of a developing means in which an AC bias with a frequency of 5 to 10 kHz and a bias of 1.0 to 2.5 kV (p-p) is applied along with a DC bias between a photosensitive member and a developing roller, and a peripheral speed ratio between the photosensitive member and the developing roller is from 1:1.2 to 1:2, in which the method uses a toner containing an additive and a toner matrix that contains at least a binder resin, a colorant, and a wax, and the additive contains an inorganic micropowder to whose surface polysiloxane and at least one selected from fatty acids and derivatives thereof are adhered.

Next, a second image forming method of the present invention makes use of a transfer system in which there are a plurality of toner image forming stations including at least an image support, charging means for forming an electrostatic latent image on the image support, and a toner support. The electrostatic latent image having been formed on the image support is visualized by a toner containing an additive and a toner matrix that contains at least a binder resin, a colorant, and a wax, the additive containing an inorganic micropowder to whose surface polysiloxane and at least one selected from fatty acids and derivatives thereof are adhered. A primary transfer process in which the toner image having been obtained by visualizing the electrostatic latent image is transferred to an endless transfer member by bringing the transfer member into contact with the image support, is executed sequentially and continuously to form a multilayer transferred toner image on the transfer member, and then a secondary transfer process in which the multilayer toner image having been formed on the transfer member is transferred all at once to a transfer medium, is executed. The transfer processes satisfy $d1/v \leqq 0.65$ (sec), when d1 (mm) is a distance from a first primary transfer position to a second primary transfer position, or a distance from the second primary transfer position to a third primary transfer position, or a distance from the third primary transfer position to a fourth primary transfer position, and v (mm/s) is the peripheral speed of the photosensitive member.

Next, a third image forming method of the present invention makes use of a transfer system in which there are a plurality of toner image forming stations including at least an image support, charging means for forming an electrostatic latent image on the image support, and a toner support. The electrostatic latent image having been formed on the image support is visualized by a toner containing an additive and a toner matrix that contains at least a binder resin, a colorant, and a wax, the additive containing an inorganic micropowder to whose surface polysiloxane and at least one selected from fatty acids and derivatives thereof are adhered, a transfer process in which the toner image having been obtained by visualizing the electrostatic latent image is transferred to a transfer medium sequentially and continuously, is executed. The transfer processes satisfy $d1/v \leqq 0.65$ (sec), when d1 (mm) is a distance from a first primary transfer position to a second primary transfer position, or a distance from the second primary transfer position to a third primary transfer position, or a distance from the third primary transfer position to a fourth primary transfer position, and v (mm/s) is the peripheral speed of the photosensitive member.

Figure 1:
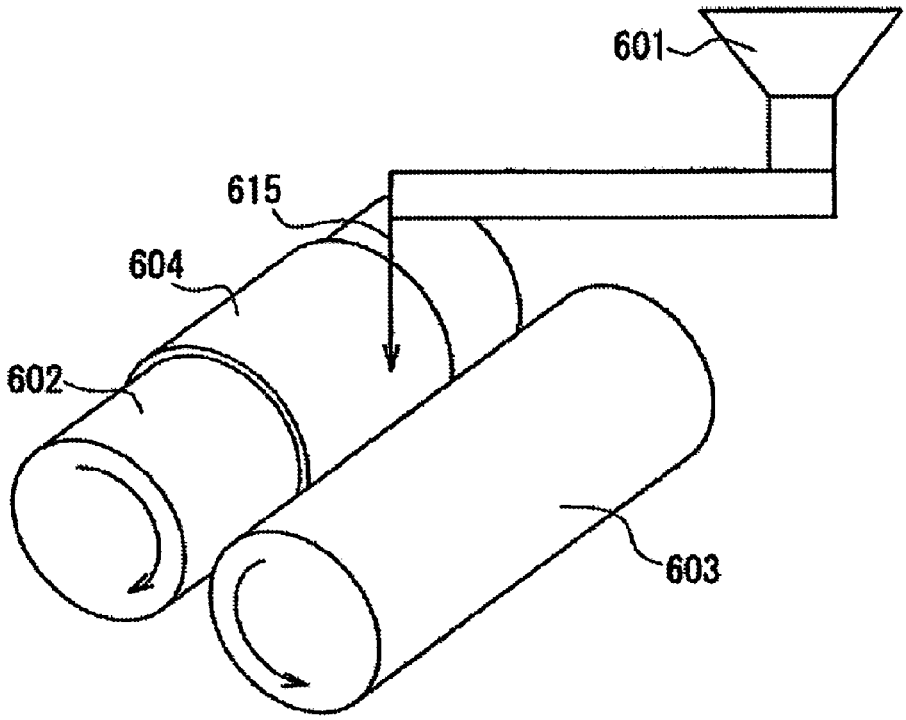
FIG. 1 is a cross-sectional view showing the configuration of an image formation device used in a working example of the present invention.

1: photosensitive member, 2: charging roller, 3: laser signal light, 4: developing roller, 5: blade, 10: first transfer roller, 12: transfer belt, 14: second transfer roller, 13: drive tensioning roller, 17: transfer belt unit, 18B, 18C, 18M, and 18Y: image formation units, 18: image formation unit group, 201: fixing roller, 202: press roller, 203: fixing belt, 205: induction heater, 206: ferrite core, 207: coil, 508: metering supply unit, 500: pulverizer, 501: rotor, 502: stator, 503: raw material, 506: jagged component, 509: cooling unit, 511: air, 512: thermometer, 514: bag filter, 515: cyclone, 516: airflow meter, 517: blower, 518: inorganic micropowder supply device, 519: vibrator, 602: roll (RL1), 603: roll (RL2), 604: molten toner film wound onto roll (RL1), 605: inlet for heating medium, 606: outlet for heating medium

BEST MODE FOR CARRYING OUT THE INVENTION

The present invention affords good digital image quality and more precise color reproduction, allows both optical transmissivity and offset resistance to be achieved, without the use of an oil for preventing offset on the fixing roller, and extends the service life by preventing toner-spent caused by the toner component on the carrier in two-component development.

(1) Additives

The additive in this embodiment is an externally added micropowder treated with a fatty acid or the like, which results in excellent partability between the photosensitive member and any toner adhering to the photosensitive member. Furthermore, a treatment that involves combination with polysiloxane makes the toner charge distribution more uniform, which results in fewer partial transfer defects and prevents back-transfer. As a result, partial transfer defects and back-transfer can be prevented even with a toner that has become more cohesive through the addition of a certain amount of wax for the sake of oil-less fixing. Also, when used in combination with the carrier or wax (discussed below), this results in excellent partability, toner-spent resistance can be further enhanced by the better uniformity in toner charge distribution resulting from treatment with polysiloxane, handling within the developing unit is facilitated, and the uniformity of toner density is increased. The occurrence of developing memory also can be suppressed. Furthermore, filming of toner components on the photosensitive member can be prevented and fusion of toner components to the fixing and heating member can be prevented. Also, both good transfer and oil-less fixing can be achieved even with a toner of smaller particle size. Latent images can be reproduced more faithfully in development. Also, transfer can be performed without decreasing the transfer efficiency of the toner particles. Further, retransfer can be prevented in tandem transfer, and the occurrence of partial transfer defects can be suppressed. In addition, a high image density can be obtained even when the amount of developer is decreased.

Examples of additives in this embodiment include metal oxide micropowders such as silica, alumina, titanium oxide, zirconia, magnesia, ferrite, and magnetite, titanates such as barium titanate, calcium titanate, and strontium titanate, zirconates such as barium zirconate, calcium zirconate, and strontium zirconate, and mixtures of these. Of fatty acids, fatty acid esters, fatty acid amides, and fatty acid metal salts that are used for the surface treatment of an inorganic micropowder, examples of the fatty acids and the fatty acid metal salts include caprylic acid, capric acid, undecylic acid, lauric acid, myristic acid, palmitic acid, stearic acid, behenic acid, montanic acid, lacceric acid, oleic acid, erucic acid, sorbic acid, and linoleic acid. Of these, a fatty acid having 15 to 20 carbon atoms is preferred.

Examples of the metal that constitutes the fatty acid metal salt include aluminum, zinc, calcium, magnesium, lithium, sodium, lead, and barium. Of these, aluminum, zinc, and sodium are preferred. Particularly preferable are difatty acids aluminum such as aluminum distearate ($Al(OH)(C_{17}H_{35}COO)_2$) and monofatty acid aluminum such as aluminum monostearate ($Al(OH)_2(C_{17}H_{35}COO)$). Having OH groups prevents excess charging and keeps transfer defects to a minimum. This also seems to improve treatability with silica and other such inorganic micropowders during treatment.

Preferable examples of an aliphatic amide include a $C_{16}$ to $C_{24}$ saturated or monounsaturated aliphatic amide such as palmitic acid amide, palmitoleic acid amide, stearic acid amide, oleic acid amide, arachidic acid amide, eicosenoic acid amide, behenic acid amide, erucic acid amide, and lignoceric acid amide.

Preferable examples of fatty acid esters include methyl, ethyl, butyl, glycerol, pentaerythritol, polypropylene glycol, trimethylolpropane esters. A fatty acid pentaerythritol monoester, a fatty acid pentaerythritol triester, a fatty acid trimethylol propane ester, or the like is particularly preferable.

A hydroxystearic acid derivative, a glycerol fatty acid ester, a glycol fatty acid ester, a sorbitan fatty acid ester, or another such polyhydric alcohol fatty acid ester is the preferred material, and these can be used singly or in combinations of two or more types.

Preferable examples of polysiloxane include polysiloxane selected from dimethylpolysiloxane, diphenyl polysiloxane, and methylphenyl polysiloxane. Also, polysiloxane selected from phenyl hydrogen polysiloxane, methyl hydrogen polysiloxane, and phenyl hydrogen methyl hydrogen polysiloxane is used prefeferably.

The surface treatment is performed by dissolving the above polysiloxane and fatty acid in a hydrocarbonate organic solvent such as toluene, xylene, hexane, or isoper, wet mixing this solution along with silica, titanium oxide, alumina, or another such micropowder in a disperser, causing the polysiloxane or fatty acid to adhere to the surface of the micropowder by using a treatment agent, and thereby effecting a surface treatment, after which this product is dried and the solvent is removed.

In this case, the mixing ratio between the fatty acid or the like and the polysiloxane preferably is 2:1 to 1:20. If a fatty acid or the like is contained at more than a ratio of 2:1, the charge amount of silica becomes high, and thus image density is lowered and charge-up occurs more easily in the case of two-component development. If a fatty acid metal salt or the like is contained at less than a ratio of 1:20, particle transfer defects, a decrease in the effect on back-transfer, and an increase in toner-spent on the carrier are caused.

In a preferred embodiment, the surface of an inorganic micropowder that is to be treated is treated with a coupling agent and/or polysiloxane, and then treated with a fatty acid or the like and polysiloxane. This is because a more uniform treatment is possible than when hydrophilic silica is treated merely with a fatty acid, and a higher toner charge is attained, and fluidity is higher when the powder is added to the toner.

In another preferred embodiment, the surface of an inorganic micropowder that is to be treated is treated with polysiloxane, and then treated with a fatty acid or the like. This is because the treatment amount of the fatty acid or the like can be reduced. Furthermore, a more uniform treatment is possible, and a higher toner charge is attained and fluidity is higher when the powder is added to the toner.

Examples of silane coupling agents include dimethyldichlorosilane, trimethylchlorosilane, allyldimethylchlorosilane, hexamethyldisilazane, allylphenyldichlorosilane, benzylmethylchlorosilane, vinyltriethoxysilane, gamma-methacryloxypropyltrimethoxysilane, vinyltriacetoxysilane, divinylchlorosilane, and dimethylvinylchlorosilane. The silane coupling agent treatment involves, for example, a dry treatment in which the micropowder is stirred and put into a cloud state, and this is reacted with a vaporized silane coupling agent, or a wet treatment in which a silane coupling agent dispersed in a solvent is drip-reacted with a micropowder.

It is preferable for an inorganic micropowder with an average particle size of 6 nm to 200 nm to be added externally in an amount of 1.0 to 5.5 parts by weight per 100 parts by weight of a toner matrix. If the amount is under 1.0 parts by weight, toner fluidity tends to decrease and back-transfer cannot be completely eliminated during transfer. If the amount is over 5.5 parts by weight, silica suspension and filming on the photosensitive member tend to occur. If the average particle size is less than 6 nm, silica suspension and filming on the photosensitive member tend to occur. If the average particle size is more than 200 nm, toner fluidity tends to decrease. In this case, the ignition loss of the inorganic micropowder whose surface has been treated is preferably 1.5 to 25 wt %, more preferably 3 to 23 wt %, and further more preferably 5 to 20 wt %. If the ignition loss is less than 1.5 wt %, the treatment agent does not sufficiently exhibit its function, and thus chargeability and transfer are difficult to improve. If the ignition loss is more than 25 wt %, there is an unprocessed material, and thus developing performance and chargeability tend to deteriorate.

The average particle size of an inorganic micropowder treated with polysiloxane and fatty acid or the like is preferably 30 nm to 200 nm, more preferably 40 nm to 140 nm, and further more preferably 40 nm to 90 nm. This is because transfer is improved and toner spent on the carrier can be prevented. Furthermore, the inorganic particle preferably is used in combination with a negatively-chargeable silica micropowder having an average particle size of 6 nm to 20 nm. Another preferable constitution is one in which at least an inorganic micropowder having an average particle size of 6 to 20 nm is externally added in an amount of 0.5 to 2 parts by weight per 100 parts by weight of toner matrix particles, and an inorganic micropowder that is treated with polysiloxane and a fatty acid or the like and has an average particle size of 30 to 120 nm is externally added in an amount of 0.5 to 3.5 parts by weight per 100 parts by weight of toner matrix particles. The use of a silica whose functions have been separated as in this constitution affords a wider margin with respect to handling in development, back-transfer during transfer, partial transfer defects, and scattering. This also prevents toner-spent on the carrier. Outside the above ranges, however, this margin is narrowed, requiring higher precision on the machine side.

Yet another preferable constitution is one in which at least an inorganic micropowder with an average particle size of 6 nm to 20 nm and an ignition loss of 1.5 to 25 wt % is added externally in an amount of 0.5 to 2 parts by weight per 100 parts by weight of toner matrix particles, and an inorganic micropowder that is treated with polysiloxane and fatty acid or the like and has an average particle size of 30 nm to 200 nm and ignition loss of 1.5 to 25 wt % is added externally in an mount of 0.5 to 3.5 parts by weight per 100 parts by weight of toner matrix particles. Specifying the ignition loss of the silica affords a wider margin with respect to back-transfer during transfer, partial transfer defects, and scattering. Also, when used in combination with the above-mentioned carrier or wax, this increases toner-spent resistance, facilitates handling within the developing unit, and increases uniformity in toner density. The occurrence of developing memory is also suppressed. Outside the above range, however, this margin is narrowed, requiring higher precision on the machine side. In particular, the parting action during transfer can be stabilized and the transfer margin with respect to back-transfer and partial transfer defects can be stabilized.

The transfer margin with respect to back-transfer and partial transfer defects tends to be narrower if the ignition loss is under 1.5 wt % with particles having an average particle size of 6 to 20 nm. The surface treatment tends to be uneven and there tends to be variance in charging if the ignition loss is over 25 wt %. Preferably, the ignition loss is from 1.5 to 20 wt %, and even more preferably from 5 to 19 wt %.

Furthermore, a preferable constitution is one in which a positively-chargeable inorganic micropowder with an average particle size of 6 nm to 120 nm and an ignition loss of 1.5 to 25 wt % is added externally in an amount of 0.5 to 1.5 parts by weight per 100 parts by weight of toner matrix particles. This is because it suppresses excess charging when the toner is used continuously for an extended period, which further extends the service life of the developer. Another effect is that during transfer it suppresses scattering caused by excess charging. The effect of adding a positively-chargeable inorganic micropowder is that the charging stability is improved significantly when the toner is used continuously for an extended period by adding the positively-chargeable inorganic micropowder to the toner. Furthermore, in a tandem electrophotography, it is possible to suppress image disruption and transfer defects caused by charge repelling in transfer. If the amount is less than 0.5 parts by weight, the effect is difficult to achieve. If the amount is more than 1.5 parts by weight, fogging in development tends to increase. The ignition loss is preferably 1.5 to 25 wt %, and more preferably 5 to 20 wt %.

Preferable examples of positively-chargeable silica include aminosilane, amino-modified silicone oil, silica treated with aminoammonium, titanium oxide, alumina. In this case, the toner matrix is negatively-chargeable, and in a preferable embodiment, an inorganic micropowder having chargeability opposite from that of the toner matrix is added.

The average particle size of the inorganic micropowder is obtained by enlarging an electron micrograph, measuring the particle sizes of about 100 particles, and calculating the average thereof. Furthermore, the drying loss of the inorganic powder added as an additive preferably is 1.0 wt % or less. If the drying loss is more than 1.0 wt %, image deterioration such as fogging tends to be caused in development. The degree of hydrophobicity preferably is 70% or more. If the degree of hydrophobicity is less than 70%, humidity resistance tends to decrease. The drying loss (%) is found as follows. Approximately 1 g of sample is weighed out precisely in a vessel that has been dried, allowed to cool, and precisely weighed. The sample is dried for 2 hours with a hot forced air drier (105° C.±1° C.), then allowed to cool for 30 minutes in a desiccator, after which it is precisely weighed, and the drying loss is calculated from the following equation.

Drying loss (%)=weight loss on drying (g)/amount of sample (g)×100

The ignition loss is found as follows. Approximately 1 g of sample is placed and precisely weighed out in a magnetic crucible that has been dried, allowed to cool, and precisely weighed. The sample is ignited for 2 hours in an electric furnace set to 500° C., then allowed to cool for 1 hour in a desiccator, after which it is precisely weighed, and the ignition loss is calculated from the following equation.

Ignition loss (%)=weight loss on ignition (g)/amount of sample (g)×100

The moisture adsorption of the treated inorganic micropowder preferably is no more than 1 wt %, with 0.5 wt % or less being more preferable, 0.1 wt % or less even more preferable, and 0.05 wt % or less particularly preferable. If the amount is more than 1 wt %, there tends to be a decrease in chargeability and filming tends to occur on the photosensitive member over time. The moisture adsorption apparatus used to measure the amount of moisture adsorption was a continuous evaporation and adsorption apparatus (Belsorp 18, made by BEL Japan).

The degree of hydrophobicity is measured as follows. 0.2 g of product to be tested is weighed out precisely in 50 mL of distilled water that has been poured into a 250 mL beaker. Methanol is dripped onto the distal end from a burette immersed in liquid, until the entire amount of inorganic micropowder is wetted. The system is intermittently and gently stirred with an electromagnetic stirrer during this time. The hydrophobicity is calculated with the following equation from the amount of methanol a (ml) needed to completely wet the powder.

$$\text{Hydrophobicity}=(a/(50+a))\times 100\ (\%)$$

(2) Wax

The wax added to the toner of this embodiment is one with an iodine value of 25 or less and a saponification value of 30 to 300. Adding this wax in an amount of 3 to 20 parts by weight per 100 parts by weight of binder resin lessens the repulsion of the toner caused by charge action during multilayer toner transfer, and suppresses a decrease in transfer efficiency, partial transfer defects during transfer, and back transfer. Also, when this wax is used in combination with the carrier discussed above, toner-spent occurs less often on the carrier, which extends the service life of the developer. In addition, handling in the developing unit is facilitated, and there is better uniformity of the image between the leading and trailing sides in development. The wax also reduces the occurrence of developing memory.

It is preferable for the acid value of the binder resin to be from 1 to 40 mgKOH/g. The binder resin preferably is added in an amount of 5 to 20 parts by weight per 100 parts by weight of binder resin. Fixability is difficult to improve if the added amount is below 3 parts by weight, but exceeding 20 parts by weight poses problems with preservation stability.

If the iodine value is greater than 25, there tends to be only minimal reduction in toner repulsion caused by charge action during multilayer toner transfer in primary transfer. Environmental dependence tends to be high, the chargeability of a material tends to vary greatly during long-term continuous use, and the stability of the image tends to be impaired. Developing memory also is more apt to occur. If the saponification value is lower than 30, more unsaponified material and hydrocarbons tend to be present, filming tends to occur on the photosensitive member, and chargeability tends to suffer. Dispersibility in a charge control agent also tends to be poor, and this can lead to filming or a decrease in chargeability during continuous use. If the saponification value is over 300, the dispersibility of the wax in the resin tends to be poor, and there tends to be only minimal reduction in toner repulsion caused by charge action. This also leads to more fogging and toner scattering. If the resin acid value is less than 1 mgKOH/g, there tends to be only minimal reduction in toner repulsion caused by charge action during multilayer toner transfer. If the resin acid value is greater than 40 mgKOH/g, environmental resistance tends to suffer, and this leads to more fogging.

The melting point (as found by DSC) preferably is 50 to 120° C. Even more preferable is a wax with an iodine value of 15 or less, a saponification value of 50 to 250, and a DSC melting point of 55 to 90° C., and more preferable still is a wax with an iodine value of 5 or less, a saponification value of 70 to 200, and a DSC melting point of 60 to 85° C.

It is preferable to use a material that increases in volume by 2 to 30% with a 10° C. change at a temperature over the melting point. The wax expands rapidly upon changing from a solid to a liquid, so that when it is melted by heat during fixing, the toner particles adhere together more tightly, which further improves fixability, parting from the fixing roller is better, and offset resistance is also increased. There tends to be little effect if the increase in volume is less than 2%, but dispersibility during kneading tends to decrease if the increase is more than 30%.

The heating loss of the wax at 220° C. preferably is no more than 8 wt %. If the heating loss is greater than 8 wt %, the wax remains in the binder resin during heating and kneading, greatly reducing the glass transition point of the binder resin and decreasing the preservation stability of the toner. This has an adverse effect on developing characteristics, and produces fogging and photosensitive member filming. The wax with an iodine value of 25 or less and a saponification value of 30 to 300 preferably has the following molecular weight characteristics as determined by gel permeation chromatography (GPC): a number average molecular weight of 100 to 5000, a weight average molecular weight of 200 to 10,000, a ratio of the weight average molecular weight to the number average molecular weight (weight average molecular weight/number average molecular weight) of 1.01 to 8, a ratio of the Z average molecular weight to the number average molecular weight (Z average molecular weight/number average molecular weight) of 1.02 to 10, and the presence of at least one molecular weight maximum peak in the molecular weight region from $5\times10^2$ to $1\times10^4$. Even more preferably, the number average molecular weight is from 500 to 4500, the weight average molecular weight is from 600 to 9000, the ratio of the weight average molecular weight to the number average molecular weight (weight average molecular weight/number average molecular weight) is from 1.01 to 7, and the ratio of the Z average molecular weight to the number average molecular weight (Z average molecular weight/number average molecular weight) is from 1.02 to 9. More preferably still, the number average molecular weight is from 700 to 4000, the weight average molecular weight is from 800 to 8000, the ratio of the weight average molecular weight to the number average molecular weight (weight average molecular weight/number average molecular weight) is from 1.01 to 6, and the ratio of the Z average molecular weight to the number average molecular weight (Z average molecular weight/number average molecular weight) is from 1.02 to 8. Preservation stability tends to worsen if the number average molecular weight is less than 100 or if the weight average molecular weight is more than 200. If the molecular weight maximum peak is located below $5\times10^2$, the dispersibility of the charge control agent with the wax tends to suffer. Also, handling in the developing unit tends to be more difficult, and toner density cannot be kept as uniform. There tends to be a decrease in the preservation stability of the toner, an increase in the toner spent on the carrier, and photosensitive member filming. If the number average molecular weight is greater than 5000, or the weight average molecular weight is greater than 10,000, or the ratio of weight average molecular weight to number average molecular weight (weight average molecular weight/number average molecular weight) is greater than 8, or the ratio of Z average molecular weight to number average molecular weight (Z average molecular weight/number average molecular weight) is greater than 10, or the molecular weight maximum peak is located above $1\times10^4$, the parting action tends to be weaker and there tends to be a decrease in fixability function, such as fixability and offset resistance.

The wax preferably is a natural wax such as a meadowfoam oil derivative, carnauba wax, a jojoba oil derivative, Japan wax, beeswax, ozocerite, candelilla wax, montan wax, ceresin wax, and rice wax, a synthetic wax such as Fischer-Tropsch wax, or another such material. One type may be used, or a combination of two or more types may be used. It is particularly preferable to use one or more types of wax selected from the group consisting of carnauba wax (DSC melting point of 76 to 90° C.), candelilla wax (66 to 80° C.), hydrogenated jojoba oil (64 to 78° C.), hydrogenated meadowfoam oil (64 to 78° C.), or rice wax (74 to 90° C.).

The saponification value refers to the number of milligrams of potassium hydroxide (KOH) required to saponify 1 g of sample, and corresponds to the sum of the acid value and the ester value. To measure the saponification value, the sample is saponified in an approximately 0.5 N alcohol solution of potassium hydroxide, after which the excess potassium hydroxide is titrated with 0.5 N hydrochloric acid.

The iodine value is expressed by the number of grams, per 100 g of sample, when a halogen is allowed to act on the sample and the amount of absorbed halogen is calculated as iodine, and is the number of grams of iodine absorbed by 100 g of the sample. The greater is this value, the higher is the degree of fatty acid unsaturation in the sample. An alcohol solution of iodine and mercury chloride (II) or a glacial acetic acid solution of iodine chloride is added to a chloroform or carbon tetrachloride solution of the sample, and the iodine that remains unreacted after the system has been allowed to stand is titrated with a sodium thiosulfate standard solution to calculate the amount of absorbed iodine.

The heating loss is measured by precisely weighing the sample cell to 0.1 mg (W1 mg), putting 10 to 15 mg of sample in this cell, and precisely weighing to 0.1 mg (W2 mg). The sample cell is placed in a differential thermal balance, and measurement is commenced with the weighing sensitivity set to 5 mg. Temperature control is performed by the following program. After measurement, the weight loss is read to 0.1 mg (W3 mg) from a chart at the point when the sample temperature reaches 220° C. The apparatus used here was a TGD-3000 made by Shinku Riko, the temperature elevation rate was 10° C./min, the maximum temperature was 220° C., the holding time was 1 minute, and the result was calculated from the equation: heating loss (%)=W3/(W3/W2−W1)×100.

The meadowfoam oil derivative preferably is a meadowfoam oil fatty acid, a metal salt of a meadowfoam oil fatty acid, a meadowfoam oil fatty acid ester, a hydrogenated meadowfoam oil, a meadowfoam oil amide, a homomeadowfoam oil amide, a meadowfoam oil triester, a maleic acid derivative of epoxidized meadowfoam oil, an isocyanate polymer of a meadowfoam oil fatty acid polyhydric alcohol ester, or a halogen-modified meadowfoam oil. These materials are preferred because they improve transfer and extend the service life of the developer and oil-less fixing. These can be used singly or in combinations of two or more types.

Preferable examples of meadowfoam oil fatty acid esters include methyl, ethyl, butyl, glycerol, pentaerythritol, polypropylene glycol, trimethylolpropane esters. A meadowfoam oil fatty acid pentaerythritol monoester, a meadowfoam oil fatty acid pentaerythritol triester, a meadowfoam oil fatty acid trimethylol propane ester, or the like is particularly preferable because it affords good cold offset resistance as well as offset resistance at high temperatures. Also, an isocyanate polymer of a meadowfoam oil fatty acid polyhydric alcohol ester preferably is used that is obtained when meadowfoam oil fatty acid and an esterification reaction product with polyhydric alcohol, such as glycerol, pentaerythritol, or trimethylolpropane, are crosslinked by isocyanate such as tolylene diisocyanate (TDI), or diphenylmethane-4,4'-diisocyanate (MDI). Toner spent on the carrier is caused less and the two-component developer can have a longer service life.

A hydrogenated meadowfoam oil is obtained by hydrogenating meadowfoam oil to convert the unsaturated bonds into saturated bonds. This improves offset resistance as well as gloss and optical transmissivity.

A meadowfoam oil amide can be obtained by hydrolyzing meadowfoam oil, and then producing a fatty acid methyl ester by esterification, and finally reacting this ester with a mixture of concentrated aqueous ammonia and ammonium chloride. The melting point of this product can be adjusted by hydrogenation. It is also possible to perform this hydrogenation prior to hydrolysis. A product with a melting point of 75 to 120° C. is obtained. A homomeadowfoam oil amide can be obtained by hydrolyzing meadowfoam oil, and then reducing this product to an alcohol, and then converting this into a nitrile. This improves offset resistance as well as gloss and optical transmissivity.

The jojoba oil derivative preferably is a jojoba oil fatty acid, a metal salt of a jojoba oil fatty acid, a jojoba oil fatty acid ester, hydrogenated jojoba oil, a jojoba oil amide, a homojojoba oil amide, a jojoba oil triester, a maleic acid derivative of epoxidized jojoba oil, an isocyanate polymer of a jojoba oil fatty acid polyhydric alcohol ester, or a halogen-modified jojoba oil. These materials are preferred because they improve transfer and extend the service life of the developer and oil-less fixing. These can be used singly or in combinations of two or more types.

Preferable examples of jojoba oil fatty acid esters include methyl, ethyl, butyl, glycerol, pentaerythritol, polypropylene glycol, trimethylolpropane esters. A jojoba oil fatty acid pentaerythritol monoester, a jojoba oil fatty acid pentaerythritol triester, a jojoba oil fatty acid trimethylol propane ester, or the like is particularly preferable because it affords good cold offset resistance as well as offset resistance at high temperatures.

Also, an isocyanate polymer of a jojoba oil fatty acid polyhydric alcohol ester preferably is used that is obtained when jojoba oil fatty acid and an esterification reaction product with polyhydric alcohol, such as glycerol, pentaerythritol, or trimethylolpropane, are crosslinked by isocyanate such as tolylene diisocyanate (TDI), or diphenylmethane-4,4'-diisocyanate (MDI). Toner spent on the carrier is caused less and the two-component developer can have a longer service life. A hydrogenated jojoba oil is obtained by hydrogenating jojoba oil to convert the unsaturated bonds into saturated bonds. This improves offset resistance as well as gloss and optical transmissivity.

A jojoba oil amide can be obtained by hydrolyzing jojoba oil, and then producing a fatty acid methyl ester by esterification, and finally reacting this ester with a mixture of concentrated aqueous ammonia and ammonium chloride. The melting point of this product can be adjusted by hydrogenation. It is also possible to perform this hydrogenation prior to hydrolysis. A product with a melting point of 75 to 120° C. is obtained. A jojoba oil amide can be obtained by hydrolyzing jojoba oil, and then reducing this product to an alcohol, and then converting this into a nitrile. This improves offset resistance as well as gloss and optical transmissivity.

A hydroxystearic acid derivative, a glycerol fatty acid ester, a glycol fatty acid ester, a sorbitan fatty acid ester, or another such polyhydric alcohol fatty acid ester is the preferred material in this embodiment, and these can be used singly or in combinations of two or more types. When used in combination with the above-mentioned carrier, these afford oil-less fixing, extend the service life of the developer, maintain uniformity in the developing unit, and suppress the occurrence of developing memory.

Preferable examples of derivatives of hydroxystearic acid include methyl 12-hydroxystearate, butyl 12-hydroxystearate, propylene glycol mono-12-hydroxystearate, glycerol mono-12-hydroxystearate, and ethylene glycol mono-12-hydroxystearate. These have the effect of preventing filming and preventing adhesion to the paper in oil-less fixing.

Preferable examples of glycerol fatty acid esters include glycerol monostearate, glycerol tristearate, glycerol stearate, glycerol monopalmitate, and glycerol tripalmitate. These have the effect of preventing a decrease in transferability and lessening cold offset at low temperatures in oil-less fixing.

Preferable examples of glycol fatty acid esters include propylene glycol fatty acid esters such as propylene glycol monopalmitate and propylene glycol monostearate, and ethylene glycol fatty acid esters such as ethylene glycol monostearate and ethylene glycol monopalmitate. These have the effect of affording oil-less fixing, improving lubricity in development, and preventing toner-spent on the carrier.

Preferable examples of sorbitan fatty acid esters include sorbitan monopalmitate, sorbitan monostearate, sorbitan tripalmitate, and sorbitan tristearate. Other preferable materials include a stearic acid ester of pentaerythritol and a mixed ester of adipic acid and stearic acid or oleic acid, and these can be used singly or in combinations of two or more types. These have the effect of preventing filming and preventing adhesion to the paper in oil-less fixing.

Also, an aliphatic amide wax preferably is used in this embodiment. This greatly increases the optical transmissivity in a color image. In particular, it promotes smoothness on the surface of a fixed image, allowing a high-quality color image to be obtained. It further prevents the adhesion of the transfer paper to the fixing roll during fixing, allowing both optical transmissivity and offset resistance to be achieved, and preventing partial transfer defects. When used in combination with the above-mentioned carrier, this affords oil-less fixing, suppresses the occurrence of toner-spent, extends the service life of the developer, maintains uniformity in the developing unit, and suppresses the occurrence of developing memory.

The aliphatic amide wax preferably is a $C_{16}$ to $C_{24}$ saturated or monounsaturated aliphatic amide such as palmitic acid amide, palmitoleic acid amide, stearic acid amide, oleic acid amide, arachidic acid amide, eicosenoic acid amide, behenic acid amide, erucic acid amide, and lignoceric acid amide, having a melting point of 60 to 120° C., and preferably 70 to 100° C., and even more preferably 75 to 95° C. The added amount preferably is 5 to 20 parts by weight per 100 parts by weight of binder resin. If the melting point is under 60° C., there tends be a decrease in dispersibility in the resin and filming is more apt to occur on the photosensitive member. If the melting point is over 120° C., there tends be a decrease in the smoothness of the fixed image surface and optical transmissivity tends to suffer. If the added amount is over 20 parts by weight, preservation stability tends to decrease, but there tends be no effect of the wax if the added amount is less than 5 parts by weight.

A wax based on an alkylenebis fatty acid amide of a saturated or a mono- or diunsaturated fatty acid is preferred, examples of which include methylene-bis-stearic acid amide, ethylene-bis-stearic acid amide, propylene-bis-stearic acid amide, butylene-bis-stearic acid amide, methylene-bis-oleic acid amide, ethylene-bis-oleic acid amide, propylene-bis-oleic acid amide, butylene-bis-oleic acid amide, methylene-bis-lauric acid amide, ethylene-bis-lauric acid amide, propylene-bis-lauric acid amide, butylene-bis-lauric acid amide, methylene-bis-myristic acid amide, ethylene-bis-myristic acid amide, propylene-bis-myristic acid amide, butylene-bis-myristic acid amide, methylene-bis-palmitic acid amide, ethylene-bis-palmitic acid amide, propylene-bis-palmitic acid amide, butylene-bis-palmitic acid amide, methylene-bis-palmitoleic acid amide, ethylene-bis-palmitoleic acid amide, propylene-bis-palmitoleic acid amide, butylene-bis-palmitoleic acid amide, methylene-bis-arachidic acid amide, ethylene-bis-arachidic acid amide, propylene-bis-arachidic acid amide, butylene-bis-arachidic acid amide, methylene-bis-eicosenoic acid amide, ethylene-bis-eicosenoic acid amide, propylene-bis-eicosenoic acid amide, butylene-bis-eicosenoic acid amide, methylene-bis-behenic acid amide, ethylene-bis-behenic acid amide, propylene-bis-behenic acid amide, butylene-bis-behenic acid amide, methylene-bis-erucic acid amide, ethylene-bis-erucic acid amide, propylene-bis-erucic acid amide, and butylene-bis-erucic acid amide. This improves optical transmissivity in a color image and increases offset resistance with respect to a fixing roller. This also suppresses the occurrence of toner-spent on the carrier and extends the service life of the developer. The added amount preferably is 3 to 20 parts by weight per 100 parts by weight of binder resin. There tends to be no effect if the added amount is less than 3 parts by weight, and there tends to be an increase in fogging if the added amount is more than 20 parts by weight.

Moreover, the surface smoothness of a fixed image can be improved, and the optical transmissivity and offset resistance of a color image can be made even better, by using a wax in which the aliphatic amide and the alkylene bis fatty acid amide are used in a ratio of 3:7 to 7:3. The melting point here must be higher for the alkylene bis fatty acid amide than for the aliphatic amide. The melting point of the alkylene bis fatty acid amide being too low not only decreases offset resistance, but the resin itself is in a state of low softening and is excessively pulverized during pulverization, so that there tends to be more micropowder, which leads to a drop in productivity.

In particular, since the aliphatic amide is a material with a low softening point, as compatibility with the resin progresses, the resin itself is plasticized, with the result that offset resistance and preservation stability decrease, and partial transfer defects occur more often during extended use. Accordingly, if an alkylene bis fatty acid amide having a higher melting point is used in combination with an aliphatic amide having a lower melting point, there tends to be less plasticization of the resin itself, partial transfer defects can be prevented during extended use without losing the effect of the aliphatic amide in terms of high optical transmissivity and surface smoothness, and offset resistance and preservation stability can be maintained. This also suppresses the occurrence of toner-spent on the carrier and extends the service life of the developer.

Also, a wax obtained by reacting a $C_4$ to $C_{30}$ long chain alkyl alcohol, an unsaturated polycarboxylic acid or anhydride thereof, and an unsaturated hydrocarbon wax, or a wax obtained by reacting a long chain alkylamine, an unsaturated polycarboxylic acid or anhydride thereof, and an unsaturated hydrocarbon wax, or a wax obtained by reacting a long chain fluoroalkyl alcohol, an unsaturated polycarboxylic acid or anhydride thereof, and an unsaturated hydrocarbon wax, each of which has a molecular weight distribution (by GPC) such that the weight average molecular weight is from 1000 to 6000, the Z average molecular weight is from 1500 to 9000, the ratio of the weight average molecular weight to number average molecular weight (weight average molecular weight/number average molecular weight) is from 1.1 to 3.8, the ratio of the Z average molecular weight to the number average molecular weight (Z average molecular weight/number average molecular weight) is from 1.5 to 6.5, and there is at least one molecular weight maximum peak in the region from $1\times10^3$ to $3\times10^4$, and in which the acid value is from 5 to 80 mgKOH/g, the melting point is from 60 to 120° C., and the penetration at 25° C. is 4 or less, is particularly effective in terms of improving separation between the paper and the fixing roller or belt with an image formed from three layers of color toner on thin paper. Such a wax is also effective at increasing OHP transmissivity without decreasing high temperature offset resistance. The addition of this wax also improves the fixing characteristics, and particularly high optical transmissivity, high gloss, and no offset in oil-less fixing, and does not diminish high temperature preservation stability. Also, the offset of halftone images can be prevented even by using a fluorine- or silicone-based member for the fixing roller. When used in combination with the above-mentioned carrier, this wax affords oil-less fixing, suppresses the occurrence of toner-spent on the carrier, extends the service life of the developer, maintains uniformity in the developing unit, and suppresses the occurrence of developing memory. Furthermore, charging stability can be obtained over continuous use, allowing both fixability and charging stability to be achieved at the same time. Also, partability, optical transmissivity, and other aspects of fixability, and charging stability and other aspects of developability can be improved further by increasing the state of dispersion during the addition of this wax to the binder resin. The addition of a release agent may in some cases lower the dispersibility of other internal additives, but with the constitution of the additives in this embodiment, good fixing and development both can be achieved without decreasing the dispersibility.

If the carbon number of the long chain alkyl of the wax is less than 4, the parting action tends to be weak and there tends to be a drop in separability and high temperature offset resistance. If the carbon number of the long chain alkyl is greater than 30, though, there tends to be a decrease in dispersibility in the binder resin. An acid value of less than 5 mgKOH/g can lead to a decrease in the amount of charge when the toner is used for an extended period, but if the acid value is greater than 80 mgKOH/g, humidity resistance tends to decrease and there tends to be more fogging under high humidity. The preservation stability of the toner tends to decrease if the melting point is below 60° C., but if the melting point is over 120° C., the parting action tends to be weak and the temperature range in which there is no offset tends to be narrower. Toughness tends to decrease and photosensitive member filming tends to occur over extended use if the penetration at 25° C. is less than 4.

If the weight average molecular weight is less than 1000, or the Z average molecular weight is less than 1500, or the weight average molecular weight/number average molecular weight is less than 1.1, or the Z average molecular weight/number average molecular weight is less than 1.5, or the molecular weight maximum peak is located below $1\times10^3$, there tends to be a decrease in the preservation stability of the toner and filming tends to occur on the photosensitive member or the intermediate transfer member. Also, handling in the developing unit tends to be more difficult, and toner density uniformity tends to drop. Also, developing memory is more likely to occur. If the weight average molecular weight is greater than 6000, or the Z average molecular weight is greater than 9000, or the weight average molecular weight/number average molecular weight is greater than 3.8, or the Z average molecular weight/number average molecular weight is greater than 6.5, or the molecular weight maximum peak is located above $3\times10^4$, the parting action tends to be weaker and there tends to be a decrease in fixing offset resistance. Preferably, the weight average molecular weight is from 1000 to 5000, the Z average molecular weight is from 1700 to 8000, the ratio of the weight average molecular weight to number average molecular weight (weight average molecular weight/number average molecular weight) is from 1.1 to 2.8, the ratio of the Z average molecular weight to the number average molecular weight (Z average molecular weight/number average molecular weight) is from 1.5 to 4.5, and there is at least one molecular weight maximum peak between $1\times10^3$ and $1\times10^4$, and even more preferably, the weight average molecular weight is from 1000 to 2500, the Z average molecular weight is from 1900 to 3000, the ratio of the weight average molecular weight to number average molecular weight (weight average molecular weight/number average molecular weight) is from 1.2 to 1.8, the ratio of the Z average molecular weight to the number average molecular weight (Z average molecular weight/number average molecular weight) is from 1.7 to 2.5, and there is at least one molecular weight maximum peak between $1\times10^3$ and $3\times10^3$. The alcohol here can be one having a long chain alkyl, such as octanol, dodecanol, stearyl alcohol, nonacosanol, or pentadecanol. Amines that can be used preferably include N-methylhexylamine, nonylamine, stearylamine, and nonadecylamine. Fluoroalkyl alcohols that can be used preferably include 1-methoxy-(perfluoro-2-methyl-1-propene), hexafluoroacetone, and 3-perfluorooctyl-1,2-epoxypropane. The unsaturated polycarboxylic acid or anhydride thereof can be maleic acid, maleic anhydride, itaconic acid, itaconic anhydride, citraconic acid, citraconic anhydride, or the like, which can be used singly or in combinations of two or more. Of these, maleic acid and maleic anhydride are preferred. Unsaturated hydrocarbon waxes that can be used preferably include olefins having a double bond such as ethylene, propylene, or butylenes. The product can be obtained by polymerizing an unsaturated polycarboxylic acid or anhydride thereof using an alcohol or an amine, and then adding this polymer to an unsaturated hydrocarbon wax in the presence of dicumyl peroxide, tert-butyl peroxyisopropyl monocarbonate, or the like. The added amount preferably is 3 to 20 parts by weight per 100 parts by weight of binder resin. The parting effect tends to be minimal if the amount is less than 3 part by weight, but exceeding 20 parts by weight decreases the fluidity of the toner, and moreover there is no additional effect by adding any more.

It is preferable for the dispersed average particle size of the wax in the binder resin to be from 0.1 to 1.5 μm, for particles smaller than 0.1 μm to account for no more than 35% of the dispersed average particle size distribution, for particles of 0.1 to 2.0 μm to account for at least 65%, and for particles larger than 2.0 μm to account for no more than 5%. The particle size and count were found from a cross sectional micrograph of the toner taken by TEM. If the dispersed average particle size is less than 0.1 μm or if particles smaller than 0.1 μm account for more than 35%, there tends to be little effect as a release agent, and good fixing is difficult to achieve. If the dispersed average particle size is greater than 1.5 μm and if particles larger than 2.0 μm account for more than 5%, the dispersibility of the wax in the resin tends to decrease, and there tends to be only minimal reduction in toner repulsion caused by charge action. This also leads to more fogging and toner scattering. When wax particles in the resin have a elongated or oval structure, it is preferable for the average major axis diameter to be from 0.5 to 3 μm, for particles smaller than 0.5 μm to account for no more than 35%, for particles of 0.5 to 3.5 μm to account for at least 65%, and for particles larger than 3.5 μm to account for no more than 5%. If the average diameter is less than 0.5 μm, and if particles smaller than 0.5 μm account for more than 35%, there tends to be little effect as a release agent, and good fixing is difficult to achieve. If the average diameter is greater than 3 μm, or if particles larger than 3.5 μm account for more than 5%, the dispersibility of the wax in the resin tends to decrease, and there tends to be only minimal reduction in toner repulsion caused by charge action. This also leads to more fogging and toner scattering. Also, handling in the developing unit tends to be more difficult, and developing memory characteristics deteriorate.

(3) Binder Resin

The binder resin in this embodiment preferably contains a polyester resin in which at least one molecular weight maximum peak is in a region of $2\times10^3$ to $3\times10^4$ in the GPC molecular weight distribution, the content of components in the high molecular weight region with a molecular weight of at least $3\times10^4$ is at least 5% with respect to the entire binder resin, the weight average molecular weight is from 10,000 to 300,000, the Z average molecular weight is from 20,000 to 5,000,000, the ratio of the weight average molecular weight to number average molecular weight (weight average molecular weight/number average molecular weight) is from 3 to 100, the ratio of the Z average molecular weight to the number average molecular weight (Z average molecular weight/number average molecular weight) is from 10 to 2000, the melting temperature as measured by the ½ method with a flow tester that is a constant load extrusion type of capillary rheometer (this temperature hereinafter is referred to as the softening point) is from 80 to 150° C., the flow beginning temperature is from 80 to 120° C., and the glass transition point of the resin is from 45 to 68° C.

Even more preferably, the binder resin contains a polyester resin in which the weight average molecular weight is from 10,000 to 200,000, the Z average molecular weight is from 20,000 to 3,000,000, the weight average molecular weight/number average molecular weight is from 3 to 50, the Z average molecular weight/number average molecular weight is from 20 to 1000, the softening point is from 90 to 140° C., the flow beginning temperature is from 85 to 115° C., and the glass transition point is from 52 to 68° C.

More preferable still is for the binder resin to contain a polyester resin in which the weight average molecular weight is from 10,000 to 150,000, the Z average molecular weight is from 20,000 to 500,000, the weight average molecular weight/number average molecular weight is from 3 to 15, the Z average molecular weight/number average molecular weight is from 50 to 1000, the softening point is from 105 to 135° C., the flow beginning temperature is from 90 to 120° C., and the glass transition point is from 58 to 66° C.

The content of components in the high molecular weight region with a molecular weight of at least $1\times10^5$ preferably is at least 3% with respect to the entire binder resin. Even more preferably, the content of components in the high molecular weight region with a molecular weight of at least $3\times10^5$ preferably is at least 0.5% with respect to the entire binder resin.

Preferably, the content of components in the high molecular weight region with a molecular weight of from $8\times10^4$ to $1\times10^7$ is at least 3% with respect to the entire binder resin, and there is no component with a molecular weight of more than $1\times10^7$.

Even more preferably, the content of components in the high molecular weight region with a molecular weight of from $3\times10^5$ to $9\times10^6$ is at least 1% with respect to the entire binder resin, and there is no component with a molecular weight of more than $9\times10^6$.

Even more preferably, the content of components in the high molecular weight region with a molecular weight of from $7\times10^5$ to $6\times10^6$ is at least 1% with respect to the entire binder resin, and there is no component with a molecular weight of more than $6\times10^6$.

If the high molecular weight component content is too high, or if the molecules are too large, a high molecular weight component tends to remain behind in kneading and hinder optical transmissivity, and also tends to lower the efficiency at which the resin itself is manufactured. Also, this component can scratch the developing roller and supply roller and produce streaks in the image. The dispersibility of the wax also decreases.

If the weight average molecular weight of the binder resin is less than 10,000, or the Z average molecular weight is less than 20,000, or the weight average molecular weight/number average molecular weight is less than 3, or the Z average molecular weight/number average molecular weight is less than 10, or the softening point is lower than 80° C., or the flow beginning temperature is lower than 80° C., or the glass transition point is lower than 45° C., there tends to be a decrease in dispersibility during kneading, and this leads to more fogging and lower durability. Also, the kneading stress is not sufficient during kneading, and thus it tends to be impossible to keep the molecular weight at the proper level. The dispersibility of the wax or charge control agent in the resin tends to decrease, and there tends to be only minimal reduction in toner repulsion caused by charge action. This also leads to more fogging and toner scattering. Also, offset resistance and high temperature preservation stability tend to decrease, the transfer member is cleaned less properly, and filming tends to occur on the photosensitive member.

If the weight average molecular weight of the binder resin is greater than 300,000, or the Z average molecular weight is greater than 5,000,000, or the weight average molecular weight/number average molecular weight is greater than 100, or the Z average molecular weight/number average molecular weight is greater than 2000, or the softening point is higher than 150° C., or the flow beginning temperature is higher than 120° C., or the glass transition point is higher than 68° C., then the load on the machine during treatment may be excessive, which can lead to a drastic drop in productivity or to a decrease in optical transmissivity in a color image or a decrease in fixing strength.

Fixability tends to be further enhanced if the toner that has undergone melt kneading has a GPC molecular weight distribution in which there is at least one molecular weight maximum peak in the region of $2\times10^3$ to $3\times10^4$, and there is at least one molecular weight maximum peak or shoulder in the region of $5\times10^4$ to $1\times10^6$. Preferably, at least one molecular weight maximum peak is located on the toner low molecular weight side in a range of $3\times10^3$ to $2\times10^4$, and even more preferably, in a range of $4\times10^3$ to $2\times10^4$.

Preferably, at least one molecular weight maximum peak or shoulder is located on the toner high molecular weight side in a range of $6\times10^4$ to $7\times10^5$, and even more preferably, in a range of $8\times10^4$ to $5\times10^5$.

If the molecular weight maximum peak location in the molecular weight distribution of the toner on the low molecular weight side is less than $2\times10^3$, durability tends to decrease, but if this is greater than $3\times10^4$, both fixability and optical transmissivity tend to decrease.

If the molecular weight maximum peak or shoulder location in the molecular weight distribution of the toner on the high molecular weight side is less than $5\times10^4$, offset resistance tends to decrease, and preservation stability tends to decrease as well. Developability also tends to suffer, and there tends to be more fogging. If this is greater than $1\times10^6$, though, pulverization tends to be difficult, which leads to a drop in productivity.

It is preferable for the content of the component located in the toner high molecular weight range with a high molecular weight of at least $5\times10^5$ to be no more than 10 wt % with respect to the entire binder resin. If there is a large amount of component located in the high molecular weight range of at least $5\times10^5$, or if the molecules are very large, this is a result of the fact that kneading stress is applied unevenly to the material constituting the toner during kneading, resulting in a poor state of kneading. This impairs the optical transmissivity severely. Thus, poor dispersion results in more fogging, decreases transfer efficiency, makes the toner more difficult to pulverize, and lowers production efficiency.

More preferably, the content of the high molecular weight component of at least $5\times10^5$ is no more than 5% with respect to the entire binder resin, and even more preferably, the content of the high molecular weight component of at least $1\times10^6$ is no more than 1% with respect to the entire binder resin, or none at all is contained.

Also, in the molecular weight distribution in a toner GPC chromatogram, if we let Ha be the height of the molecular weight distribution of the molecular weight maximum peak located between $2\times10^3$ and $3\times10^4$, and Hb be the height of the molecular weight maximum peak or shoulder located between $5\times10^4$ and $1\times10^6$, then Hb/Ha is from 0.15 to 0.9.

If Hb/Ha is less than 0.15, there tends to be a decrease in both offset resistance and preservation stability, resulting in increased filming on a developing roller and the photosensitive member. If the ratio is greater than 0.9, pulverization tends to be more difficult, productivity tends to decrease, and cost tends to rise. More preferably, Hb/Ha is from 0.15 to 0.7, and even more preferably, Hb/Ha is from 0.2 to 0.6.

In an arrangement in which, in the GPC molecular weight distribution of the toner, at least one molecular weight maximum peak is within the range of $2\times10^3$ to $3\times10^4$, and at least one molecular weight maximum peak or shoulder is within the range of $5\times10^4$ to $1\times10^6$, if we focus on the molecular weight curve within a region greater than the molecular weight value corresponding to the maximum peak or shoulder of the molecular weight distribution located within the molecular weight range of $5\times10^4$ to $1\times10^6$, and if we assume that the height of the maximum peak or shoulder in this molecular weight distribution is set to a base of 100%, and if we let M90 be the molecular weight corresponding to 90% of the height of the molecular weight maximum peak or shoulder, and M10 be the molecular weight corresponding to 10% of the height of the molecular weight maximum peak or shoulder, then setting M10/M90 to be from 0.5 to 0.8, and further setting (M10−M90)/M90 to be from 0.1 to 7, allows optical transmissivity to be ensured, and also allows oil-less fixing in which offset is prevented to be achieved without any fixing oil being required. This also suppresses the occurrence of toner-spent on the carrier and extends the service life of the developer.

Specifying the value M10/M90, and further, the value (M10−M90)/M90 (the slope of the molecular weight distribution curve), makes it possible to quantify the state of molecular cleavage of the ultra-high molecular weight component, and if this value is within the range given above (which suggests that the slope of the molecular weight distribution curve is steep), cleavage during kneading eliminates ultra-high molecular weight component that would hamper optical transmissivity, the result being good optical transmissivity. Moreover, the high molecular weight component that forms the peak or shoulder appearing on the high molecular weight side contributes to offset resistance, making it possible to prevent the occurrence of offset in colored toner without use of any oil. This also suppresses the occurrence of toner-spent on the carrier and extends the service life of the developer.

Furthermore, in the course of the molecular cleavage of the ultra-high molecular weight component, the wax and charge control agent can be dispersed uniformly in the binder resin, which makes the amount of charge more uniform, affords higher resolution, and allows durability to be maintained even over long-term continuous use. This also improves the cleaning of the transfer member, facilitates handling within the developing unit, and increases uniformity in toner density. The occurrence of developing memory also is suppressed. It is also possible to prevent partial transfer defects and image disruption during transfer, and consequently to achieve more efficient transfer.

If the value of M10/M90 is greater than 8, or if (M10−M90)/M90 is less than 7, the ultra-high molecular weight component still remains, which hampers good optical transmissivity. If the value of M10/M90 is smaller than 0.5, or if (M10−M90)/M90 is less than 0.1, mechanical load during kneading is too high and productivity tends to fall. This also lowers toner durability. Preferably, the value of M10/M90 is from 0.5 to 6, and (M10−M90)/M90 is from 0.1 to 4.5. More preferably, the value of M10/M90 is from 0.5 to 4.5, and (M10−M90)/M90 is from 0.1 to 3.5.

This affords higher quality digital images and better color reproduction, prevents toner-spent on the carrier in two-component development, and allows both optical transmissivity and offset resistance to be achieved without the use of an oil for preventing offset on the fixing roller.

Furthermore, this provides a cleaner process, shortens the transfer distance, prevents partial transfer defects in the transfer step of a high-speed tandem transfer process, and results in better transfer.

Characteristics that did not appear in the past can be attained by kneading under a high shearing force in the melt kneading of the above-mentioned binder resin. This affords both good optical transmissivity and offset resistance in a color toner in fixing without the use of an oil. That is, when a binder resin containing a ultra-high molecular weight component is subjected to high shearing force, this ultra-high molecular weight component is reduced in molecular weight, which results in higher optical transmissivity, and the presence of this ultra-high molecular weight component that has been reduced in molecular weight also provides satisfactory offset resistance. Also, since there is a ultra-high molecular weight component, high shearing force is produced during kneading, so that the wax can be dispersed more uniformly, optical transmissivity is improved, and good transfer can be accomplished, with no offset and with high image quality and high color reproduction. This also suppresses the occurrence of toner-spent on the carrier and extends the service life of the developer.

After the kneading process, the weight average molecular weight of the toner is to be between 8000 and 180,000, the Z average molecular weight between 18,000 and 1,000,000, the ratio of the weight average molecular weight to number average molecular weight (weight average molecular weight/number average molecular weight) between 3 and 80, and the ratio of the Z average molecular weight to the number average molecular weight (Z average molecular weight/number average molecular weight) between 10 and 1000. If a toner is kneaded under a high shearing force within these suitable ranges, both optical transmissivity and offset resistance can be achieved in a color toner in fixing without the use of an oil. Preferably, the weight average molecular weight is from 8000 to 100,000, the Z average molecular weight is from 18,000 to 300,000, the weight average molecular weight/number average molecular weight is from 3 to 60, and the Z average molecular weight/number average molecular weight is from 10 to 500. Even more preferably, the weight average molecular weight is from 10,000 to 40,000, the Z average molecular weight is from 20,000 to 80,000, the weight average molecular weight/number average molecular weight is from 3 to 30, and the Z average molecular weight/number average molecular weight is from 10 to 50.

If the weight average molecular weight is less than 8000, or if the Z average molecular weight is less than 18,000, or if the weight average molecular weight/number average molecular weight is less than 3, or if the Z average molecular weight/number average molecular weight is less than 10, not enough kneading stress tends to be applied, and the molecular weight cannot be maintained at the proper level. Wax dispersibility tends to decrease, as well as offset resistance and high temperature preservation stability, cleaning of the intermediate transfer member tends to be poor, and filming tends to occur on the photosensitive member.

On the other hand, if the weight average molecular weight is greater than 180,000, or if the Z average molecular weight is greater than 1,000,000, or if the weight average molecular weight/number average molecular weight is greater than 80, or if the Z average molecular weight/number average molecular weight is greater than 1000, the charge control agent and other internal additives tend to agglomerate together, leading to a drop in dispersibility, an increase in fogging, a decrease in image density, and poor transfer. This also leads to a decrease in fixing strength, optical transmissivity, and gloss.

The binder resin is to contain no more than 5 wt % THF insolubles, and preferably contains no THF insolubles at all. If the THF insoluble content is over 5 wt %, the optical transmissivity of a color image tends to suffer and the image tends to be inferior.

A binder resin that can be used preferably in this embodiment is a polyester resin obtained by polycondensation of an alcohol component and a carboxylic acid component such as a carboxylic acid, carbonate, or carboxylic anhydride.

Examples of dicarboxylic acids or lower alkyl esters include aliphatic dibasic acids such as malonic acid, succinic acid, glutaric acid, adipic acid, and hexahydrophthalic anhydride, aliphatic unsaturated dibasic acids such as maleic acid, maleic anhydride, fumaric acid, itaconic acid, and citraconic acid, aromatic dibasic acids such as phthalic anhydride, phthalic acid, terephthalic acid, and isophthalic acid, and methyl esters and ethyl esters of these. Of these, an aromatic dibasic acid such as succinic acid, phthalic acid, terephthalic acid, or isophthalic acid, or a lower alkyl ester of one of these acids, is preferred. It is preferable to use a combination of succinic acid and terephthalic acid, or of phthalic acid and terephthalic acid.

Examples of trivalent and higher carboxylic acid components include 1,2,4-benzenetricarboxylic acid, 1,2,5-benzenetricarboxylic acid, 1,2,4-cyclohexanetricarboxylic acid, 2,5,7-naphtalenetricarboxylic acid, 1,2,4-naphtalenetricarboxylic acid, 1,2,4-butanetricarboxylic acid, 1,2,5-hexatricarboxylic acid, 1,3-dicarboxyl-2-methyl-2-methylenecarboxyprop ane, tetra(methylene carboxyl)methane, 1,2,7,8-octanetetracarboxylic acid, pyromellitic acid, Enpol trimer acid, and acid anhydrides and alkyl ($C_1$ to $C_{12}$) esters of these.

Examples of dihydric alcohols include diols such as ethylene glycol, 1,2-propylene glycol, 1,3-propylene glycol, 1,3-butylene glycol, 1,4-butylene glycol, 1,6-hexanediol, neopentyl glycol, diethylene glycol, dipropylene glycol, bisphenol A ethylene oxide adduct, and bisphenol A propylene oxide adduct, triols such as glycerol, trimethylolpropane, and trimethylolethane, and mixtures of these. Of these, a bisphenol A expressed by Chemical Formula 1, its derivatives, its alkylene oxide adducts, neopentyl glycol, or trimethylolpropane is particularly preferable.

(Chemistry Formula 1)

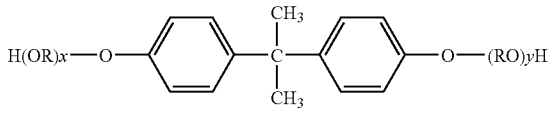

where R is an ethylene group or propylene group, x and y are each an integer greater than or equal to 1, and the average value of x+y is from 2 to 10.

Examples of trihydric and higher alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The polymerization can be performed by a known process, such as polycondensation or solution polycondensation. This allows a good toner to be obtained without sacrificing PVC matte resistance or the color of the coloring material used in a color toner.

Polycarboxylic acids and polyhydric alcohols usually are used in a proportion such that the ratio of the number of hydroxyl groups to the number of carboxyl groups (OH/COOH) is from 0.8 to 1.4.

The molecular weights of the resin, wax, and toner are measured by gel permeation chromatography (GPC) using a number of kinds of monodisperse polystyrene as the standard sample.

The apparatus used in this measurement is one from the HPLC 8120 series (made by Tosoh), with columns of TSKgel superHM-H H4000/H3000/H2000 (diameter: 7.8 mm, 150 mm×3), with an eluant of THF (tetrahydrofuran), at a flow rate of 0.6 mL/min, a sample concentration of 0.1%, and an added amount of 20 μL, with an RI detector, and at a measurement temperature of 40° C. As a pretreatment, the sample is dissolved in THF and filtered through a filter of 0.45 μm to remove additives such as silica. The resin component thus obtained is measured. The measurement conditions are such that the molecular weight distribution of the sample to be measured is included in a range in which a straight line is formed by the count number and the logarithm of the molecular weight in a calibration curve obtained from a plurality of different monodisperse polystyrene standard samples.

The apparatus used to measure the wax obtained by reacting a $C_4$ to $C_{30}$ long chain alkyl alcohol, an unsaturated polycarboxylic acid or anhydride thereof, and an unsaturated hydrocarbon wax is a GPC-150C made by Waters, with columns of Shodex HT-806M (8.0 mm I.D.-30 cm×2), with an eluant of o-dichlorobenzene, at a flow rate of 1.0 mL/min, a sample concentration of 0.3%, and an added amount of 200 μL, with an RI detector, and at a measurement temperature of 130° C. As a pretreatment, the sample is dissolved in a solvent and then filtered through a sintered metal filter of 0.5 μm. The measurement conditions are such that the molecular weight distribution of the sample to be measured is included in a range in which a straight line is formed by the count number and the logarithm of the molecular weight in a calibration curve obtained from a plurality of different monodisperse polystyrene standard samples.

The softening point of the binder resin is measured as follows by using a constant load extrusion type of capillary rheometer made by Shimadzu (CFT500). While heating 1 $cm^3$ of sample at a temperature elevation rate of 6° C./min, a load of approximately $9.8\times10^5$ $N/m^2$ is applied by a plunger to extrude the sample from a die 1 mm in diameter and 1 mm in length. Based on the relationship between the piston stroke of the plunger and the temperature elevation characteristics, the temperature at which the piston stroke starts to rise is termed the flow beginning temperature (Tfb° C.), and one-half the difference between the lowest value on the curve and the flow end point is calculated, and the temperature at the point where the lowest value in the curve is added to the one-half value is termed the melting temperature (softening point Tm° C.) by the ½ method.

The glass transition point of the resin is measured by using a differential scanning calorimeter and following ASTMD3418-82. The glass transition point refers to the temperature at the point of intersection between an extension of a base line below the glass transition point and a tangent having the maximum slope from the peak rise portion to the peak top, in the course of measuring hysteresis when the sample is heated to 100° C. and left at that temperature for 3 minutes, after which it is cooled to room temperature at a temperature decrease rate of 10° C./min, and then heated at a temperature elevation rate of 10° C./min.

The melting point in an endothermic peak (as determined by DSC) is measured with a differential scanning calorimeter DSC-50 made by Shimadzu. The sample is heated to 200° C. at a rate of 5° C./min, is held at that temperature for 5 minutes, and is quenched to 10° C., after which it is allowed to stand for 15 minutes, and then heated at a rate of 5° C./min, and the melting point is found from the endothermic (melting) peak. The amount of the sample put into a cell is 10 mg±2 mg.

Preferable examples of the binder resin used in this embodiment also include homopolymers or copolymers of various kinds of vinyl monomer. Examples include styrene and derivatives thereof, such as styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, and p-chlorostyrene, with styrene being particularly preferable.

Examples of acrylic monomers include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, beta-hydroxyethyl acrylate, gamma-hydroxypropyl acrylate, alpha-hydroxybutyl acrylate, beta-hydroxyethyl methacrylate, gamma-aminopropyl acrylate, gamma-N,N-diethylaminopropyl acrylate, ethylene glycol dimethacrylate, and tetraethylene glycol dimethacrylate. A copolymer of styrene and butyl acrylate is preferable as the styrene-acrylic copolymer for the purposes of the present invention, and particularly one that contains 75 to 85 wt % styrene and 15 to 25 wt % butyl acrylate.

(4) Charge Control Agent

A charge control agent is added in this embodiment for the purpose of controlling the toner charge and for ensuring stronger oil-less fixing. An acrylsulfonic acid-based polymer is a preferable material, and a vinyl copolymer of a styrene-based monomer and an acrylic acid-based monomer having sulfonic acid groups as polar groups is preferred. The characteristics are particularly preferable with a copolymer of acrylamide-2-methylpropanesulfonic acid. When used in combination with the above-mentioned carrier, this facilitates handling within the developing unit, and increases uniformity in toner density. The occurrence of developing memory also is suppressed.

The metal salt of a salicylic acid derivative shown in Chemical Formula 2 can be used as a preferable material.

(Chemical Formula 2)

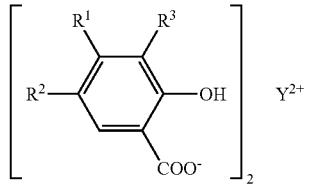

where $R^1$, $R^2$, and $R^3$ are each independently a hydrogen atom or a linear or branched $C_1$ to $C_{10}$ alkyl group or allyl group, and Y is at least one element selected from zinc, nickel, cobalt, copper, and chromium.

The metal salt of a benzylic acid derivative shown in Chemical Formula 3 can be used as a preferable material.

(Chemical Formula 3)

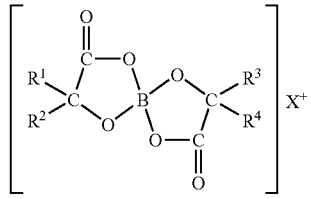

where $R^1$ and $R^4$ are each independently a hydrogen atom, a linear or branched $C_1$ to $C_{10}$ alkyl group, or an aromatic ring that may have a substituent, $R^2$ and $R^3$ are aromatic rings that may be substituted, and X is an alkali metal.

In the metal salt of a salicylic acid derivative, examples of $C_1$ to $C_{10}$ alkyl groups include a methyl group, ethyl group, n-propyl group, isopropyl group, n-butyl group, isobutyl group, sec-butyl group, and tert-butyl group. Examples of the metal Y include zinc, nickel, cobalt, copper, and chromium, with zinc and chromium being preferred. In the metal salt of a benzylic acid derivative, $R^1$ to $R^4$ can be a benzene ring, and examples of the alkali metal X include lithium, sodium, and potassium, with potassium being preferred. This constitution ensures a wide range of non-offset temperature in oil-less fixing, and also prevents image disruption caused by a charge action during fixing. This is believed to be the effect of the charge polarity of the metal salt and functional group having an acid value possessed by the wax. This also reduces the amount of charge in continuous use. The added amount of this agent is preferable from 0.5 to 5 parts by weight per 100 parts by weight of binder resin. 1 to 4 parts by weight is even more preferable, and 3 to 4 parts by weight is better yet. There tends to be no charge action effect if the amount is less than 0.5 parts by weight, but color impurity tends to be pronounced in a color image if the amount is greater than 5 parts by weight.

(5) Pigment

Examples of the pigment used in this embodiment include carbon black, iron black, graphite, nigrosine, a metal complex of an azo dye, arylamide acetoacetate monoazo yellow pigments such as C.I. pigment yellow 1, 3, 74, 97, and 98, arylamide acetoacetate diazo yellow pigments such as C.I. pigment yellow 12, 13, 14, and 17, C.I. solvent yellow 19, 77, and 79, and C.I. disperse yellow 164. Abenzimidazolone-based pigment such as C.I. pigment yellow 93, 180, or 185 is particularly preferable because it is effective with respect to filming on the photosensitive member.

One or more types of red pigment such as C.I. pigment red 48, 49:1, 53:1, 57, 57:1, 81, 122, and 5, red dyes such as C.I. solvent red 49, 52, 58, and 8, and blue dyes or pigments such as phthalocyanine or a derivative thereof, such as C.I. pigment blue 15:3 are added. The added amount preferably is from 3 to 8 parts by weight per 100 parts by weight of binder resin.

(6) Powder Properties of Toner

The constitution in this embodiment is such that the volume average particle size of a toner containing at least a binder resin, a colorant, and a wax is from 3.5 to 6.5 μm, the toner contains from 30 to 80% particles (in the number distribution) of 5.04 μm or smaller, contains from 5 to 35% particles (in the number distribution) of 3.17 μm or smaller, and contains no more than 35 vol % particles whose size is between 6.35 and 10.1 μm. The constitution in a more preferable example is such that a toner particle contains no more than 30 vol % particles whose size is between 6.35 and 10.1 μm, and contains no more than 5 vol % particles of 8 μm or larger in the number distribution. This affords an image of high resolution, prevents back-transfer in tandem transfer, prevents partial transfer defects, and allows oil-less fixing. Attaining both good image quality and good transfer becomes difficult if the volume average particle size is greater than 6.5 μm, but the toner particles tend to be difficult to handle in development if the volume average particle size is less than 3.5 μm. Attaining both good image quality and good transfer becomes difficult if the content of particles of 5.04 μm or smaller in the number distribution is less than 30%, but the toner particles tend to be difficult to handle in development if the content is over 80%. Carrier fouling also tends to occur. Attaining both good image quality and good transfer becomes difficult if the content of particles of 3.17 μm or smaller in the number distribution is more than 5%, but the toner particles tend to be difficult to handle in development if the content is over 35%. Attaining both good image quality and good transfer becomes difficult if toner particles having a size of 6.35 to 10.1 μm account for more than 35 vol %. Furthermore, attaining both good image quality and good transfer becomes difficult if toner particles having a size of 6.35 to 10.1 μm account for more 30 vol % and the content of particles of 8 μm or larger in the number distribution is greater than 5 vol %.

This constitution is preferably such that the ratio SSt of the specific surface area St corresponding to a true sphere calculated from the volume average particle size (St=6/(true specific gravity×volume average particle size)) to the measured specific surface area of the produced toner matrix (SSt=St/(specific surface area of pulverized toner)) is from 0.4 to 0.95. This ratio more preferably is from 0.5 to 0.85, and even more preferably from 0.55 to 0.8. The particles tend to be close to spherical if the ratio is over 0.95, which leads to a decrease in chargeability during continuous use, and to problems such as scattering during transfer. If the ratio is smaller than 0.4, the particles tend to be too amorphous in shape, or there tends to be too much excessively pulverized micropowder.

The coefficient of variation of the volume particle size distribution of the toner preferably is from 16 to 32%, and the coefficient of variation of the number particle size distribution preferably is from 18 to 35%. More preferably, the coefficient of variation of the volume particle size distribution is from 18 to 24%, and the coefficient of variation of the number particle size distribution is from 20 to 26%. Most preferably, the coefficient of variation of the volume particle size distribution is from 18 to 22%, and the coefficient of variation of the number particle size distribution is from 20 to 24%.

The coefficient of variation is a value obtained by dividing the standard deviation of the toner particle size by the average particle size. This value is found on the basis of particle sizes measured with a Coulter Counter (made by Coulter). The standard deviation is expressed as the square root of the value obtained by measuring n-number of particle systems and dividing the sum of the squares of the difference of the various measured values from the average value by (n−1). That is, the coefficient of variation expresses how wide the particle size distribution is, and when the coefficient of variation of the volume particle size distribution is less than 16%, or when the coefficient of variation of the number particle size distribution is less than 18%, manufacture becomes difficult and costs rise. When the coefficient of variation of the volume particle size distribution is greater than 32%, or when the coefficient of variation of the number particle size distribution is greater than 35%, the particle size distribution becomes broader, causing strong toner agglomeration, filming on the photosensitive member, and transfer defects, and making it difficult to recover residual toner in a cleaner-less process.

The micropowder in a toner affects the fluidity of the toner, image quality, storage stability, filming of the photosensitive member, the developing roller, and the transfer member, characteristics over time, transferability, and especially multilayer transferability in tandem transfer. It also affects optical transmissivity, gloss, and offset resistance in oil-less fixing. With a toner containing a wax or other release agent for the sake of oil-less fixing, the amount of micropowder affects tandem transferability. If the amount of micropowder is too large, much wax that cannot be dispersed tends to be exposed on the toner surface, resulting in filming on the photosensitive member and transfer member. Furthermore, since a micropowder readily adheres to a hot roller, it tends to cause offset. Also, in tandem transfer, toner agglomeration tends to be strong, and this tends to result in transfer defects in the second color during multilayer transfer. If the amount of micropowder is too small, though, this can lead to a decrease in image quality.

The particle size distribution is measured with a Coulter Counter model TA-II (made by Coulter), and is measured by connecting to a computer and an interface (made by Nikkaki) that outputs the number distribution and volume distribution.

About 2 mg of toner sample is added to about 50 mL of electrolyte to which a surfactant (sodium laurylsulfate) has been added in a concentration of 1 wt %, and the electrolyte in which the sample has been suspended is subjected to a dispersal treatment for about 3 minutes with an ultrasonic disperser. An aperture of 70 μm was used with the Coulter Counter model TA-II. With an aperture of 70 μm, the particle size distribution measurement range is from 1.26 to 50.8 μm, but the region below 2.0 μm is impractical because external noise and so forth result in low measurement precision and reproducibility. Thus, the measurement range was set at 2.0 to 50.8 μm.

Compression, which is calculated from static bulk density and dynamic bulk density, is an index of toner fluidity. The fluidity of a toner is affected by the particle size distribution of the toner, the toner particle shape, additives, and the type and amount of wax. Compression is low and toner fluidity is high when the particle size distribution of the toner is narrow and there is little micropowder, or when there are few bumps on the surface of the toner and the particle shape is close to spherical, or when a large quantity of additives are added, or when the particle size of the additives is small. Compression preferably is from 5 to 40%, and even more preferably 10 to 30%. This allows both oil-less fixing and tandem multilayer transfer to be achieved. If the compression is less than 5%, fixability tends to decrease, and optical transmissivity tends to be particularly poor. There also tends to be more toner scattering from the developing roller. If the compression is greater than 40%, though, transferability tends to decrease, and partial transfer defects and the like tend to occur in tandem transfer.

(7) Carrier

A carrier having a carrier core and a resin coating layer composed of a fluorine-modified silicone resin containing an aminosilane coupling agent can be used preferably as the resin coated carrier in this embodiment. Examples of the carrier core include an iron powder-based carrier core, a ferrite-based carrier core, a magnetite-based carrier core, and a resin dispersed type of carrier core comprising a magnetic material dispersed in a resin. Examples of the ferrite-based carrier core here generally are expressed by the following formula.

$$(MO)_x(Fe_2O_3)_y$$

where M is at least one element selected from Cu, Zn, Fe, Mg, Mn, Ca, Li, Ti, Ni, Sn, Sr, Al, Ba, Co, Mo, and the like. X and Y indicate the mole-based weight ratio and satisfy the condition X+Y=100.

At least one oxide of M (selected from Cu, Zn, Fe, Mg, Mn, Ca, Li, Ti, Ni, Sn, Sr, Al, Ba, Co, Mo, and the like) is mixed with the main raw material $Fe_2O_3$, and this mixture is used as the raw material for the ferrite-based carrier core. An example of a method for manufacturing a ferrite-based carrier core is first to blend suitable amounts of the raw material such as the above-mentioned oxides, pulverize and mix these components for 10 hours in a wet ball mill, dry the mixture, and then keep this product at 950° C. for 4 hours. This product is pulverized for 24 hours in a wet ball mill, and polyvinyl alcohol (as a binder), an antifoaming agent, a dispersant, or the like is added to create a slurry with a raw material particle size of 5 μm or less. This slurry is granulated and dried, and these granules are kept at 1300° C. for 6 hours under a controlled oxygen concentration, and then pulverized and graded to the desired particle size distribution.

It is essential that the resin used for the resin coating layer of the present invention be a fluorine-modified silicone resin. This fluorine-modified silicone resin preferably is a crosslinkable fluorine-modified silicone resin obtained by reacting a polyorganosiloxane with an organosilicon compound containing perfluoroalkyl groups. The ratio in which the polyorganosiloxane and the organosilicon compound containing perfluoroalkyl groups are combined preferably is at least 3 parts by weight and no more than 20 parts by weight of the organosilicon compound containing perfluoroalkyl groups per 100 parts by weight of polyorganosiloxane.

The polyorganosiloxane preferably is at least one repetition unit selected from Chemical Formulas 4 and 5 below.

(Chemical Formula 4)

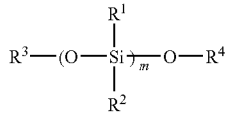

where $R^1$ and $R^2$ are each a hydrogen atom, halogen atom, hydroxy group, methoxy group, or $C_1$ to $C_4$ alkyl group or phenyl group, $R^3$ and $R^4$ are each a $C_1$ to $C_4$ alkyl group or phenyl group, and m is a positive integer (preferably in the range from 2 to 500, more preferably in the range from 5 to 200) indicating the average degree of polymerization.

(Chemical Formula 5)

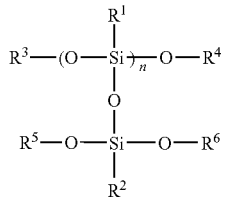

where $R^1$ and $R^2$ are each a hydrogen atom, halogen atom, hydroxy group, methoxy group, or $C_1$ to $C_4$ alkyl group or phenyl group, $R^3$, $R^4$, $R^5$, and $R^6$ are each a $C_1$ to $C_4$ alkyl group or phenyl group, and n is a positive integer (preferably in the range from 2 to 500, more preferably in the range from 5 to 200) indicating the average degree of polymerization.

Examples of the perfluoroalkyl group-containing organosilicon compound include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CH_3)_2CF(CF_2)_8CH_2CH_2Si(OCH_3)_3$, but one that has a trifluoropropyl group is particularly preferable.

In this embodiment, an aminosilane coupling agent is contained in the resin coating layer. This aminosilane coupling agent may be a known agent such as γ-(2-aminoethyl)aminopropyltrimethoxysilane, γ-(2-aminoethyl)aminopropylmethyldimethoxysilane, and octadecylmethyl[3-(trimethoxysilyl)propyl] ammonium chloride (from the top, SH6020, SZ6023, and AY43-021, all made by Dow Corning Toray Silicone), and KBM602, KBM603, KBE903, and KBM573 (made by Shin-Etsu Silicone). A primary amine is particularly preferable. The polarity is weak with secondary or tertiary amines substituted with a methyl group, ethyl group, phenyl group, or the like, so that these have little effect on the charge rise characteristics with the toner. Also, when the amino group portion is an aminomethyl group, aminoethyl group, or aminophenyl group, then the silane coupling agent has a primary amine at its very end, but the amino groups in the straight-chain organic groups extending from the silane do not contribute to the charge rise characteristics with the toner, but conversely are affected by moisture under high humidity, so that although the carrier initially may have been capable of imparting a charge with the toner due to the amino group at the end, this charge imparting capability decreases after repeated printings, so that the carrier ends up having short service life.

The use of an aminosilane coupling agent such as this and fluorine-modified silicone resin in combination ensures a sharp charge quantity distribution with respect to the toner, while allowing negative chargeability to be imparted, results in a fast charge rise in supplementally added toner, and reduces the amount of toner consumption. Furthermore, the aminosilane coupling agent has an effect similar to that of a crosslinking agent, and therefore increases the degree of crosslinking of the fluorine modified silicone resin layer serving as a base resin, further increases the coating resin hardness, reduces wear, separation, and so forth that result from extended use, improves resistance to toner-spent, suppress a decrease in chargeability, stabilizes charging, and increases durability. Furthermore, if this is used in combination with a toner to which a certain amount or more of specific additive has been added, handling in the developing unit is facilitated, there is better uniformity in density between the leading and trailing sides in developing an image. Also, there is a reduction in what is known as developing memory, in which a history remains after a solid image is acquired. If this is used in combination with a toner to which a certain amount or more of low-melting point wax has been added for oil-less fixing, it is possible to prevent toner-spent on the carrier and improve the service life. The aminosilane coupling agent is used in a proportion of 5 to 40 wt %, and preferably 10 to 30 wt %, with respect to the resin. The aminosilane coupling agent tends to have no effect if this proportion is less than 5 wt %, but if 40 wt % is exceeded, the crosslinking of the resin coating layer tends to be too high, making it more likely that charge-up occurs, and causing image defects such as an insufficient development.

The resin coating layer also can contain conductive microparticles in order to stabilize charging and to prevent charge-up. Examples of such conductive microparticles include carbon blacks such as oil furnace carbon and acetylene black, semiconductive oxides such as titanium oxide and zinc oxide, and materials in which the surface of a powder such as titanium oxide, zinc oxide, barium sulfate, aluminum borate, or potassium titanate is coated with tin oxide, carbon black, or a metal. The specific resistance of these particles preferably is $10^{10}$ Ω·cm or less. When conductive microparticles are used, they are preferably contained in an amount of 1 to 15 wt %. If a certain amount of conductive microparticles are contained in the resin coating layer, they tend to increase the hardness of the resin coating layer by a filler effect, but if the amount is over 15 wt %, they tend conversely to hinder the formation of the resin coating layer and cause a decrease in adhesiveness or hardness. Furthermore, if the conductive microparticles are contained in too large an amount in a full-color developer, they tend to cause toner color stains in the toner that is transferred and fixed to the paper surface.

The use in combination with a toner to which the inorganic micropowder discussed above has been added lowers toner-spent on the carrier caused by the low-melting point component more, and ensures a longer service life. During mixing and stirring, there is an effect of improving the charge rise characteristics and dot reproducibility, and reducing fogging.

The average particle size of the carrier used in the present invention preferably is 20 to 70 μm. If the average particle size of the carrier is less than 20 μm, the ratio of microparticles in the carrier particle distribution tends to be high and the amount of magnetization per carrier particle tends to be small, so that the carrier is more prone to being developed on the photosensitive member. If the average particle size of the carrier is more than 70 μm, however, the specific surface area of the carrier particles tends to be small and their toner holding power tends to be weak, resulting in toner scattering. Also, in full color development including a large amount of solid image, the solid image is reproduced in a particularly poor manner, which is not preferable.

There are no particular restrictions on how the coating layer is formed on the carrier core, and any known coating method may be employed. Examples include wet coating methods such as an immersion method in which a powder (the carrier core) is immersed in a solution for forming a coating layer, a spray method in which a solution for forming a coating layer is sprayed onto the surface of the carrier core, a fluidized bed method in which a solution for forming a coating layer is sprayed while the carrier core is fluidized with air, and a kneader coater method in which the carrier core and a solution for forming a coating layer are mixed in a kneader coater and the solvent is then removed; and a dry coating method in which a powdered resin and the carrier core are mixed at a high speed and the frictional heat thus generated is utilized to fuse a coating of the powdered resin to the surface of the carrier core. Although any of these methods can be applied, it is particularly preferable to use a wet coating method for coating with a fluorine-modified silicone resin containing an aminosilane coupling agent as in the present invention.

There are no particular restrictions on the solvent used in the coating liquid for forming a coating layer, as long as it is one that will dissolve the coating resin, and the solvent may be selected as dictated by the coating resin being used. Examples of the solvent typically include aromatic hydrocarbons such as toluene and xylene, ketones such as acetone and methyl ethyl ketone, and ethers such as tetrahydrofuran and dioxane.

The amount of resin coating in the present invention is from 0.1 to 5.0 wt % with respect to the carrier core. If the amount of resin coating is less than 0.5 wt %, a uniform coating cannot be formed on the carrier surface, and the influence of the characteristics of the carrier core tends to be so strong that the effect of the fluorine-modified silicone resin and the aminosilane coupling agent of the present invention cannot be fully realized. If the amount is more than 5.0 wt %, the coating layer tends to be too thick, granulation tends to occur among the carrier particles, and there tends to be a tendency for uniform carrier particles not to be obtained.

After coating the surface of the carrier core with the fluorine-modified silicone resin containing an aminosilane coupling agent in this manner, it is preferable to perform a baking treatment. There are no particular restrictions on the means for performing this baking treatment, and it may involve either external or internal heating. For example, the baking may be performed by using an electric furnace with a fixed or a fluidized bed, a rotary kiln electric furnace, or a burner furnace, or microwaves may be used. As to the temperature in the baking treatment, however, in order for the effect of the fluorosilicone (improving the toner-spent resistance of the resin coating layer) to be exhibited efficiently, the treatment preferably is conducted at a high temperature of from 200 to 350° C., and more preferably from 220 to 280° C. A treatment duration of 0.5 to 2.5 hours is suitable. The hardness of the coating resin itself tends to decrease if the treatment temperature is too low, but charging tends to decrease if the treatment temperature is too high.

(8) Kneading Method

Kneading under a high shearing force allows the added wax to be more finely dispersed. Thorough dispersion can be accomplished by optimally setting the kneading conditions, including the roll temperature, temperature gradient, rotational speed, and load current, and the softening point and glass transition point of the binder resin. "High shearing force" refers to a kneading force that acts on a binder resin or other toner material when rolls that are spaced at a narrow gap are rotated at a high speed, and refers to the force produced when the material is squeezed through the narrow gap, and to the shearing force imparted by rotating rolls having a rotational speed differential. A kneading force is produced that was unattainable with a conventional biaxial extruder. This makes it possible to produce high and low molecular weight components for the binder resin.

More specifically, there are two opposing rolls that are rotating in different directions and are capable of heating or cooling. A temperature differential is provided between the temperature of one roll (RL1) and the other roll (RL2). The roll (RL1) and the roll (RL2) are rotated at different peripheral speeds so that kneading is performed between the two rolls. Furthermore, the roll (RL1) has a temperature differential between its front and rear portions.

The speed ratio of the two rolls is from 1.1 times to 2.5 times so that an appropriate shearing force is generated during kneading, the binder resin undergoes molecular cleavage, there is an increase in the dispersibility of the colorant and other internal additives, and development and fixing are improved. This constitution is such that the roll on which the heated and melted toner adheres has a higher rotation ratio. If the ratio is less than 1.1, the proper shearing force tends not to be produced, dispersibility tends not to be increased, and optical transmissivity tends to suffer. Conversely, if the ratio is over 2.5 times, there tends to be a sharp reduction in productivity, dispersibility tends not to increase, and development tends to suffer.

If the kneading here is performed such that the ratio of load current values applied to the two rolls is between 1.25 and 10, the appropriate shearing force tends to be applied and the dispersibility of the internal additives tends to be improved. If the ratio is below this range, there tends to be no increase in dispersibility and optical transmissivity tends to suffer. Productivity also tends to decrease. Conversely, if the ratio is over this range, the rollers tend to be subjected to excessive load, and too much ultra-high molecular weight component tends to be further lowered in molecular weight, with the result being a decrease in offset resistance, so that offset tends to occur.

Figure 3:
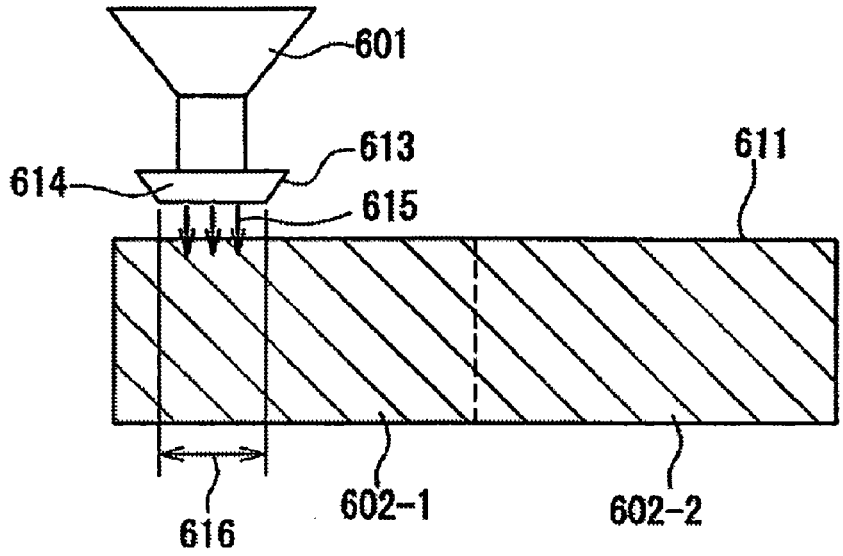
FIG. 3 is a simplified diagram of a toner kneading device used in a working example of the present invention.
Figure 4:
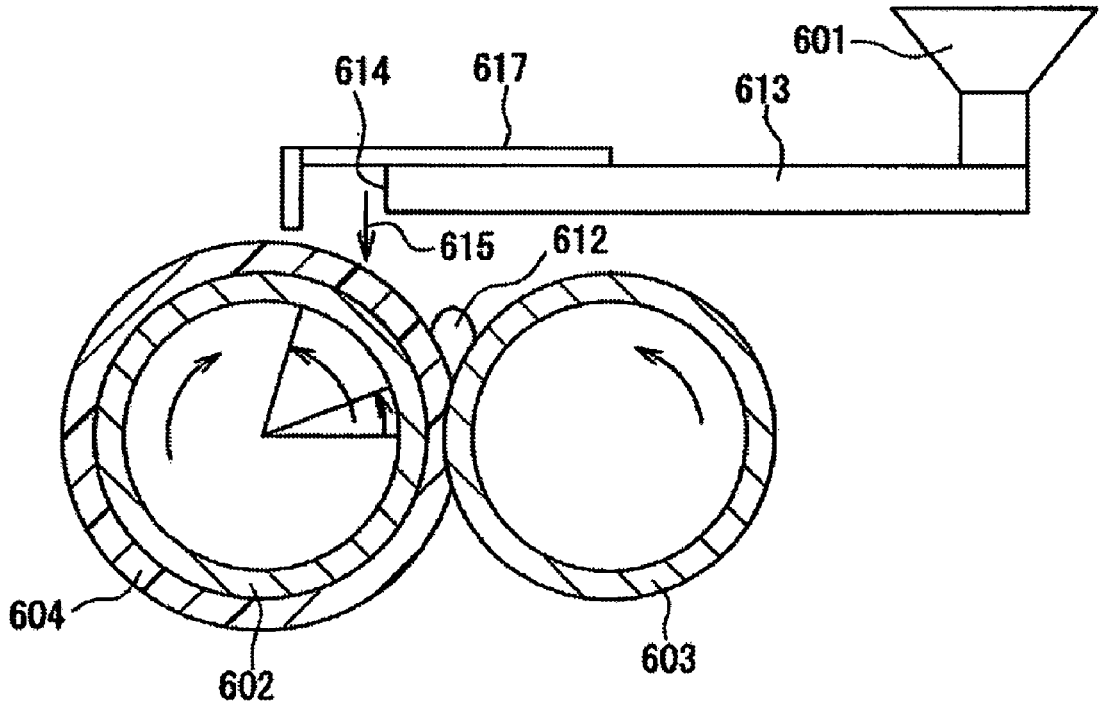
FIG. 4 is a plan view of a toner kneading device used in a working example of the present invention.
Figure 5:
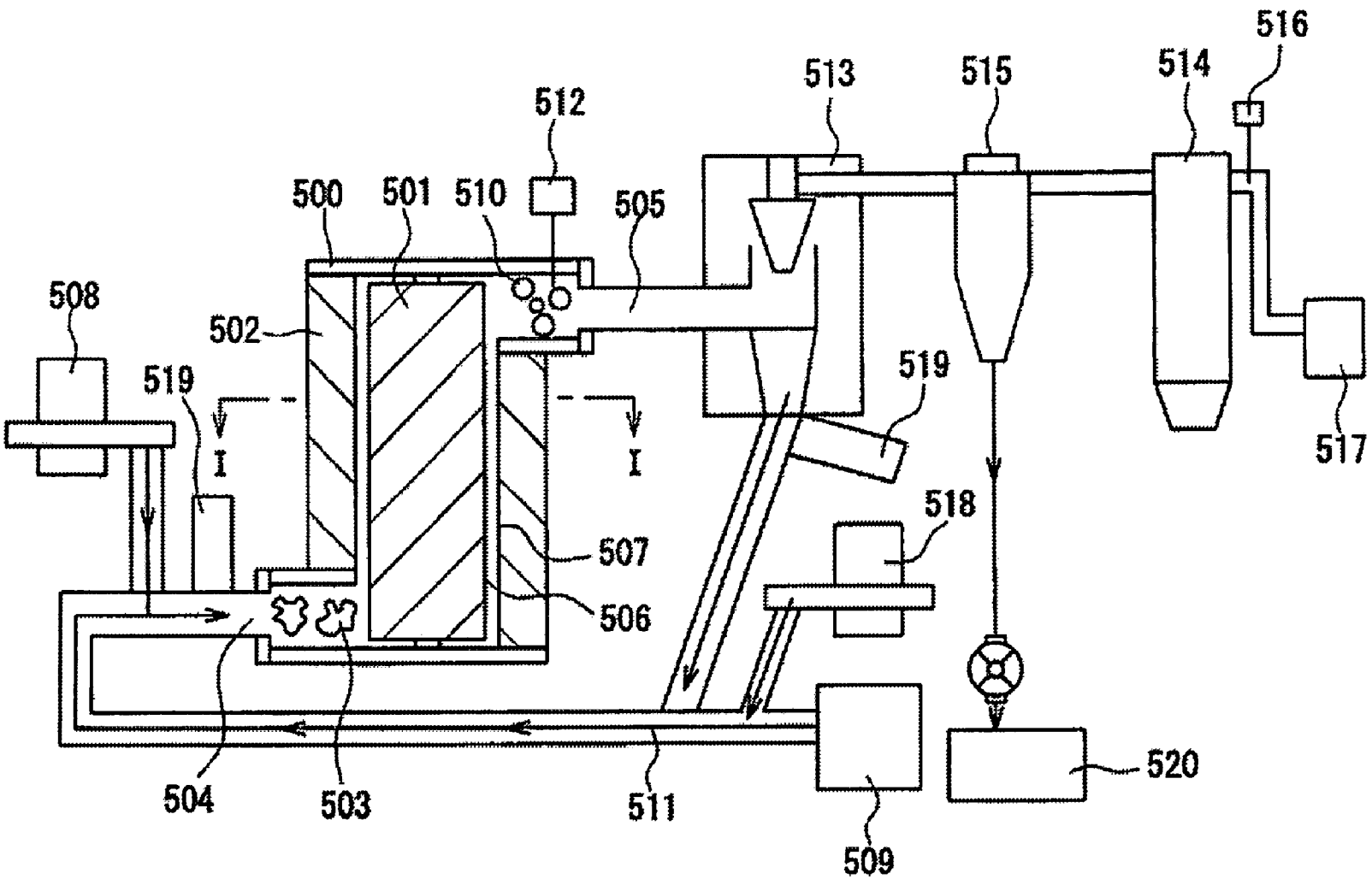
FIG. 5 is a side view of a toner kneading device used in a working example of the present invention.
Figure 6:
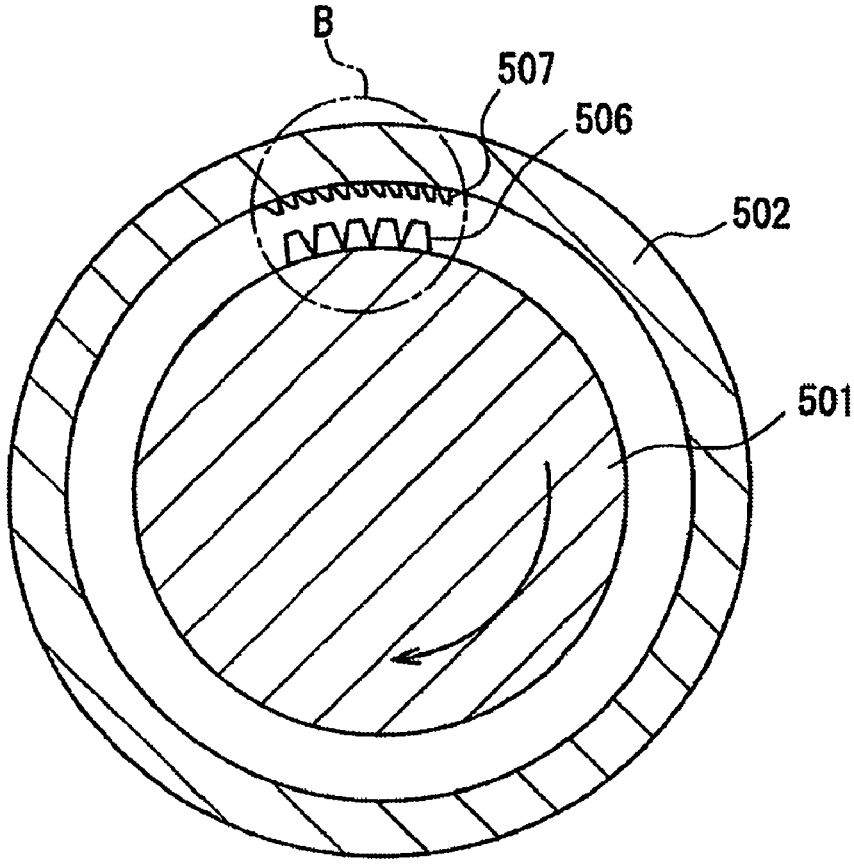
FIG. 6 is a cross-sectional view of a toner kneading device used in a working example of the present invention.

FIG. 3 is a simplified oblique view of a toner melt-kneading process, FIG. 4 is a plan view seen from the above, FIG. 5 is a side view seen from the left side, and FIG. 6 is a cross-sectional view in a winding state. 601 is a metering supply unit for toner raw material, 602 is a roll (RL1), 603 is a roll (RL2), and 604 is a molten toner film adhering around the roll (RL1). The roll 602 rotates clockwise in FIG. 3, while the roll 603 rotates counterclockwise.

In FIG. 4, 602-1 is the front half of the roll (RL1) (the upstream part in the direction of raw material conveyance), 602-2 is the rear half of the roll (RL1) (the downstream part in the direction of raw material conveyance), 603-1 is the front half of the roll (RL2) (the upstream part in the direction of raw material conveyance), 603-2 is the rear half of the roll (RL2) (the downstream part in the direction of raw material conveyance), 605 is an inlet for a heating medium for heating the front half 602-1 of the roll (RL1), 606 is an outlet for the heating medium that has heated the front half 602-1 of the roll (RL1), 607 is an inlet for a medium for heating or cooling the rear half 602-2 of the roll (RL1), 608 is an outlet for the medium that has heated or cooled the rear half 602-2 of the roll (RL1), 618 is an inlet for a heating medium for heating the front half 603-1 of the roll (RL2), 619 is an outlet for the heating medium that has heated the front half 603-1 of the roll (RL2), 609 is an inlet for a medium for heating or cooling the rear half 603-2 of the roll (RL2), and 610 is an outlet for the medium that has heated or cooled the rear half 603-2 of the roll (RL2).

In FIG. 5, 611 is a spiral groove formed on the roll surface, the depth of which is about 2 to 10 mm. The spiral groove 611 is preferable for smoothly conveying the material from the right end of a material charging section to the left end of a discharge section during the kneading of the toner. 603-1 applies enough heat for the raw material to adhere efficiently around the roll.

The raw material discharged from the metering supply unit 601 falls through an opening 614 into the vicinity of the end on the roll (RL1) 602-1 side while going through a raw material supply feeder 613, as shown by arrow 615. 616 represents the length of the opening of the supplying feeder. This length preferably is equal to from one-half to four times the roll radius. If the length is too short, there tends to be a rapid increase in the amount of material that drops down from the gap between the two rollers before it has been melted. If the length is too great, the material tends to separate in the midst of being conveyed by the raw material feeder, so that uniform dispersion tends not to be obtained.

In FIG. 6, the dropping position is set to a point within a range of 20 to 80 degrees from the point at which the two rolls of the roll (RL1) 602 are closest to each other, as indicated by the arrow. If the angle is less than 20 degrees, there tends to be a rapid increase in the amount of the material dropping through the gap between the two rolls. If the angle is greater than 80 degrees, however, there tends to be more billowing of toner powder while it is being dropped, and this powder tends to foul the surrounding area. A cover 617 is provided so as to cover an area wider than the length of the opening portion 616. The cover is not depicted in FIG. 5.

The toner raw material from the metering supply unit 601 falls through the opening 614 while going through the raw material supply feeder 613. The toner raw material that has fallen is charged in the vicinity of the end on the roll (RL1) 602-1 side. The resin is melted by the heat of 602-1 and the compressive shearing force of the roll (RL2) 603-1, and adheres around the front half 602-1 of the roll (RL1). A toner pool 612 is formed between the rolls. This state spreads to the end of the rear half 602-2 of the roll (RL1), and the toner separates in a solid piece from the rear half 602-2 of the roll (RL2) that has been heated or cooled at a temperature lower than that of the front half 602-1 of the roll (RL1). During this process, the roll 603-2 is cooled to room temperature or lower. The clearance between the roll (RL1) 602 and the roll (RL2) 603 is from 0.1 to 0.9 mm. In this example, the raw material charge was 10 kg/h, the diameter of the rolls RL1 and RL2 was 140 mm, and the length was 800 mm.

(9) Pulverization

The two-component developer pertaining to this embodiment prevents toner-spent on the carrier and allows oil-less fixing even when toner with a small particle size is used.

The following is an example of how this pulverization is accomplished. To achieve a small particle size and a sharp particle size distribution, the toner composition is melt and kneaded, after which it is pulverized to the required particle size distribution with a pulverizer equipped with a cylindrical rotor that has a bumpy surface and rotates at a high speed, a cylindrical stator that has a bumpy surface and shares its central axis with the rotor and is disposed on the outside of the rotor with a gap of 0.5 to 40 mm therebetween, a supply inlet through which the toner to be pulverized flows, and a discharge outlet for discharging the pulverized toner. The constitution here is such that some means is provided for lessening the agglomeration of the toner to be pulverized before this toner flows through the supply inlet, and the toner flows through the supply inlet and is pulverized to the required particle size distribution.

The purpose of the means for lessening the agglomeration of the toner to be pulverized is to allow the charge to be removed from the powder with an evaporative medium such as water vapor, ethanol, iso-propyl alcohol, n-butyl alcohol, sec-butyl alcohol, or iso-butyl alcohol, before the toner to be pulverized flows through the supply inlet. The toner to be pulverized is allowed to flow through the supply inlet after being made to adhere or mixed by being sprayed in the form of a mist. Also, in a method in which the toner to be pulverized is subjected to a vibration means before flowing through the supply inlet, in which case examples of the vibration means include ultrasonic vibration and mechanical vibration. A vibration apparatus is provided to the piping before the toner to be pulverized passes through the pipe and flows through the supply inlet of the pulverizing section, and the toner to be pulverized is dispersed while flowing through the supply inlet. Another method is to supply and mix an inorganic micropowder into the toner to be pulverized before the toner flows through the supply inlet, and then allow the toner to flow through the supply inlet and be pulverized. One of the materials discussed above is suitable as this inorganic micropowder. In the pulverization of the toner, the constitution is such that an inorganic micropowder is supplied to and mixed with the toner to be pulverized before the toner flows through the supply inlet, and then the toner is allowed to flow through the supply inlet and is pulverized to the required particle size distribution. As a result, the toner to be pulverized is in a uniformly dispersed state when it enters the pulverizing section having the rotor, and the toner is uniformly pulverized by the eddy produced by the rotor. This makes possible pulverization to a small particle size, and pulverization in a state in which the raw powder has been sharply cut.

The inorganic micropowder that is supplied and mixed in here preferably is a silica or titanium oxide micropowder that has an average particle size of 8 to 40 μm and an ignition loss of 0.5 to 25 wt %. The use a silica or titanium oxide micropowder that has been surface treated with one or more of a fatty acid ester, fatty acid amide, and fatty acid metal salt is preferred. A silica or titanium oxide micropowder that has been surface treated with a silicone oil is an even more preferable material for the inorganic micropowder. Also, an inorganic micropowder having the opposite charge polarity from that of the toner matrix particles is an effective way to lessen the charge of the toner to be pulverized. Constant-amount cut out tends to be unstable if the average particle size is less than 8 nm, but pulverization uniformity tends to be poor if the average particle size is greater than 40 nm. The micropowder tends to scatter if the ignition loss is less than 0.5 wt %, but micropowder agglomeration tends to be severe and the toner to be pulverized is not supplied uniformly if the ignition loss is greater than 25 wt %.

This inorganic micropowder adheres to the toner surface in a state of electrostatic adhesion, without being affixed to the toner matrix. The inorganic micropowder preferably is supplied in an amount of about 0.1 to 5 wt % of the supply amount of the toner to be pulverized.

The gap between the convex part of the rotor and the convex part of the stator is 0.5 to 40 mm, and preferably 0.5 to 10 mm, and even more preferably 0.5 to 6 mm. This improves pulverization efficiency and makes the particles more spherical. There tends to be a pronounced increase in contact between the particles and the rotor and stator if the gap is smaller than 0.5 mm, so that much more frictional heat tends to be generated, which causes toner fusion at the above-mentioned distal end. If the gap is larger than 40 mm, it tends to be impossible to generate a flow with a strong, high-speed stream, making adequate pulverization unattainable.

This method allows pulverization to be performed simultaneously with the external additions, the advantage of which is a shorter manufacturing process. Also, the corners of the toner particles are cleanly rounded off, so that fluidity improves.

If the toner fluidity is low, there tends to be unevenness in solid image areas, friction chargeability tends to decrease, the amount of opposite polarity toner tends to increase, toner tends to adhere stubbornly to the non-image portions of the photosensitive member and cannot be removed, resulting in base fogging that adversely affects the image, and transfer efficiency decreases. If the fluidity of the toner is raised by increasing the amount of external added silica, friction charging tends to be more uniform, there tends to be less base fogging, image density tends to increase, and the unevenness in solid black image portions tends to be eliminated. However, this can create problems such as silica or toner filming on the photosensitive member, or the adhesion of white spots of agglomerated silica to the solid black image portions.

Accordingly, the addition of a small amount of silica yields high fluidity, suppresses the occurrence of suspended silica, and suppresses the occurrence of silica and toner filming on the intermediate transfer member and the photosensitive member, and silica white spots in the solid black image portions. This also suppresses the occurrence of the unevenness in solid black image portions that is seen in toners of low fluidity, results in more uniform transfer, and keeps the occurrence of opposite polarity toner infrequent, and therefore increases the transfer efficiency.

Furthermore, even when transfer is performed at the required pressing force in places where the toner agglomerates, such as characters and lines, and especially under high temperature and humidity, because of the high fluidity of the toner, the toner particles tend not to agglomerate readily, and a sharp image without partial transfer defects can be obtained.

A working example of the toner pulverization apparatus in this embodiment shown in FIG. 7 will now be described. A toner to be pulverized 503, which is the portion of a kneaded material that has been coarsely pulverized and has passed through a mesh with a diameter of approximately 1 to 5 mm, is introduced from a metering supply unit 508 and is sent to a pulverization supply section by cooling air 511 supplied by a cooling unit 509, and this toner is pulverized by a pulverizer 500. Raw material 503 is introduced form an inlet 504, and is carried to the space between a rotor 501, which rotates at a high speed and has a jagged component 506 on its surface, and a stator 502, which has a jagged component 507 on its surface and is positioned with a narrow gap between itself and the rotor 501. The raw material particles collide with each other powerfully and are spherically pulverized in the high-speed flow generated between the stator and the rotor that is rotating at a high speed. The particles 510 that have been made spherical come out through a discharge outlet 505 and are sent to a coarse powder grader 513, and these coarse particles are once again sent through the inlet 504 by the air 511. The product is sent to a cyclone 515 and recovered in a dust trap 520. 512 is a thermometer, 514 is a bag filter, 516 is an airflow meter, and 517 is a blower. 519 is a vibrator, and 518 is an inorganic micropowder supply apparatus. When the particles are separated in the coarse powder grading and sent back to the pulverizing section, it is preferable for the inorganic micropowder to be supplied from the rear. This allows the inorganic micropowder to be mixed more uniformly during collision with the pulverized powder. An evaporative solvent also can be supplied instead of the inorganic micropowder.

Figure 7:
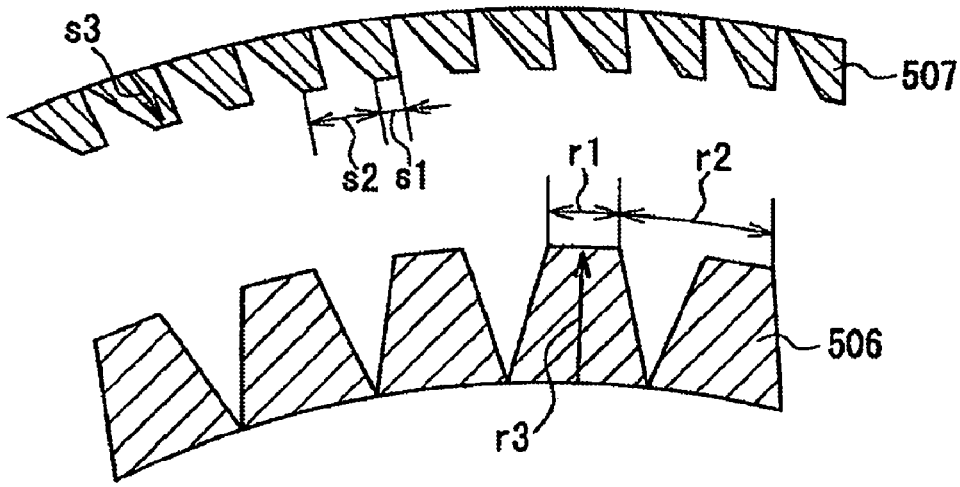
FIG. 7 is a diagram of the constitution of a toner pulverization process used in a working example of the present invention.
Figure 8:
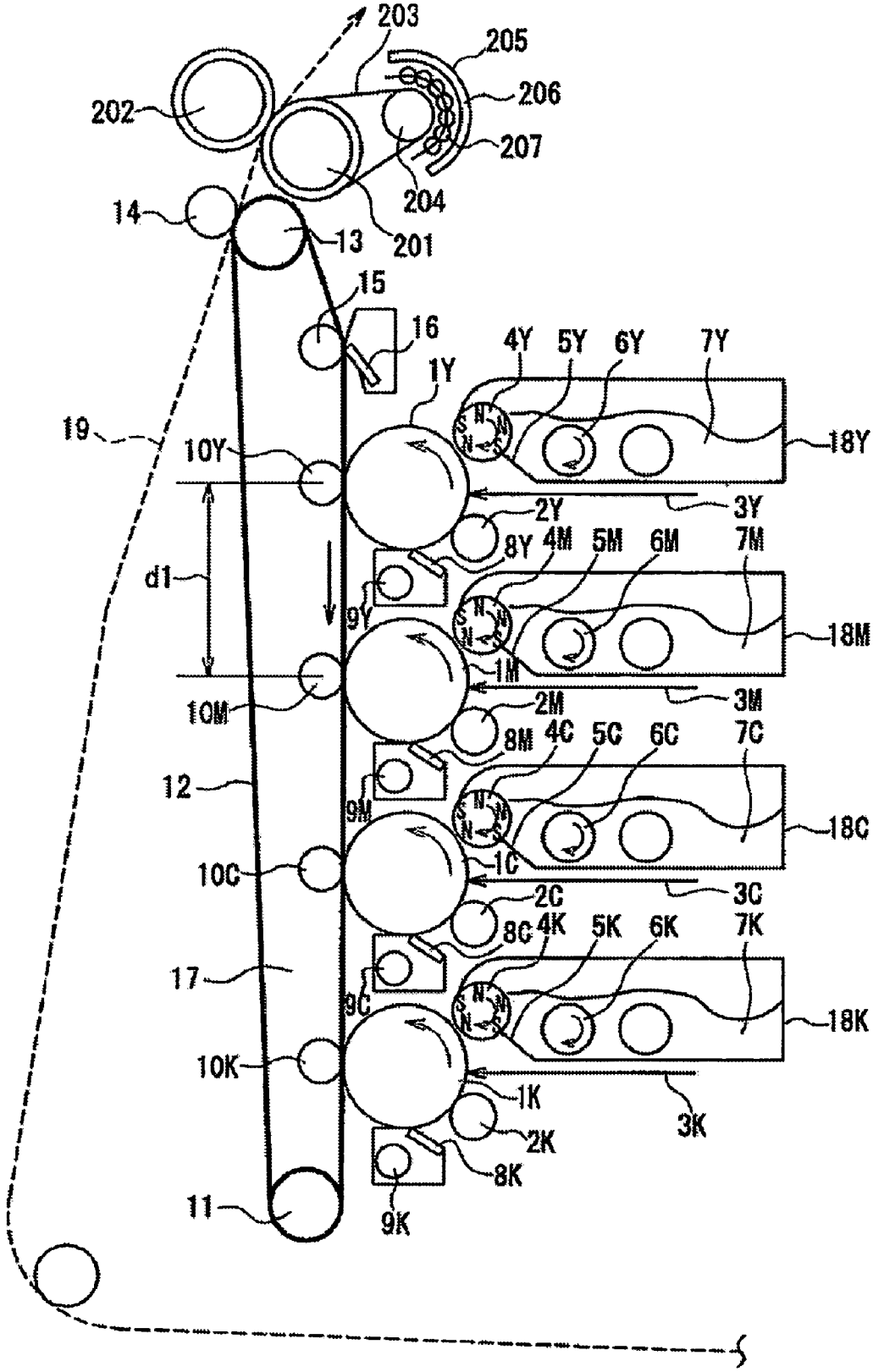
FIG. 8 is a cross-sectional view along the line I-I' in FIG. 7.
Figure 9:
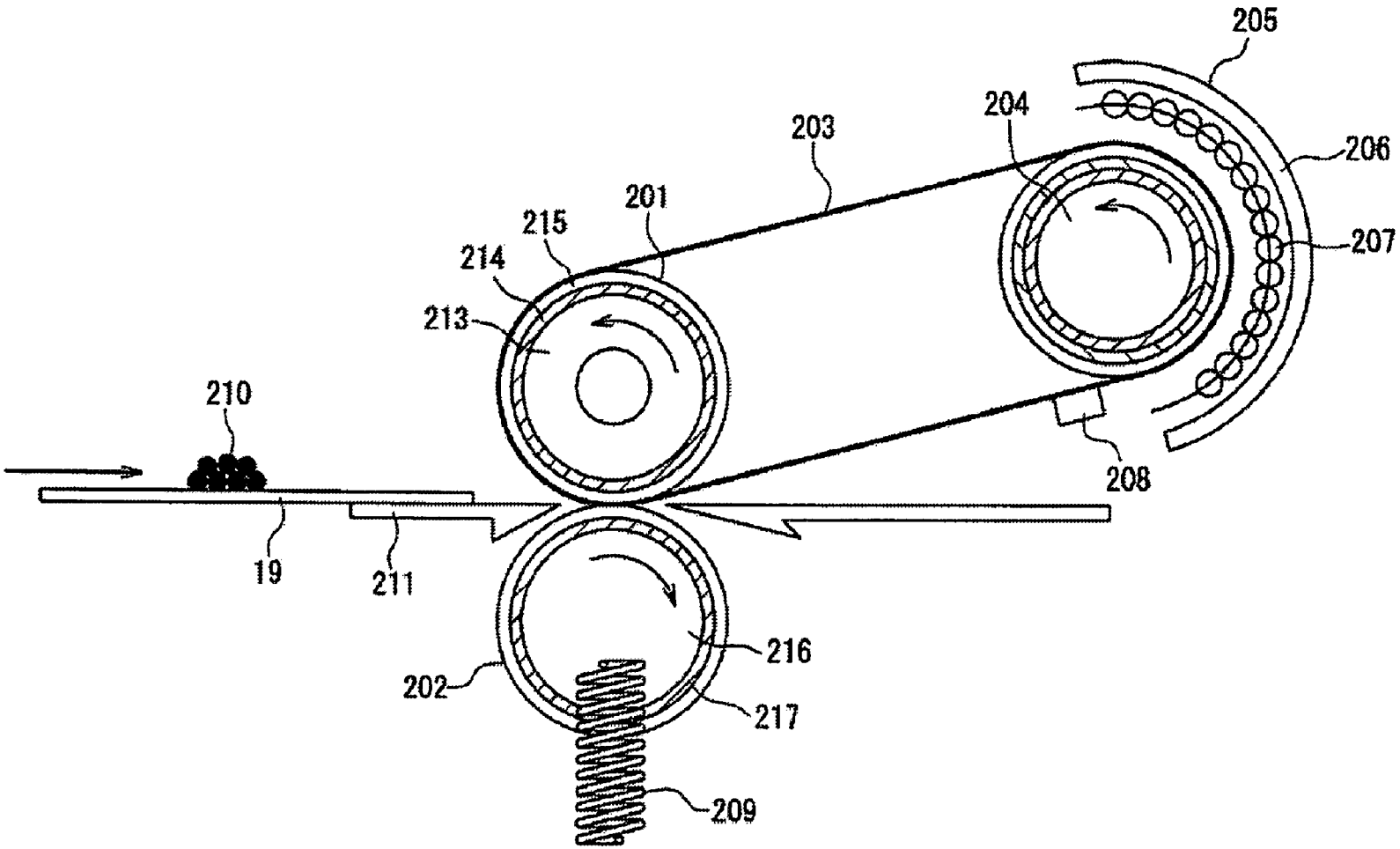
FIG. 9 is a detailed view of the location B in FIG. 8

FIG. 8 is a cross-sectional view along the I-I line in FIG. 7. FIG. 9 is a detail view of the location B in FIG. 8. s1 is the width of the protrusions of the surface jagged component 507 of the stator 502, s2 is the distance between the protrusions of the surface jagged component 507 of the stator 502, s3 is the height of the protrusions of the surface jagged component 507 of the stator 502, r1 is the width of the protrusions of the surface jagged component 506 of the rotor 501, r2 is the distance between the protrusions of the surface jagged component 506 of the rotor 501, and r3 is the height of the protrusions of the surface jagged component 506 of the rotor 501. The rotor rotates at a high speed, and in order for the toner to be pulverized efficiently into a spherical shape of small particle size while silica or another inorganic micropowder is being supplied, the configuration can be such that the density of the surface jagged component 507 of the stator 502 is higher than the density of the jagged component 506 of the rotor 501. It is preferable for the configuration to be such that there is at least one protrusion (and even more preferably, 2.5) per centimeter of peripheral length. It is also preferable if the relationships $0.2 \leqq s1/r1 \leqq 0.7$ and $0.2 \leqq s2/r2 \leqq 0.7$ are satisfied. In particular, as the powder is being pulverized while an inorganic micropowder is supplied, since the powder to be pulverized is introduced in a uniformly dispersed state, the density must be raised in order to stabilize the collisions with the wall face of the stator. Below 0.2, costs tend to be higher in surface processing, but over 0.7, the eddy flow tends to be uneven and it is difficult to pulverize the powder to a small particle size.

(10) Polymerization Method

Emulsion polymerization, suspension polymerization, or the like can be used preferably as the method for producing a toner of small particle size. With emulsion polymerization, a resin microparticle solution containing an ionic surfactant is prepared, this is mixed with a colorant particle dispersion and a wax release agent particle dispersion, and this mixture is agglomerated with an ionic surfactant having the opposite polarity from that of the above-mentioned ionic surfactant, thereby forming toner-based agglomerated particles, after which these are heated to a temperature over the glass transition point of the resin microparticles so as to fuse the agglomerated particles, and this product is washed and dried to produce a toner. Examples of the surfactant used here include anionic surfactants based on a sulfate, sulfonate, phosphate, or soap, and cationic surfactants such as amine salt types and quaternary ammonium salt types. The concurrent use of a nonionic surfactant, such as one based on polyethylene glycol, an alkylphenol ethylene oxide adduct, or a polyhydric alcohol, is also effective. The means for dispersing these can be a rotary shear type of homogenizer, or a dynomill, sand mill, or ball mill having media, or any other such standard means.

After the particles have been produced, the desired toner can be obtained through a washing step, solid-liquid separation step, and drying step as needed, but in order to achieve and maintain chargeability, the washing step preferably is carried out by sufficient replacement washing with ion exchanged water. There are no particular restrictions on the solid-liquid separation step, but in terms of productivity, it is preferable to use absorption filtration, pressurized filtration, or the like. Nor are there any particular restrictions on the drying step, but in terms of productivity, it is preferable to use freeze drying, flash jet drying, flow drying, vibratory flow drying, or the like.

With suspension polymerization, a polymerizable monomer, wax, a colorant, and various other additives are uniformly dissolved or dispersed, heated, and uniformly dissolved or dispersed with a homogenizer, ultrasonic disperser, or the like to produce a monomer composition, after which this monomer system is dispersed with an ordinary stirrer, homomixer, homogenizer, or the like in an aqueous phase of the same temperature as the monomer system and containing a dispersion stabilizer.

Preferably, the stirring speed and duration are adjusted so that the monomer liquid drops will be the same size as the required size of the toner particles. After this, the particle state is maintained by the action of the dispersion stabilizer, and the system is stirred enough that the particles will not settle. The polymerization temperature is at least 40° C., and is generally set to between 50 and 80° C.

It is preferable here for the stirring speed to be at least 30 m/sec in order to highly disperse the fixing adjuvant and to obtain small toner particles that contain the fixing adjuvant and have a uniform size distribution.

Upon completion of the reaction, the toner particles thus produced are washed, recovered by filtration, and dried. In suspension polymerization, it is usually preferable to use water as a dispersion medium in an amount of 300 to 3000 parts by weight per 100 parts by weight of the monomer system.

All the dispersion media used here can be used by dispersing a suitable stabilizer in an aqueous phase, examples of which include organic compounds such as polyvinyl alcohol, gelatin, methyl cellulose, methyl hydroxypropyl cellulose, ethyl cellulose and carboxymethyl cellulose sodium salt, polyacrylic acid and salts thereof, and starch, and inorganic compounds such as tricalcium phosphate, magnesium phosphate, aluminum phosphate, zinc phosphate, calcium carbonate, magnesium carbonate, barium sulfate, calcium sulfate, aluminum hydroxide, magnesium hydroxide, calcium metasilicate, bentonite, silica, and alumina.

Of these dispersion stabilizers, when an inorganic compound is used, the inorganic compound may be produced in an aqueous medium in order to obtain finer particles. For example, in the case of calcium phosphate, a sodium phosphate aqueous solution may be mixed with a calcium chloride aqueous solution under high speed stirring.

Also, in order to achieve a fine dispersion of these stabilizers, a surfactant may be used in an amount of 0.001 to 0.1 parts by weight. The purpose of this is to promote the desired action of the above-mentioned dispersion stabilizer, and specific examples thereof include sodium dodecylbenzene sulfate, sodium tetradecyl sulfate, sodium pentadecyl sulfate, sodium octyl sulfate, sodium oleate, sodium laurate, potassium stearate, and calcium oleate. Azo and diazo polymerization initiators can be used as well, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

(11) Two-Component Development

An AC bias is applied along with a DC bias between the photosensitive member and the developing roller. The frequency here is from 5 to 10 kHz, the AC bias is from 1.0 to 2.5 kV (p-p), and the peripheral speed ratio between the photosensitive member and the developing roller is from 1:1.2 to 1:2. More preferably, the frequency here is from 5.5 to 8 kHz, the AC bias is from 1.2 to 2.0 kV (p-p), and the peripheral speed ratio between the photosensitive member and the developing roller is from 1:1.5 to 1:1.8.

Even more preferably, the frequency here is from 5.5 to 7 kHz, the AC bias is from 1.5 to 2.0 kV (p-p), and the peripheral speed ratio between the photosensitive member and the developing roller is from 1:1.6 to 1:1.8. When this developing process configuration and the toner of this embodiment are used, dots can be reproduced faithfully, and the developing gamma characteristic can be made flatter. Both high image quality and oil-less fixing can be achieved. Also, charge-up under low humidity can be prevented even with a high-resistance carrier, allowing high image density to be obtained even in continuous use. The reason for this is believed to be that the combined use of a toner that affords high chargeability, this carrier constitution, and an AC bias allows adhesive strength with the carrier to be reduced, the image density to be maintained, and fogging to be reduced, and also allows dots to be reproduced faithfully.

If the frequency is less lower 5 kHz, dot reproducibility tends to worsen, and halftone reproducibility also tends to worsen. If the frequency is higher than 10 kHz, it tends to be impossible to keep up in the developing region and no further effect tends to be realized. In this frequency region, in two-component development using a high-resistance carrier, the reciprocal action is at work more between the carrier and the toner than between the developing roller and the photosensitive member, having the effect of microscopically isolating the toner from the carrier, and this affords good dot reproducibility and halftone reproducibility, and also results in high image density.

If the AC bias is less than 1.0 kV (p-p), there tends to be no effect of suppressing charge-up, but fogging tends to increase if the AC bias is greater than 2.5 kV (p-p). If the peripheral speed ratio between the photosensitive member and the developing roller is less than 1:1.2 (that is, if the developing roller is slowed), it tends to be difficult to obtain good image density. If the peripheral speed ratio between the photosensitive member and the developing roller is greater than 1:2 (that is, if the developing roller speeds up), there tends to be more toner scattering.

(12) Tandem Color Process

In order to form a color image at a high speed, in this embodiment there are a plurality of toner image forming stations including a photosensitive member, charging means, and a toner support, the electrostatic latent image formed on the image support is visualized, a primary transfer process, in which the toner image produced by the visualization of the electrostatic latent image is transferred to an endless transfer member by bringing the transfer member into contact with the image support, is executed sequentially and continuously to form a multilayer transferred toner image on the transfer member, and then a secondary transfer process, in which the multilayer toner image formed on the transfer member is transferred all at once to a transfer medium such as paper or an OHP sheet, is executed. In this transfer process the transfer location is such that $d1/v \leqq 0.65$ (sec), when d1 (mm) is the distance from a first primary transfer position to a second primary transfer position, and v (mm/s) is the peripheral speed of the photosensitive member. This both makes the machine more compact and affords higher printing speed. As there has been a recent strong demand for the machine to be faster and smaller, in order to be capable of processing at least 16 sheets (A4) per minute, and to reduce the size of the machine to the point that it can be used in SOHO applications, it is essential that the toner image forming stations be spaced closely together and the process speed raised. A constitution in which the above-mentioned value is 0.65 or less is believed to be the minimum in order to achieve both this compact size and high printing speed. If the value is more than that, the machine becomes larger and the process speed seems to be slow.

However, when this constitution is employed, for example, after the first color of toner (yellow) has undergone primary transfer, the time before the second color of toner (magenta) undergoes primary transfer is extremely short, there is virtually no lessening of charge of the transfer member or lessening of charge of the transferred toner, and when the magenta toner is transferred over the yellow toner, the magenta toner is repelled by the charge action of the yellow toner, which decreases the transfer efficiency and causes partial transfer defects in characters. Furthermore, during the primary transfer of the third color of toner (cyan), the cyan toner is scattered in the course of being transferred over the yellow and magenta toner, resulting in pronounced partial transfer defects and other such defects during transfer. As this process is repeated, toner of a specific particle size is developed selectively, and there is a considerable difference in the fluidity of individual toner particles, they will have differing opportunities for friction charging, which creates variance in the amount of charge and leads to inferior transfer performance.

In view of this, adopting the toner and developer constitution of this embodiment results in the uniform dispersion of wax and other internal additives in the resin, and this stabilizes the charge distribution, suppresses excess charging of the toner, and suppresses fluidity fluctuations, so that a decrease in transfer efficiency and partial transfer defects of characters during transfer can be prevented without sacrificing fixing characteristics.

(13) Cleaner-less Process

This embodiment also can be applied preferably to an electrophotographic apparatus whose basic configuration is a cleaner-less process in which the subsequent charging, exposure, and developing processes are performed without first going through a cleaning process in which toner remaining on the photosensitive member after the transfer process is recovered by cleaning.

Using the toner of this embodiment suppresses agglomeration of the toner, prevents excessive charging, yields stable chargeability, and allows high transfer efficiency to be obtained. It also improves uniform dispersibility in the resin, affords good chargeability, and takes advantage of the good partability of the material, allowing any toner remaining on the non-image portions to be recovered well in development. Accordingly, there is no developing memory, in which the previous image pattern remains in the non-image portions.

(14) Oil-less Color Fixing

This embodiment also can be used preferably in an electrophotographic apparatus equipped with a fixing process designed for oil-less fixing, in which no oil is used in the means for fixing the toner. Electromagnetic inductive heating is preferable as the heating means here because it requires a shorter warm-up period and consumes less energy. A heating and pressing means is used here that has at least a magnetic field generation means, a rotary heating member comprising at least a parting layer and a heat generating layer that works by electromagnetic induction, and a rotary pressing member that forms a constant nip with the rotary heating member. Transfer paper or another such transfer medium onto which toner has been transferred is passed between the rotary heating member and the rotary pressing member to fix the toner. The rise time during warm-up to the temperature of the rotary heating member is much shorter than when a conventional halogen lamp is used. Accordingly, the transfer operation begins while the rotary pressing member has yet to be fully heated, so that low temperature fixing and a wide range of offset resistance are required.

A preferable constitution is to use a fixing belt that separates the heating member and fixing member. A heat-resistant belt such as a polyimide belt or a belt electrocast with nickel that is both heat resistant and deformable can be used preferably as this belt. A silicone rubber, fluororubber, or fluororesin can be used to improve partability.

In the fixing of these, up to now offset has been prevented by coating with a parting oil. If a toner that has partability without the use of an oil is used, then there is no need to coat with a parting oil. However, charging tends to occur if there is no coating with a parting oil, and when an unfixed toner image draws near to the heating member or fixing member, the effect of this charging sometimes causes the toner to scatter. This is particularly likely to occur under low temperature and humidity.

By using the toner of this embodiment, however, a low temperature fixing and a wide range of offset resistance can be realized without having to use an oil, and color high optical transmissivity can be obtained. This also suppresses excessive charging of the toner, and suppresses toner scattering caused by the charge effect with the heating member or fixing member.

WORKING EXAMPLES

The present invention now will be described in further detail through working examples, but the present invention is not limited to or by these examples.

Carrier Manufacturing Example 1

39.7 mol % MnO, 9.9 mol % MgO, 49.6 mol % $Fe_2O_3$, and 0.8 mol % SrO were pulverized for 10 hours in a wet ball mill, then mixed and dried, after which this mixture was pre-baked by being held at 950° C. for 4 hours. This product was pulverized in the wet ball mill for 24 hours, then granulated with a spray dryer, dried, and baked by being held at 1270° C. for 6 hours in an electric furnace in an atmosphere of 2% oxygen concentration. This product was then cracked and graded, which gave a core material made of ferrite particles whose average particle size was 50 μm and in which the saturation magnetization was 65 emu/g when a magnetic field of 3000 oersted was applied.

Next, 250 g of a polyorganosiloxane including 15.4 mol % $(CH_3)_2SiO$ units expressed by Chemical Formula 6 below and 84.6 mol % $CH_3SiO_{3/2}$ units expressed by Chemical Formula 7 were reacted with 21 g of $CF_3CH_2CH_2Si(OCH_3)_3$, which gave a fluorine-modified silicone resin. This was a demethoxylation reaction by which an organosilicon compound molecule containing a perfluoro alkyl group was introduced into the polyorganosiloxane. In addition, 100 g (calculated as solids) of this fluorine-modified silicone resin and 10 g of an aminosilane coupling agent (gamma-aminopropyltriethoxysilane) were weighed out and dissolved in 300 mL of toluene solvent.

(Chemical Formula 6)

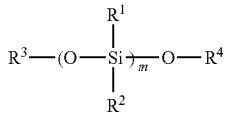

where $R^1$, $R^2$, $R^3$, and $R^4$ are each a methyl group, and m is 100, representing the average degree of polymerization.

(Chemical Formula 7)

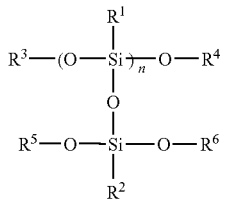

where $R^1$, $R^2$, $R^3$, $R^4$, $R^5$, and $R^6$ are each a methyl group, and n is 80, representing the average degree of polymerization.

Subsequently, 10 kg of the above-described ferrite particles were coated by stirring them in the above-described coating resin solution for 20 minutes using an immersion dry coating equipment. Subsequently, the obtained material was baked at 260° C. for 1 hour, and carrier A1 was obtained.

Carrier Manufacturing Example 2

A core material was manufactured and coated by the same process as in Carrier Manufacturing Example 1, except that the $CF_3CH_2CH_2Si(OCH_3)_3$ was changed to $C_8F_{17}CH_2CH_2Si(OCH_3)_3$, which gave a carrier A2.

Carrier Manufacturing Example 3

A core material was manufactured and coated by the same process as in Carrier Manufacturing Example 1, except that conductive carbon (EC, made by Ketjenblack International) was dispersed at a ratio of 5 wt % with respect to the resin solids by using a ball mill, which gave a carrier A3.

Carrier Manufacturing Example 4

A core material was manufactured and coated by the same process as in Carrier Manufacturing Example 3, except that the added amount of aminosilane coupling agent was changed to 30 g, which gave a carrier A4.

Carrier Manufacturing Example 5

A core material was manufactured and coated by the same process as in Carrier Manufacturing Example 3, except that the added amount of aminosilane coupling agent was changed to 50 g, which gave a carrier b1.

Carrier Manufacturing Example 6

A core material was manufactured and coated by the same process as in Carrier Manufacturing Example 1, except that the coating resin was changed to straight silicone (SR-2411, made by Dow Corning Toray Silicone), which gave a carrier b2.

Carrier Manufacturing Example 7

A core material was manufactured and coated by the same process as in Carrier Manufacturing Example 3, except that the coating resin was changed to a copolymer of perfluorooctylethyl acrylate and methacrylate, which gave a carrier b3.

Carrier Manufacturing Example 8

A core material was manufactured and coated by the same process as in Carrier Manufacturing Example 3, except that the coating resin was changed to an acrylic-modified silicone resin (KR-9706, made by Shin-Etsu Chemical), which gave a carrier b4.

Table 1 shows characteristics of the binder resin of the toner used in this working example. The resins were a polyester resin whose main component was a bisphenol A propyl oxide adduct, terephthalic acid, trimellitic acid, succinic acid, or fumaric acid, and whose thermal characteristics were varied by means of the polymerization conditions and the mix proportion. This constitution combining a dihydric alcohol with a dicarboxylic acid or tricarboxylic acid is preferable for achieving good fixability, dispersibility, carrier toner-spent resistance, and pulverization.

TABLE 1

| resin | PES-1 | PES-2 | PES-3 | PES-4 | PES-5 | PES-6 | pes-7 |
|---|---|---|---|---|---|---|---|
| Mnf ($\times 10^4$) | 0.32 | 0.52 | 0.57 | 0.59 | 0.32 | 0.32 | 0.23 |
| Mwf ($\times 10^4$) | 2.10 | 4.40 | 5.60 | 5.91 | 6.40 | 10.20 | 1.40 |
| Mzf ($\times 10^4$) | 26.50 | 31.00 | 31.50 | 40.50 | 97.50 | 302.50 | 7.40 |
| Wmf = Mwf/Mnf | 6.56 | 8.46 | 9.82 | 10.02 | 20.00 | 31.88 | 6.09 |
| Wzf = Mzf/Mnf | 82.81 | 59.62 | 55.26 | 68.64 | 304.69 | 945.31 | 32.17 |
| Mpf ($\times 10^4$) | 0.62 | 0.74 | 0.88 | 1.02 | 1.8 | 2.2 | 0.5 |
| Tg (° C.) | 57.3 | 57.3 | 55.0 | 55.5 | 58.0 | 61.0 | 54.0 |
| Tm (° C.) | 107.5 | 110.8 | 113.0 | 116.0 | 121.0 | 125.0 | 100.0 |
| Tfb (° C.) | 96.2 | 97.5 | 98.5 | 99.2 | 105.6 | 107.8 | 85.0 |
| AV (mgKOH/g) | 18 | 15 | 28 | 25 | 15 | 20 | 2 |

Mnf is the number average molecular weight of the binder resin,
Mwf is the weight average molecular weight of the binder resin,
Mzf is the Z average molecular weight of the binder resin,
Wmf is the ratio Mwf/Mnf between the average molecular weight Mwf and the number average molecular weight Wnf,
Wzf is the ratio Mzf/Mnf between the Z average molecular weight Mzf and the number average molecular weight Mnf of the binder resin,
Mpf is the peak molecular weight,
$T_g$ (° C.) is the glass transition point,
$T_m$ (° C.) is the softening point,
Tfb (° C.) is the flow beginning temperature, and
AV (mgKOH/g) is the resin acid value.

Tables 2, 3, and 4 below list the waxes used in this working example, and the properties thereof. Tw (° C.) is the melting point as measured by DSC, Ct (%) is the volumetric increase (%) at the melting point+10° C., Ck (wt %) is the heating loss at 220° C., Mnr is the number average molecular weight of the wax, Mwr is the weight average molecular weight of the wax, Mzr is the Z average molecular weight of the wax, and "peak" is the peak value of the molecular weight.

TABLE 2

| wax | material | melting point Tw (° C.) | volumetric increase Ct (%) | heating loss Ck (wt %) | iodine value | saponification value |
|---|---|---|---|---|---|---|
| WA-1 | extremely hydrogenated jojoba oil | 68 | 18.5 | 2.8 | 2 | 95.7 |
| WA-2 | carnauba wax | 83 | 15.3 | 4.1 | 10 | 80 |
| WA-3 | extremely hydrogenated meadowfoam oil | 71 | 3 | 2.5 | 2 | 90 |
| WA-4 | jojoba oil fatty acid pentaerythritol monoester | 120 | 3.5 | 3.4 | 2 | 120 |
| WA-5 | oleic acid amide | 78 | | 0.8 | | |
| WA-6 | ethylene-bis-erucic acid amide | 105 | | 1.2 | | |
| WA-7 | neopentyl polyol fatty acid ester | 110 | | 2.2 | 0.2 | 150 |
| WA-8 | pentaerythritol tetrastearate | 125 | | 0.9 | 0.1 | 180 |

(Note)
The unit for iodine value is iodine g/100 g, and the unit for saponification value is mgKOH/g.

TABLE 3

| | | melting point Tw (° C.) | acid value | penetration |
|---|---|---|---|---|
| WA-9 | ethylene/maleic anhydride/$C_{30}$ terminal alcohol-type wax/tert-butyl peroxyisopropyl monocarbonate: 100/20/8/4 parts by weight | 98 | 45 | 1 |
| WA-10 | propylene/maleic anhydride/ 1-octanol/dicumyl peroxide: 100/15/8/4 parts by weight | 120 | 58 | 1 |

TABLE 4

| | Mnr | Mwr | Mzr | Mwr/Mnr | Mzr/Mnr | peak |
|---|---|---|---|---|---|---|
| WA-1 | 1009 | 1072 | 1118 | 1.06 | 1.11 | $1.02 \times 10^3$ |
| WA-2 | 1100 | 1198 | 1290 | 1.09 | 1.17 | $1.2 \times 10^3$ |
| WA-3 | 1015 | 1078 | 1124 | 1.06 | 1.11 | $1.03 \times 10^3$ |
| WA-4 | 1500 | 2048 | 3005 | 1.37 | 2.00 | $3.2 \times 10^3$ |
| WA-5 | 1000 | 1050 | 1200 | 1.05 | 1.20 | $1.8 \times 10^3$ |
| WA-6 | 1002 | 1100 | 1350 | 1.10 | 1.35 | $1.9 \times 10^3$ |
| WA-7 | 1050 | 1205 | 1400 | 1.15 | 1.33 | $2.1 \times 10^3$ |
| WA-8 | 1100 | 1980 | 3050 | 1.80 | 2.77 | $3.5 \times 10^3$ |
| WA-9 | 1400 | 2030 | 2810 | 1.45 | 2.01 | $2.1 \times 10^3$ |
| WA-10 | 1400 | 3250 | 5200 | 2.32 | 3.71 | $3.1 \times 10^3$ |

Table 5 lists the pigments used in this working example.

TABLE 5

| material No. | composition |
|---|---|
| CM | magenta pigment:Pigment Red 57:1 |
| CC | cyan pigment:Pigment Blue 15:3 |
| CY | yellow pigment:Pigment Yellow 180 |
| BK | Carbon Black MA 100S (made by Mitsubishi Chemical) |

Table 6 lists the charge control agents used in this working example.

TABLE 6

| material No. | composition | material |
|---|---|---|
| CA1 | Cr metal salt of salicylic acid derivative | E-81 (made by Orient Chemical) |
| CA2 | K metal salt of benzylic acid derivative | LR-147 (made by Japan Carlit) |

Table 7 lists the additives used in this working example.

TABLE 7

| Inorganic micropowder | progenitor | process material A | process material B | particle size (nm) | methanol titration (%) | moisture adsorption amount (wt %) | ignition loss (wt %) | drying loss (wt %) | 5 min. value (μC/g) | 30 min. value (μC/g) | 5 min. value/ 30 min. value |
|---|---|---|---|---|---|---|---|---|---|---|---|
| S1 | silica | silica treated with dimethylpolysiloxane | | 6 | 88 | 0.1 | 10.5 | 0.2 | −820 | −710 | 86.59 |
| S2 | silica | silica treated with dimethylpolysiloxane | | 16 | 88 | 0.1 | 8.5 | 0.2 | −720 | −520 | 72.22 |
| S3 | silica | silica treated with methylhydrogen polysiloxane | | 16 | 88 | 0.1 | 5.5 | 0.2 | −560 | −450 | 80.36 |
| S4 | silica | dimethylpolysiloxane (20) | zinc octanoate (1) | 40 | 84 | 0.09 | 24.5 | 0.2 | −740 | −580 | 78.38 |

TABLE 7-continued

| Inorganic micropowder | progenitor | process material A | process material B | particle size (nm) | methanol titration (%) | moisture adsorption amount (wt %) | ignition loss (wt %) | drying loss (wt %) | 5 min. value (μC/g) | 30 min. value (μC/g) | 5 min. value/ 30 min. value |
|---|---|---|---|---|---|---|---|---|---|---|---|
| S5 | silica | methyl hydrogen polysiloxane (1) | aluminum distearate (2) | 40 | 88 | 0.1 | 10.8 | 0.2 | −580 | −480 | 82.76 |
| S6 | silica | dimethylpolysiloxane (2) | stearic acid amide (1) | 80 | 88 | 0.12 | 15.8 | 0.2 | −620 | −475 | 76.61 |
| S7 | silica | methyl hydrogen polysiloxane (1) | fatty acid pentaerythritol monoester (1) | 120 | 89 | 0.10 | 6.8 | 0.2 | −580 | −480 | 82.76 |
| S8 | titanium oxide | diphenylpolysiloxane (10) | stearic acid Na(1) | 80 | 88 | 0.1 | 18.5 | 0.2 | −750 | −650 | 86.67 |
| S9 | barium titanate | phenyl hydrogen polysiloxane (15) | palmitic acid Ca(1) | 200 | 85 | 0.09 | 5.5 | 0.2 | −690 | −540 | 78.26 |
| S10 | silica | silica treated with hexamethyldisilazane | | 16 | 68 | 0.60 | 1.6 | 0.2 | −800 | −620 | 77.50 |

The charge amounts (μC/g) were measured by a friction charging blow-off method with a non-coated ferrite carrier. 50 g of carrier and 0.1 g of silica or the like were mixed in a 100 mL polyethylene vessel under an atmosphere of 25° C. and 45% RH, the contents were stirred for 5 and 30 minutes by vertical rotation at a speed of 100 $min^{-1}$, after which 0.3 g was sampled and blown for 1 minute with nitrogen gas at $1.96\times10^4$ Pa.

With negative chargeability, it is preferable for the 5 minute value to be from −100 to −900 μC/g, and for the 30 minute value to be from −50 to −700 μC/g. Silica having a high charge amount can exhibit its function only with a small added amount. It is preferable to use silica that maintains the amount of charge at the 30 minute value at a level of at least 40% of the amount of charge at the 5 minute value. If the proportional decrease is large, there is considerable change in the amount of charge during long-term continuous use, and a consistent image cannot be maintained.

With positive chargeability, it is preferable for the 5 minute value (after 5 minutes of stirring) to be from +100 to +900 μC/g, and for the 30 minute value (after 30 minutes of stirring) to be from +50 to +500 μC/g. It is preferable to use silica that maintains the amount of charge at the 30 minute value at a level of at least 40% of the amount of charge at the 5 minute value. If the proportional decrease is large, there is considerable change in the amount of charge during long-term continuous use, and a consistent image cannot be maintained.

The kneading conditions in this working example are shown in Table 8.

TABLE 8

| kneading conditions | Trj1 (° C.) | Trk1 (° C.) | Tr2 (° C.) | Rw1 ($min^{-1}$) | Rw2 ($min^{-1}$) | Rw1/ Rw2 | Dr1 (A) | Dr2 (A) | Dr1/Dr2 |
|---|---|---|---|---|---|---|---|---|---|
| Q-1 | 131 | 61 | 20 | 95.0 | 80.0 | 1.2 | 29.2 | 12.1 | 2.4 |
| Q-2 | 152 | 40 | 6 | 95.0 | 65.0 | 1.5 | 31.0 | 16.5 | 1.9 |
| Q-3 | 118 | 55 | 20 | 75.0 | 65.0 | 1.2 | 25.2 | 12.5 | 2.0 |
| q-4 | 100 | 100 | 20 | 60.0 | 60.0 | 1.0 | 19.0 | 19.0 | 1.0 |

Trji (° C.) is the heating temperature at the front half of the roll (RL1),
Trk1 (° C.) is the heating temperature at the rear half of the roll (RL1),
Tr2 (° C.) is the heating or cooling temperature and both the front and rear portions of the roll (RL2),
Rw1 is the rotational speed of the roll (RL1),
Rw2 is the rotational speed of the roll (RL2),
Dr1 is the load current value during rotation of the roll (RL1), and
Dr2 is the load current value during rotation of the roll (RL2).
The amount of raw material introduced was 15 kg/h, the diameter of the rolls RL1 and RL2 was 140 mm, and their length was 800 mm.

Tables 9 and 10 list the pulverization conditions in this working example.

TABLE 9

| | gap between rotor and stator | rotor peripheral speed | supply amount of toner to be pulverized | cooling air temperature | discharge section temp. |
|---|---|---|---|---|---|
| KM1 | 1.5 mm | 130 m/s | 5 kg/h | 0° C. | 45° C. |
| KM2 | 1 mm | 120 m/s | 5 kg/h | 0° C. | 40° C. |

TABLE 10

| | supplied inorganic micropowder | supply amount of toner to be pulverized | | |
|---|---|---|---|---|
| KS1 | S1 | 0.48 kg/h | | |
| KS2 | S2 | 0.12 kg/h | | |
| KS3 | S4 | 0.09 kg/h | | |
| KS4 | S6 | 0.02 kg/h | vibrator | |
| KS5 | S8 | 0.09 kg/h | vibrator | |
| KS6 | S10 | 0.02 kg/h | | |
| KS7 | | | vibrator | |
| KS8 | | | | ethanol spraying |

In this working example, pulverization condition KM1 is such that gap between rotor and stator: 1.5 mm, rotor peripheral speed: 130 m/s, supplied amount of toner to be pulverized: 5 kg/h, cooling air temperature: 0° C., and discharge section temperature: 45° C. Pulverization condition KM2 is such that gap between rotor and stator: 1 mm, rotor peripheral speed: 120 m/s, supplied amount of toner to be pulverized: 5 kg/h, cooling air temperature: 0° C., and discharge section temperature: 40° C. s1 was 1 mm, s2 was 4 mm, s3 was 3 mm, r1 was 4 mm, r2 was 7 mm, r3 was 3 mm, and the circumference of the stator was 57 cm. This table shows the inorganic micropowder supplied before being pulverized, its supplied amount, whether or not the inorganic micropowder was subjected to vibration with a vibrator, and whether or not the spray treatment was performed.

Table 11 shows the composition and properties of the toners used in this working example.

TABLE 11

| toner | resin | charge control agent | pigment | Wax 1 | Wax 2 | Additive A | Additive B | pulverization conditions 1 | pulverization conditions 2 | kneading conditions |
|---|---|---|---|---|---|---|---|---|---|---|
| TM1 | PES-1 | CA1(3) | CM(5) | WA1(18) | | S1(0.5) | S4(2.5) | KM1 | KS1 | Q-1 |
| TM2 | PES-2 | CA2(2.5) | CM(5) | WA2(16) | | S2(1.5) | S5(3.5) | KM2 | KS2 | Q-2 |
| TM3 | PES-3 | CA1(2) + CA3(1.5) | CM(5) | WA3(12) | | S3(2.0) | S6(2.5) | KM1 | KS3 | Q-3 |
| TM4 | PES-4 | CA2(3) + CA4(2) | CM(5) | WA4(8) | | S1(0.5) | S7(2.0) | KM2 | KS6 | Q-1 |
| TM5 | PES-5 | CA1(1.5) + CA3(2) | CM(5) | WA1(5) | WA5 (3) | S2(1.5) | S8(3.5) | KM1 | KS7 | Q-2 |
| TM6 | PES-6 | CA2(3) + CA4(2) | CM(5) | WA2(6) | WA6 (2) | S3(2.0) | S9(3.5) | KM2 | KS8 | Q-3 |
| Tm7 | pes-7 | CA4(1) | CM(5) | PPWAX (4) | | S10(1.5) | | km3 | | q-4 |
| TY1 | PES-1 | CA1(3) | CY(5) | WA9(12) | | S1(0.5) | S4(2.5) | KM1 | KS1 | Q-1 |
| TY2 | PES-2 | CA2(2.5) | CY(5) | WA10 (16) | | S2(1.5) | S5(3.5) | KM2 | KS3 | Q-2 |
| TY3 | PES-3 | CA1(2) + CA3(1.5) | CY(5) | WA1(17) | | S3(2.0) | S6(2.5) | KM1 | KS4 | Q-3 |
| TY4 | PES-4 | CA2(3) + CA4(2) | CY(5) | WA5(18) | | S1(0.5) | S7(2.0) | KM2 | KS5 | Q-1 |
| TY5 | PES-5 | CA1(1.5) + CA3(2) | CY(5) | WA2(5) | WA7 (3) | S2(1.5) | S8(3.5) | KM1 | KS7 | Q-2 |
| TY6 | PES-6 | CA2(3) + CA4(2) | CY(5) | WA3(6) | WA8 (2) | S3(2.0) | S9(3.5) | KM2 | KS8 | Q-3 |
| Ty7 | pes-7 | CA4(1) | CY(5) | PPWAX (4) | | S10(1.5) | | km3 | | q-4 |
| TC1 | PES-1 | CA1(3) | CC(5) | WA9(18) | | S1(0.5) | S4(2.5) | KM1 | KS1 | Q-1 |
| TC2 | PES-2 | CA2(2.5) | CC(5) | WA10 (16) | | S2(1.5) | S5(3.5) | KM2 | KS2 | Q-2 |
| TC3 | PES-3 | CA1(2) + CA3(1.5) | CC(5) | WA2(14) | | S3(2.0) | S6(2.5) | KM1 | KS3 | Q-3 |
| TC4 | PES-4 | CA2(3) + CA4(2) | CC(5) | WA7(12) | | S1(0.5) | S7(2.0) | KM2 | KS4 | Q-1 |
| TC5 | PES-5 | CA1(1.5) + CA3(2) | CC(5) | WA3(5) | WA4 (3) | S2(1.5) | S8(3.5) | KM1 | KS5 | Q-2 |
| TC6 | PES-6 | CA2(3) + CA4(2) | CC(5) | WA1(6) | WA5 (2) | S3(2.0) | S9(3.5) | KM2 | KS6 | Q-3 |
| Tc7 | pes-7 | CA4(1) | CC(5) | PPWAX (4) | | S10(1.5) | | km3 | | q-4 |
| TB1 | PES-1 | CA1(3) | BK(5) | WA1(18) | | S1(0.5) | S4(2.5) | KM1 | KS1 | Q-1 |
| TB2 | PES-2 | CA2(2.5) | BK(5) | WA2(16) | | S2(1.5) | S5(3.5) | KM2 | KS2 | Q-2 |
| TB3 | PES-3 | CA1(2) + CA3(1.5) | BK(5) | WA3(17) | | S3(2.0) | S6(2.5) | KM1 | KS4 | Q-3 |
| TB4 | PES-4 | CA2(3) + CA4(2) | BK(5) | WA8(18) | | S1(0.5) | S7(2.0) | KM2 | KS5 | Q-1 |
| TB5 | PES-5 | CA1(1.5) + CA3(2) | BK(5) | WA9(5) | WA6 (3) | S2(1.5) | S8(3.5) | KM1 | KS6 | Q-2 |
| TB6 | PES-6 | CA2(3) + CA4(2) | BK(5) | WA10(6) | WA7 (2) | S3(2.0) | S9(3.5) | KM2 | KS7 | Q-3 |
| Tb7 | pes-7 | CA4(1) | BK(5) | PPWAX (4) | | S10(1.5) | | km3 | | q-4 |

The blend ratios (in parts by weight) for the pigment, the charge control agent, and the wax per 100 parts by weight of binder resin are given in parentheses in Table 11. The blend amounts (in parts by weight) for the additives are indicated per 100 parts by weight of toner matrix. The external addition was performed with an FM20B, using a model Z0S0 agitator blade at a rotational speed of 2000 $min^{-1}$, for a treatment time of 5 minutes, and at an added amount of 1 kg.

FIG. 1 is a cross-sectional view of the structure of an image formation apparatus for full-color image formation used in this working example. FIG. 1 shows a color electrophotographic printer, with its outer housing removed. A transfer belt unit 17 comprises a transfer belt 12, a first color (yellow) transfer roller 10Y, a second color (magenta) transfer roller 10M, a third color (cyan) transfer roller 10C, a fourth color (black) transfer roller 10K (these rollers are all made from elastic materials), a drive roller 11 made from aluminum, a second transfer roller 14 made from an elastic material, a second transfer driven roller 13, a belt cleaner blade 16 for cleaning away toner remaining on the transfer belt 12, and a roller 15 located across from the cleaner blade.

The distance from the first color (Y) transfer position to the second color (M) transfer position is 70 mm (this is the same distance from the second color (M) transfer position to the third color (C) transfer position, and from the third color (C) transfer position to the fourth color (K) transfer position), and the peripheral speed of the photosensitive member is 125 mm/s. The transfer belt 12 is produced by kneading a conductive filler into an insulating polycarbonate resin, and extruding this mixture in the form of a film. In this working example, the mixture was produced by adding 5 parts by weight conductive carbon (such as ketjen black) to 95 parts by weight polycarbonate resin (such as Iupilon Z300, made by Mitsubishi Gas Chemical) and then forming a film from this mixture. The surface was coated with a fluororesin, the thickness of the film was approximately 100 μm, the volumetric resistance was from $10^7$ to $10^{12}$ Ω·cm, and the surface resistance was from $10^7$ to $10^{12}$ ohms per square. The purpose of this was to enhance dot reproducibility, and to effectively prevent the accumulation of charge and slackness in the transfer belt 12 over extended use. The reason for coating the surface with a fluororesin was to effectively prevent toner filming on the surface of the transfer belt over extended use. Retransfer tends to occur if the volumetric resistance is less than $10^7$ Ω·cm, but transfer efficiency tends to drop if the volumetric resistance is greater than $10^{12}$ Ω·cm.

The first transfer roller is a carbon conductive foamed urethane roller with an outside diameter of 10 mm and a resistance of $10^2$ to $10^6$ Ω. During the first transfer operation, the first transfer roller 10 is pressed against a photosensitive member 1 via the transfer belt 12 at a pressing force of 1.0 to 9.8 N, and the toner on the photosensitive member is transferred onto the belt. Retransfer tends to occur if the resistance is less than $10^2$ Ω, but transfer defects tend to occur if $10^6$ Ω is exceeded. Transfer defects also tend to occur if the pressing force is under 1.0 N, but partial transfer defects tend to occur over 9.8 N.

The second transfer roller 14 is a carbon conductive foamed urethane roller with an outside diameter of 15 mm and a resistance of $10^2$ to $10^6$ Ω. The second transfer roller 14 is pressed against the transfer roller 13 via the transfer belt 12 and a transfer medium 19, such as a paper or an OHP sheet. This transfer roller 13 is designed to be rotationally driven by the transfer belt 12. In the second transfer, the second transfer roller 14 and the opposing transfer roller 13 are pressed together at a pressing force of 5.0 to 21.8 N, and the toner is transferred from the transfer belt onto a recording material 19 such as paper. Retransfer tends to occur if the resistance is less than $10^2$ Ω, but transfer defects tend to occur if $10^6$ Ω is exceeded. Transfer defects also tend to occur if the pressing force is under 5.0 N, but the load will be too high and jitter tends to occur over 21.8 N.

Four image formation units 18Y, 18M, 18C, and 18K for the various colors (yellow (Y), magenta (M), cyan (C), and black (B)) are disposed in a row as shown in the drawing.

Aside from the developers contained therein, the image formation units 18Y, 18M, 18C, and 18K all have the same constituent members, so that for the sake of simplicity, only the image formation unit 18Y used for yellow will be described, and not the other units.

The image formation unit is constituted as follows. 1 is a photosensitive member, 3 is a pixel laser signal light, 4 is a developing roller that is made of aluminum, has an outside diameter of 12 mm, and has a magnet with a magnetic force of 1200 gauss. This developing roller is located across from the photosensitive member at a gap of 0.3 mm, and rotates in the direction indicated by the arrow. 6 is an agitation roller, which agitates the carrier and the toner inside the developing unit and supplies them to the developing roller. The carrier and toner blend ratio is read by magnetic permeability sensor (not shown), and material is supplied as needed from a toner hopper (not shown). 5 is a magnetic blade made of metal, which restricts the magnetic brush layer of the developer on the developing roller. The amount of developer introduced is 150 g. The gap was set at 0.4 mm. Although not depicted, the power supply applied to the developing roller 4 was −500V DC current and 1.5V (p-p) AC current with a frequency of 6 kHz. The peripheral speed ratio between the photosensitive member and the developing roller was set at 1:1.6. The toner and carrier were mixed in a ratio of 93:7, and the amount of developer in the developing unit was 150 g.

2 is a charging roller made of epichlorohydrin rubber and having an outside diameter of 12 mm, to which is applied a DC bias of −1.2 kV. This roller charges the surface of the photosensitive member 1 to −600V. 8 is a cleaner, 9 is a waste toner box, and 7 is a developer.

The paper conveyance path is formed so that paper 19 is conveyed from beneath the transfer unit 17, and the paper 19 is sent by a paper conveyance roller (not shown) into a nip where the transfer belt 12 and the second transfer roller 14 are pressed together.

The toner on the transfer belt 12 is transferred on the paper 19 by the +1000V voltage applied to the second transfer roller 14, and is fixed after being conveyed to a fixing section made up of a fixing roller 201, a press roller 202, a fixing belt 203, a heating medium roller 204, and an induction heater 205.

Figure 2:
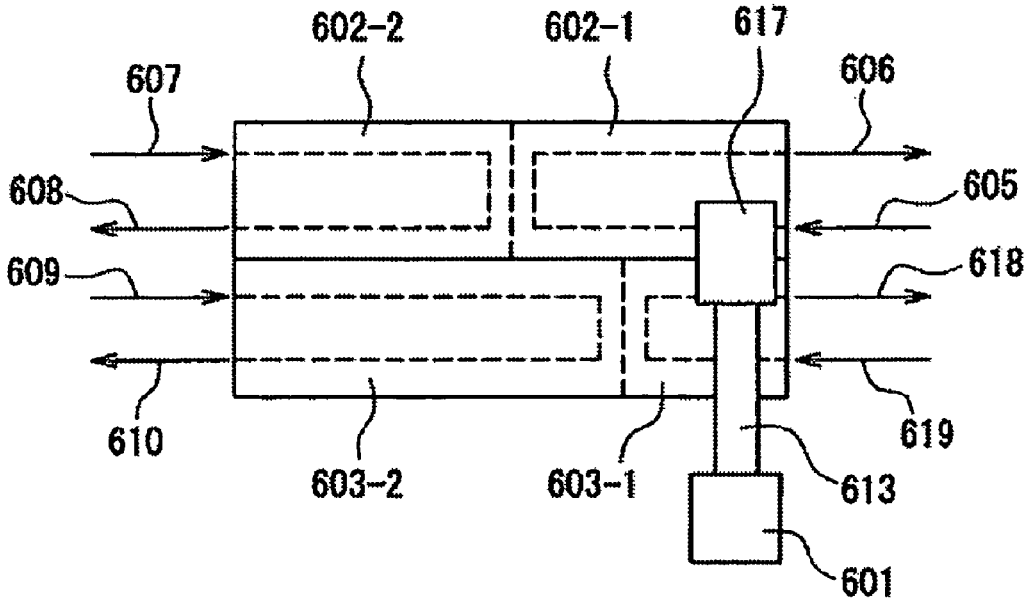
FIG. 2 is a cross-sectional view showing the configuration of a fixing unit used in a working example of the present invention.

FIG. 2 illustrates this fixing process. The belt 203 is stretched around the fixing roller 201 and the heat roller 204. A specific weight is applied between the fixing roller 201 and the press roller 202, forming a nip between the belt 203 and the press roller 202. The induction heater 205, which comprises a ferrite core 206 and a coil 207, is provided on the outer peripheral surface of the heat roller 204, and a temperature sensor 208 is disposed on the outside.

The belt has a 30 μm nickel belt as a base material, over which is provided a silicone rubber layer of 150 μm, and over this a PFA tube of 30 μm. The press roller 202 is pressed against the fixing roller 201 by a pressing spring 209. The recording material 19 with a toner 210 moves along a guide plate 211. The fixing roller 201 (which serves as the fixing member) comprises an elastic layer 214 having a thickness of 3 mm and composed of silicone rubber with a rubber hardness (according to JIS-A) of 20, provided over the surface of a hollow aluminum roller core 213 with a length of 250 mm, an outside diameter of 14 mm, and a thickness of 1 mm. A silicone rubber layer 215 is formed over this in a thickness of 3 mm, giving an outside diameter of approximately 20 mm. The roller is rotated at 125 mm/s by drive force from a drive motor (not shown). The heat roller 204 has a hollow pipe with an outside diameter of 20 mm and a wall thickness of 1 mm. The fixing belt surface temperature was held at 170° C. with a thermistor. The press roller 202 serving as the pressing member has a length of 250 mm and an outside diameter of 20 mm. This roller comprises an elastic layer 217 having a thickness of 2 mm and composed of silicone rubber with a rubber hardness (according to JIS-A) of 55, provided over the surface of a hollow aluminum roller core 216 with an outside diameter of 16 mm and a thickness of 1 mm. This press roller 202 is rotatably disposed, and forms a nip width of 5.0 mm with the fixing roller 201 when biased by a spring 209 with a spring weight on one side of 147 N.

The operation will now be described. In full-color mode, the first transfer rollers 10Y, 10M, 10C, and 10K are all pushed up so as to press against the photosensitive member 1 of the image formation units via the transfer belt 12. At this point a DC bias of +800V is applied to the first transfer rollers. Image signals are sent by laser beams 3 and are incident on the photosensitive members 1 whose surfaces have been charged by the charging rollers 2, forming electrostatic latent images. The toner on the developing rollers 4 that rotate in contact with the photosensitive members 1 makes visible the electrostatic latent images formed on the photosensitive members 1.

The speed of image formation of the image formation unit 18Y (125 mm/s, which is equal to the peripheral speed of the photosensitive member) and the moving speed of the transfer belt 12 are set in such a manner that the photosensitive member speed is 0.5 to 1.5% slower than the transfer belt speed.

The result of the image formation step is that yellow signal light 3Y is inputted to the image formation unit 18Y, and an image is formed by yellow toner. Simultaneously with this image formation, the yellow toner image is transferred from the photosensitive member 1Y to the transfer belt 12 by the action of the first transfer roller 10Y A DC voltage of +800V was applied to the first transfer roller 10Y at this point.

Magenta signal light 3M is inputted to the image formation unit 18M at a specific timing between the first color (yellow) first transfer and second color (magenta) first transfer, an image is formed by magenta toner, and simultaneously with this image formation, the magenta toner image is transferred from the photosensitive member 1M to the transfer belt 12 by the action of the first transfer roller 10M. At this point the magenta toner is transferred over the first color (yellow) toner. Similarly, images are formed from cyan and black toner, and simultaneously with this image formation, a YMCK toner image is formed on the transfer belt 12 by the action of the first transfer rollers 10C and 10K. This is known as a tandem method.

A color image is formed by positionally aligning and superimposing four colors of toner image on the transfer belt 12. After the transfer of the last toner image (black), the four-color toner image is transferred all at once by the action of the second transfer roller 14 onto the paper 19 sent from a paper feed cassette (not shown) at a specific timing. The transfer roller 13 is grounded at this point, and a DC voltage of +1 kV is applied to the second transfer roller 14. The toner image transferred to the paper is fixed by the pair of fixing rollers 201 and 202. The paper then goes through a discharge roller pair (not shown) and is discharged to the outside of the apparatus. Any toner remaining untransferred on the intermediate transfer belt 12 is removed by the action of the cleaner blade 16, so that the belt will be ready for the next image formation.

Table 12 shows the results of imaging performed by the electrophotographic apparatus shown in FIG. 1. Table 13 gives evaluation results of the state of transfer defects in the character portion of a full-color image consisting of three overlapping colors of toner, and of how much the paper adheres to the fixing belt during fixing. The charge amount was measured by a friction charging blow-off method with a ferrite carrier. 0.3 g was sampled for durability evaluation, and was blown for 1 minute with nitrogen gas at $1.96\times10^4$ Pa at 25° C. and 45% RH.

TABLE 12

| developer | toner | carrier | photosensitive member filming | image density (ID) initial/after test | fogging | overall solid image uniformity | skipped characters during transfer | toner disruption during fixing |
|---|---|---|---|---|---|---|---|---|
| DM1 | TM1 | A1 | no | 1.42/1.48 | pass | pass | no | none |
| DM2 | TM2 | A2 | no | 1.41/1.50 | pass | pass | no | none |
| DM3 | TM3 | A3 | no | 1.44/1.48 | pass | pass | no | none |
| DM4 | TM4 | A4 | no | 1.40/1.48 | pass | pass | no | none |
| DM5 | TM5 | A1 | no | 1.48/1.46 | pass | pass | no | none |
| DM6 | TM6 | A2 | no | 1.41/1.51 | pass | pass | no | none |
| dm7 | tm7 | b1 | yes | 1.21/1.03 | fail | fail | yes | toner scattering |
| DY1 | TY1 | A1 | no | 1.49/1.39 | pass | pass | no | none |
| DY2 | TY2 | A2 | no | 1.41/1.38 | pass | pass | no | none |
| DY3 | TY3 | A3 | no | 1.48/1.45 | pass | pass | no | none |
| DY4 | TY4 | A4 | no | 1.41/1.39 | pass | pass | no | none |
| DY5 | TY5 | A1 | no | 1.47/1.42 | pass | pass | no | none |
| DY6 | TY6 | A2 | no | 1.48/1.44 | pass | pass | no | none |
| dy7 | Ty7 | b2 | yes | 1.28/1.03 | fail | fail | yes | toner scattering |
| DC1 | TC1 | A1 | no | 1.38/1.42 | pass | pass | no | none |
| DC2 | TC2 | A2 | no | 1.47/1.53 | pass | pass | no | none |
| DC3 | TC3 | A3 | no | 1.46/1.42 | pass | pass | no | none |
| DC4 | TC4 | A4 | no | 1.47/1.42 | pass | pass | no | none |
| DC5 | TC5 | A1 | no | 1.48/1.42 | pass | pass | no | none |
| DC6 | TC6 | A2 | no | 1.49/1.41 | pass | pass | no | none |

TABLE 12-continued

| developer | toner | carrier | photosensitive member filming | image density (ID) initial/after test | fogging | overall solid image uniformity | skipped characters during transfer | toner disruption during fixing |
|---|---|---|---|---|---|---|---|---|
| dc7 | Tc7 | b3 | yes | 1.21/1.02 | fail | fail | yes | toner scattering |
| DB1 | TB1 | A1 | no | 1.45/1.41 | pass | pass | no | none |
| DB2 | TB2 | A2 | no | 1.42/1.36 | pass | pass | no | none |
| DB3 | TB3 | A3 | no | 1.42/1.41 | pass | pass | no | none |
| DB4 | TB4 | A4 | no | 1.47/1.42 | pass | pass | no | none |
| DB5 | TB5 | A1 | no | 1.48/1.42 | pass | pass | no | none |
| DB6 | TB6 | A2 | no | 1.41/1.37 | pass | pass | no | none |
| db7 | Tb7 | b4 | yes | 1.24/1.03 | fail | fail | yes | toner scattering |

TABLE 13

| | first color developer | second color developer | third color developer | fourth color developer | back-transfer | partial transfer defects | adhesion to fixing belt |
|---|---|---|---|---|---|---|---|
| CC1 | DY1 | DM1 | DC1 | DB1 | no | no | no |
| CC2 | DY2 | DM2 | DC2 | DB2 | no | no | no |
| CC3 | DY3 | DM3 | DC3 | DB3 | no | no | no |
| CC4 | DY4 | DM4 | DC4 | DB4 | no | no | no |
| CC5 | DY5 | DM5 | DC5 | DB5 | no | no | no |
| CC6 | DY6 | DM6 | DC6 | DB6 | no | no | no |
| cc7 | dy7 | dm7 | dc7 | db7 | yes | yes | yes |

When images were produced using the developers, there was no horizontal line disruption, toner scattering, or partial transfer defects in characters, the solid black images were uniform, the resulting images were of extremely high quality and resolution and were reproduced at 16 lines/mm, and high density images having a density of 1.3 or more were obtained. No base fogging occurred in the non-image portions. Furthermore, when a long-term durability test was conducted with 10,000 sheets of A4 paper, there was little change in fluidity and image density, and the characteristics were stable. Uniformity was also good when an overall solid image was formed during development, and no developing memory occurred. There were no streaks in the images in continuous use. Nor was there any toner-spent onto the carrier. There was little change in carrier resistance or decrease in charge amount, and no fogging occurred. There was almost no fluctuation in the charge amount, whether under high or low temperature and humidity. The partial transfer defects that occurred during transfer were at a level low enough to pose no practical problem, and transfer efficiency was about 95%. Also, toner filming on the photosensitive member and the transfer belt was low enough to pose no practical problem. The transfer belt could be cleaned adequately. Almost no toner disruption or toner scattering occurred during fixing. Further, no transfer defects occurred in full-color images consisting of three overlapping colors, and the paper did not adhere to the fixing belt during fixing.

However, with the toners tm7, ty7, tc7, tb7 and the developers, skipped characters during transfer, partial transfer defects, and back-transfer were more or less at acceptable levels when the process speed was 100 mm/s and the photosensitive member gap was 70 mm, but when the process speed was raised to 125 mm/s, or when the photosensitive member gap was lowered to 60 mm, skipped characters during transfer, partial transfer defects, and back-transfer occurred at levels that were not practically acceptable. Fogging and filming of the photosensitive members also occurred more often.

Toner-spent on the carrier also occurred more frequently, there was considerable change in carrier resistance, the charge amount decreased, and fogging tended to increase. Also observed were an increase in fogging caused by a decrease in charge amount under high temperature and humidity, and a decrease in image density caused by an increase in charge amount under low temperature and humidity. The transfer efficiency dropped to about 60 to 70%. Filming of the transfer belt also occurred more often, and cleaning was not performed properly. There was thinness at the trailing half when an overall solid image was formed during development. Wax fused to the developing blade during continuous use, and streaks appeared in the images. The paper adhered to the transfer belt during the output of images having three overlapping colors. Toner scattering occurred during fixing.

Table 14 shows the result of an offset resistance test conducted with a fixing apparatus featuring a belt not coated with oil, in which a solid image applied in an amount of at least 1.2 mg/cm$^2$ to an OHP sheet was produced at a process speed of 100 mm/s. No jamming of the OHP sheets occurred in the fixing nip. When an overall solid green image was formed on plain paper, no offset whatsoever occurred up to the 122,000$^{th}$ sheet. No degradation of the belt surface was seen even though it was a silicone or fluorine-based fixing belt not coated with oil.

Optical transmissivity and high-temperature offset resistance were evaluated. The transmissivity of light of 700 nm was measured with a U-3200 spectrophotometer (Hitachi) at a process speed of 100 mm/s and a fixing temperature of 180° C. The table below shows the results for fixability, offset resistance, and preservation stability.

TABLE 14

| | OHP transmissivity (%) | high-temp. offset occurrence temp. (° C.) | preservation stability test |
|---|---|---|---|
| TM1 | 89.8 | 220 | pass |
| TM2 | 90.8 | 230 | pass |
| TM3 | 92.5 | 230 | pass |
| TM4 | 91.7 | 230 | pass |
| TM5 | 93.8 | 220 | pass |
| TM6 | 91.8 | 230 | pass |
| tm7 | 89.8 | offset occurred over entire temp. range | fail |
| TC1 | 90.6 | 220 | pass |
| TC2 | 92.8 | 230 | pass |
| TC3 | 93.5 | 230 | pass |
| TC4 | 94.5 | 230 | pass |
| TC5 | 92.8 | 220 | pass |
| TC6 | 93.2 | 230 | pass |
| tc7 | 88.2 | offset occurred over entire temp. range | fail |

OHP transmissivity was over 80%, and the offset resistance temperature range was from 40 to 60° C., meaning that good fixability was exhibited with a fixing roller not coated with oil. Almost no agglomeration was seen in a preservation stability test for 5 hours at 60° C.

The toners tm7 and tc7, on the other hand, caked in the preservation stability test, and its offset resistance temperature range was narrow.

INDUSTRIAL APPLICABILITY

The present invention provides a toner having an additive that includes an inorganic micropowder whose surface is treated with polysiloxane and one or two or more of fatty acids, fatty acid esters, fatty acid amides, and fatty acid metal salts; and a two-component developer in which the toner is combined with a carrier whose coating resin is a fluorine-modified silicone resin containing an aminosilane coupling agent. This makes possible oil-less fixing, in which offset can be prevented while maintaining OHP transmissivity, even without the use of an oil. This also eliminates toner-spent on the carrier, and extends the service life of the developer. In addition, partial transfer defects are reduced and high transfer efficiency can be obtained.

The invention claimed is:

1. A toner comprising an additive and a toner matrix that comprises a binder resin, a colorant, and a wax, wherein the additive contains an inorganic micropowder to whose surface polysiloxane and at least one selected from fatty acids and derivatives thereof are adhered, wherein the at least one selected from fatty acids and derivatives thereof is at least one selected from the following groups (1),(2), (3) and (4):

(1) a group of fatty acids consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid;

(2) a group of fatty acid esters consisting of a fatty acid pentaerythritol monoester, a fatty acid pentaerythritol triester, and a fatty acid trimethylol propane ester;

(3) a group of aliphatic amides consisting of palmitic acid amide, palmitoleic acid amide, stearic acid amide, oleic acid amide, arachidic acid amide, eicosenoic acid amide, behenic acid amide, erucic acid amide, and lignoceric acid amide; and, (4) a group of fatty acid metal salts consisting of salts of at least one fatty acid selected from the group consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid with at least one metal selected from the group consisting of aluminum, zinc, calcium, magnesium, lithium, sodium, lead, and barium, and wherein the inorganic micropowder to whose surface polysiloxane and at least one selected from fatty acids and derivatives thereof are adhered is obtained by the step of:

mixing an inorganic micropowder with a solution of the polysiloxane and the at least one selected from fatty acids and derivatives thereof dissolved in an organic solvent and then drying the obtained product.

2. The toner according to claim 1, wherein an average particle size of the inorganic micropowder is in a range of 30 nm to 200 nm.

3. The toner according to claim 1, wherein the additive further contains a negatively-chargeable silica micropowder whose average particle size is in a range of 6 nm to 30 nm.

4. The toner according to claim 1, wherein a mixing ratio between (A) the at least one selected from fatty acids and derivatives thereof and (B) the polysiloxane is A:B=2:1 to 1:20.

5. The toner according to claim 1, wherein the polysiloxane is at least one selected from dimethylpolysiloxane, diphenyl polysiloxane, methylphenyl polysiloxane, phenyl hydrogen polysiloxane, methyl hydrogen polysiloxane, and phenyl hydrogen methyl hydrogen polysiloxane.

6. The toner according to claim 1, wherein with respect to the inorganic micropowder to whose surface polysiloxane and the at least one selected from fatty acids and derivatives thereof have been adhered, an ignition loss is 5 to 25 wt %, when the inorganic micropowder is ignited at 500° C. for 2 hours.

7. The toner according to claim 1, wherein the wax is an ester-based wax with an endothermic peak temperature (as found by DSC) of 50 to 120° C., an iodine value of 25 or less, a saponification value of 30 to 300, a number average molecular weight (as determined by gel permeation chromatography (GPC)) of 100 to 5000, a weight average molecular weight of 200 to 10,000, a ratio of the weight average molecular weight to the number average molecular weight (weight average molecular weight/number average molecular weight) of 1.01 to 8, and a ratio of Z average molecular weight to the number average molecular weight (Z average molecular weight/number average molecular weight) of 1.02 to 10, and having at least one molecular weight maximum peak in a molecular weight region from $5\times10^2$ to $1\times10^4$.

8. The toner according to claim 1, wherein the wax is obtained by reacting a $C_4$ to $C_{30}$ long chain alkyl alcohol, an unsaturated polycarboxylic acid or anhydride thereof, and a hydrocarbon wax, has a molecular weight distribution (as determined by GPC) such that a weight average molecular weight is from 1000 to 6000, a Z average molecular weight is from 1500 to 9000, a ratio of the weight average molecular weight to number average molecular weight (weight average molecular weight/number average molecular weight) is from 1.1 to 3.8, a ratio of the Z average molecular weight to the number average molecular weight (Z average molecular weight/number average molecular weight) is from 1.5 to 6.5, and there is at least one molecular weight maximum peak in a region from $1\times10^3$ to $3\times10^4$, and the presence of an endothermic peak temperature (as found by DSC) of from 80° C. to 120° C., and an acid value of from 5 to 80 mgKOH/g.

9. The toner according to claim 1, wherein the wax is at least one wax selected from a wax based on an aliphatic amide having at least 16 to 24 carbon atoms, and a wax based on an alkylenebis fatty acid amide of a saturated or a mono- or diunsaturated fatty acid.

10. The toner according to claim 1, wherein the wax is at least one wax selected from the group consisting of hydroxystearic acid derivatives, glycerol fatty acid esters, glycol fatty acid esters, and sorbitan fatty acid esters.

11. A toner comprising an additive and a toner matrix that comprises a binder resin, a colorant, and a wax, wherein the additive contains an inorganic micropowder to whose surface polysiloxane and at least one selected from fatty acids and derivatives thereof are adhered, wherein the at least one selected from fatty acids and derivatives thereof is at least one selected from the following groups (1), (2), (3) and (4):

(1) a group of fatty acids consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid;

(2) a group of fatty acid esters consisting of a fatty acid pentaerythritol monoester, a fatty acid pentaerythritol triester, and a fatty acid trimethylol propane ester;

(3) a group of aliphatic amides consisting of palmitic acid amide, palmitoleic acid amide, stearic acid amide, oleic acid amide, arachidic acid amide, eicosenoic acid amide, behenic acid amide, erucic acid amide, and lignoceric acid amide; and (4) a group of fatty acid metal salts consisting of salts of at least one fatty acid selected from the group consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid with at least one metal selected from the group consisting of aluminum, zinc, calcium, magnesium, lithium, sodium, lead, and and barium, and wherein the inorganic micropowder to whose surface polysiloxane and at least one selected from fatty acids and derivatives thereof are adhered is obtained by the steps of:

mixing an inorganic micropowder with a solution of polysiloxane dissolved in an organic solvent, mixing the polysiloxane-treated inorganic micropowder with a solution of the at least one selected from fatty acids and derivatives thereof dissolved in an organic solvent, and then drying the obtained product.

12. A toner comprising an additive and a toner matrix that comprises a binder resin, a colorant, and a wax, wherein the additive contains an inorganic micropowder to whose surface polysiloxane and at least one selected from fatty acids and derivatives thereof are adhered, wherein the at least one selected from fatty acids and derivatives thereof is at least one selected from the following groups (1), (2), (3) and (4):

(1) a group of fatty acids consisting of caprylic acid, capric acid, undecylic acid, laurie acid, myristic acid, palmitic acid, stearic acid, behenic acid, montanic acid, lacceric acid, oleic acid, erucic acid, sorbic acid, and linoleic acid;

(2) a group of fatty acid esters consisting of a fatty acid pentaerythritol monoester, a fatty acid pentaerythritol triester, and a fatty acid trimethylol propane ester;

(3) a group of aliphatic amides consisting of palmitic acid amide, palmitoleic acid amide, stearic acid amide, oleic acid amide, arachidic acid amide, eicosenoic acid amide, behenic acid amide, erucic acid amide, and lignoceric acid amide; and (4) a group of fatty acid metal salts consisting of salts of at least one fatty acid selected from the group consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid with at least one metal selected from the group consisting of aluminum, zinc, calcium, magnesium, lithium, sodium, lead, and barium, and wherein the inorganic micropowder to whose surface polysiloxane and at least one selected from fatty acids and derivatives thereof are adhered is obtained by the steps of:

mixing an inorganic micropowder with a solution of at least one of a coupling agent, polysiloxane, and a mixture thereof dissolved in an organic solvent, mixing the at least one of the coupling agent-, the polysiloxane-, or the mixture thereof-treated inorganic micropowder with a solution of the polysiloxane and the at least one selected from fatty acids and derivatives thereof in an organic solvent, and then drying the obtained product.

13. A two-component developer comprising, a toner comprising an additive and a toner matrix that comprises at least a binder resin, a colorant, and a wax, and a carrier, wherein the additive contains an inorganic micropowder to whose surface polysiloxane and at least one selected from fatty acids and derivatives thereof are adhered, wherein the at least one selected from fatty acids and derivatives thereof is at least one selected from the following groups (1), (2), (3) and (4):

(1) a group of fatty acids consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid;

(2) a group of fatty acid esters consisting of a fatty acid pentaerythritol monoester, a fatty acid pentaerythritol triester, and a fatty acid trimethylol propane ester;

(3) a group of aliphatic amides consisting of palmitic acid amide, palmitoleic acid amide, stearic acid amide, oleic acid amide, arachidic acid amide, eicosenoic acid amide, behenic acid amide, erucic acid amide, and lignoceric acid amide; and (4) a group of fatty acid metal salts consisting of salts of at least one fatty acid selected from the group consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid with at least one metal selected from the group consisting of aluminum, zinc, calcium, magnesium, lithium, sodium, lead, and barium, wherein the carrier comprises a core material whose surface is coated with a resin containing a fluorine-modified silicone resin containing an aminosilane coupling agent, and wherein the inorganic micropowder to whose surface polysiloxane and at least one selected from fatty acids and derivatives thereof are adhered is obtained by the step of:

mixing an inorganic micropowder with a solution of the polysiloxane and the at least one selected from fatty acids and derivatives thereof dissolved in an organic solvent and then drying the obtained product.

14. The two-component developer according to claim 13, wherein an average particle size of the inorganic micropowder is in a range of 30 nm to 200 nm.

15. The two-component developer according to claim 13, wherein the additive further contains a negatively-chargeable silica micropowder whose average particle size is in a range of 6 nm to 30 nm.

16. The two-component developer according to claim 13, wherein a mixing ratio between (A) the at least one selected from fatty acids and derivatives thereof and (B) the polysiloxane is A:B=2:1 to 1:20.

17. The two-component developer according to claim 13, wherein the polysiloxane is at least one selected from dimethylpolysiloxane, diphenyl polysiloxane, methylphenyl polysiloxane, phenyl hydrogen polysiloxane, methyl hydrogen polysiloxane, and phenyl hydrogen methyl hydrogen polysiloxane.

18. The two-component developer according to claim 13, wherein with respect to the inorganic micropowder to whose surface polysiloxane and the at least one selected from fatty acids and derivatives thereof have been adhered an ignition loss is 5 to 25 wt %, when the inorganic micropowder is ignited at 500° C. for 2 hours.

19. The two-component developer according to claim 13, wherein the wax is an ester-based wax with an endothermic peak temperature (as found by DSC) of 50 to 120° C., an iodine value of 25 or less, a saponification value of 30 to 300, a number average molecular weight (as determined by gel permeation chromatography (GPC)) of 100 to 5000, a weight average molecular weight of 200 to 10,000, a ratio of the weight average molecular weight to the number average molecular weight (weight average molecular weight/number average molecular weight) of 1.01 to 8, and a ratio of Z average molecular weight to the number average molecular weight (Z average molecular weight/number average molecular weight) of 1.02 to 10, and the presence of at least one molecular weight maximum peak in a molecular weight region from $5\times10^2$ to $1\times10^4$.

20. The two-component developer according to claim 13, wherein the wax is obtained by reacting a $C_4$ to $C_{30}$ long chain alkyl alcohol, an unsaturated polycarboxylic acid or anhydride thereof, and a hydrocarbon wax, has a molecular weight distribution (as determined by GPC) such that a weight average molecular weight is from 1000 to 6000, a Z average molecular weight is from 1500 to 9000, a ratio of the weight average molecular weight to number average molecular weight (weight average molecular weight/number average molecular weight) is from 1.1 to 3.8, a ratio of the Z average molecular weight to the number average molecular weight (Z average molecular weight/number average molecular weight) is from 1.5 to 6.5, and the presence of at least one molecular weight maximum peak in a region from $1\times10^3$ to $3\times10^4$, and has an endothermic peak temperature (as found by DSC) of from 80° C. to 120° C. and an acid value of from 5 to 80 mgKOH/g.

21. The two-component developer according to claim 13, wherein the wax is at least one wax selected from a wax based on an aliphatic amide having at least 16 to 24 carbon atoms, and a wax based on an alkylenebis fatty acid amide of a saturated or a mono- or diunsaturated fatty acid.

22. The two-component developer according to claim 13, wherein the wax is at least one wax selected from the group consisting of hydroxystearic acid derivatives, glycerol fatty acid esters, glycol fatty acid esters, and sorbitan fatty acid esters.

23. The two-component developer according to claim 13, wherein the coating resin of the carrier contains the aminosilane coupling agent in a proportion of 5 to 40 parts by weight per 100 parts by weight of the coating resin.

24. The two-component developer according to claim 13, wherein the coating resin of the carrier contains a conductive micropowder in a proportion of 1 to 15 parts by weight per 100 parts by weight of the coating resin.

25. A two-component developer comprising, a toner comprising an additive and a toner matrix that comprises at least a binder resin, a colorant, and a wax, and a carrier, wherein the additive contains an inorganic micropowder to whose surface polysiloxane and at least one selected from fatty acids and derivatives thereof are adhered, wherein the at least one selected from fatty acids and derivatives thereof is at least one selected from the following groups (1), (2), (3) and (4):

(1) a group of fatty acids consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid;

(2) a group of fatty acid esters consisting of a fatty acid pentaerythritol monoester, a fatty acid pentaerythritol triester, and a fatty acid trimethylol propane ester;

(3) a group of aliphatic amides consisting of palmitic acid amide, palmitoleic acid amide, stearic acid amide, oleic acid amide, arachidic acid amide, eicosenoic acid amide, behenic acid amide, erucic acid amide, and lignoceric acid amide; and (4) a group of fatty acid metal salts consisting of salts of at least one fatty acid selected from the group consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid with at least one metal selected from the group consisting of aluminum, zinc, calcium, magnesium, lithium, sodium, lead, and barium, wherein the carrier comprises a core material whose surface is coated with a resin containing a fluorine-modified silicone resin containing an aminosilane coupling agent, and wherein the inorganic micropowder to whose surface polysiloxane and at least one selected from fatty acids and derivatives thereof are adhered is obtained by the steps of:

mixing an inorganic micropowder with a solution of polysiloxane dissolved in an organic solvent, mixing the polysiloxane-treated inorganic micropowder with a solution of the at least one selected from fatty acids and derivatives thereof dissolved in an organic solvent, and then drying the obtained product.

26. A two-component developer comprising, a toner comprising an additive and a toner matrix that comprises at least a binder resin, a colorant, and a wax, and a carrier, wherein the additive contains an inorganic micropowder to whose surface polysiloxane and at least one selected from fatty acids and derivatives thereof are adhered, wherein the at least one selected from fatty acids and derivatives thereof is at least one selected from the following groups (1), (2), (3) and (4):

(1) a group of fatty acids consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid;

(2) a group of fatty acid esters consisting of a fatty acid pentaerythritol monoester, a fatty acid pentaerythritol triester, and a fatty acid trimethylol propane ester;

(3) a group of aliphatic amides consisting of palmitic acid amide, palmitoleic acid amide, stearic acid amide, oleic acid amide, arachidic acid amide, eicosenoic acid amide, behenic acid amide, erucic acid amide, and lignoceric acid amide; and (4) a group of fatty acid metal salts consisting of salts of at least one fatty acid selected from the group consisting of caprylic acid, capric acid, undecylic acid, lauric acid, myristic acid, palmitic acid, stearic acid, behenic acid, montanic acid, lacceric acid, oleic acid, erucic acid, sorbic acid, and linoleic acid with at least one metal selected from the group consisting of aluminum, zinc, calcium, magnesium, lithium, sodium, lead, and barium, wherein the carrier comprises a core material whose surface is coated with a resin containing a fluorine-modified silicone resin containing an aminosilane coupling agent, and wherein the inorganic micropowder to whose surface polysiloxane and at least one selected from fatty acids and derivatives thereof are adhered is obtained by the steps of:

mixing an inorganic micropowder with a solution of at least one of a coupling agent, polysiloxane, or a mixture thereof dissolved in an organic solvent, mixing the at least one of the coupling agent-, the polysiloxane-, or the mixture thereof-treated inorganic micropowder with a solution of the polysiloxane and the at least one selected from fatty acids and derivatives thereof in an organic solvent, and then drying the obtained product.

* * * * *